US010632760B2

(12) United States Patent
Kimura et al.

(10) Patent No.: US 10,632,760 B2
(45) Date of Patent: Apr. 28, 2020

(54) THERMAL PRINTHEAD

(71) Applicant: Rohm Co., Ltd., Kyoto-shi, Kyoto (JP)

(72) Inventors: Toshihiro Kimura, Kyoto (JP); Akira Fujita, Kyoto (JP); Kazuya Nakakubo, Kyoto (JP); Satoshi Kimoto, Kyoto (JP); Yasuhiro Yoshikawa, Kyoto (JP); Tadashi Yamamoto, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/280,791

(22) Filed: Feb. 20, 2019

(65) Prior Publication Data

US 2019/0263141 A1 Aug. 29, 2019

(30) Foreign Application Priority Data

Feb. 26, 2018 (JP) ..... 2018-031837
Mar. 22, 2018 (JP) ..... 2018-053818
Jan. 8, 2019 (JP) ..... 2019-001124

(51) Int. Cl.
*B41J 2/335* (2006.01)
*B41J 2/34* (2006.01)
*B41J 2/345* (2006.01)

(52) U.S. Cl.
CPC ..... *B41J 2/33515* (2013.01); *B41J 2/3351* (2013.01); *B41J 2/3353* (2013.01); *B41J 2/3355* (2013.01); *B41J 2/33535* (2013.01); *B41J 2/34* (2013.01); *B41J 2/345* (2013.01)

(58) Field of Classification Search
CPC .... B41J 2/33515; B41J 2/3353; B41J 2/3355; B41J 2/34; B41J 2/3351; B41J 2/33535; B41J 2/345
See application file for complete search history.

(56) References Cited

U.S. PATENT DOCUMENTS 5,055,859 A * 10/1991 Wakabayashi ..... B41J 2/3357 219/543
7,692,676 B1 * 4/2010 Shirakawa ..... B41J 2/33525 347/208
9,660,150 B2 * 5/2017 Nishimura ..... H01L 33/62

FOREIGN PATENT DOCUMENTS

JP 01-192568 * 8/1989 ..... B41J 2/345
JP 04-016361 * 1/1992 ..... B41J 2/335
JP 2017-65021 A 4/2017

OTHER PUBLICATIONS

English translation of JP 04-016361, published on Jan. 1992 (Year: 1992).*

* cited by examiner

*Primary Examiner* — Huan H Tran
(74) *Attorney, Agent, or Firm* — Hamre, Schumann, Mueller & Larson, P.C.

(57) ABSTRACT

A thermal printhead includes a substrate, a resistor layer with heat generation portions supported by the substrate and aligned in a primary scanning direction, a wiring layer supported by the substrate to form a conductive path to the heat generation portions, an insulating layer interposed between the substrate and the resistor layer, and a reflection layer located opposite to the heat generation portions with respect to the insulating layer. The reflection layer overlaps with the heat generation portions as viewed in a thickness direction of the heat generation portions and has a greater heat reflectivity than the insulating layer.

13 Claims, 47 Drawing Sheets

A62

A82

THERMAL PRINTHEAD

FIELD

The present disclosure relates to a thermal printhead.

BACKGROUND

JP-A-2017-65021 discloses an example of a conventional thermal printhead that includes: a main substrate provided with a wiring layer and a resistor layer; and an auxiliary substrate equipped with a driver IC. The resistor layer includes multiple heating portions aligned in a primary scanning direction.

In the printing performed by the thermal printhead, the heat generation portion of the resistor layer generates heat through electric conduction. This heat is transmitted, whereby the printing paper is colored and printing is performed.

SUMMARY

The present disclosure is based on the foregoing circumstance, and aims to provide a thermal printhead according to which printing quality can be improved. Also, the present disclosure aims to provide a thermal printhead according to which it is possible to improve durability and reliability without causing deterioration of the printing efficiency.

A thermal head provided by the present disclosure includes: a substrate; a resistor layer including a plurality of heat generation portions that are supported by the substrate and are aligned in a primary scanning direction; a wiring layer that is supported by the substrate and forms a conductive path to the plurality of heat generation portions; an insulating layer interposed between the substrate and the resistor layer; and a reflection layer that is located on the side of the insulating layer opposite to the plurality of heat generation portions, overlaps with the plurality of heat generation portions in a view in a thickness direction of the plurality of heat generation portions, and has a greater heat reflectivity than the insulating layer.

In accordance with the above arrangements, it is possible to improve printing quality.

Other features and advantages will become apparent through detailed description given below with reference to the accompanying drawings.

EMBODIMENTS

Figure 1:
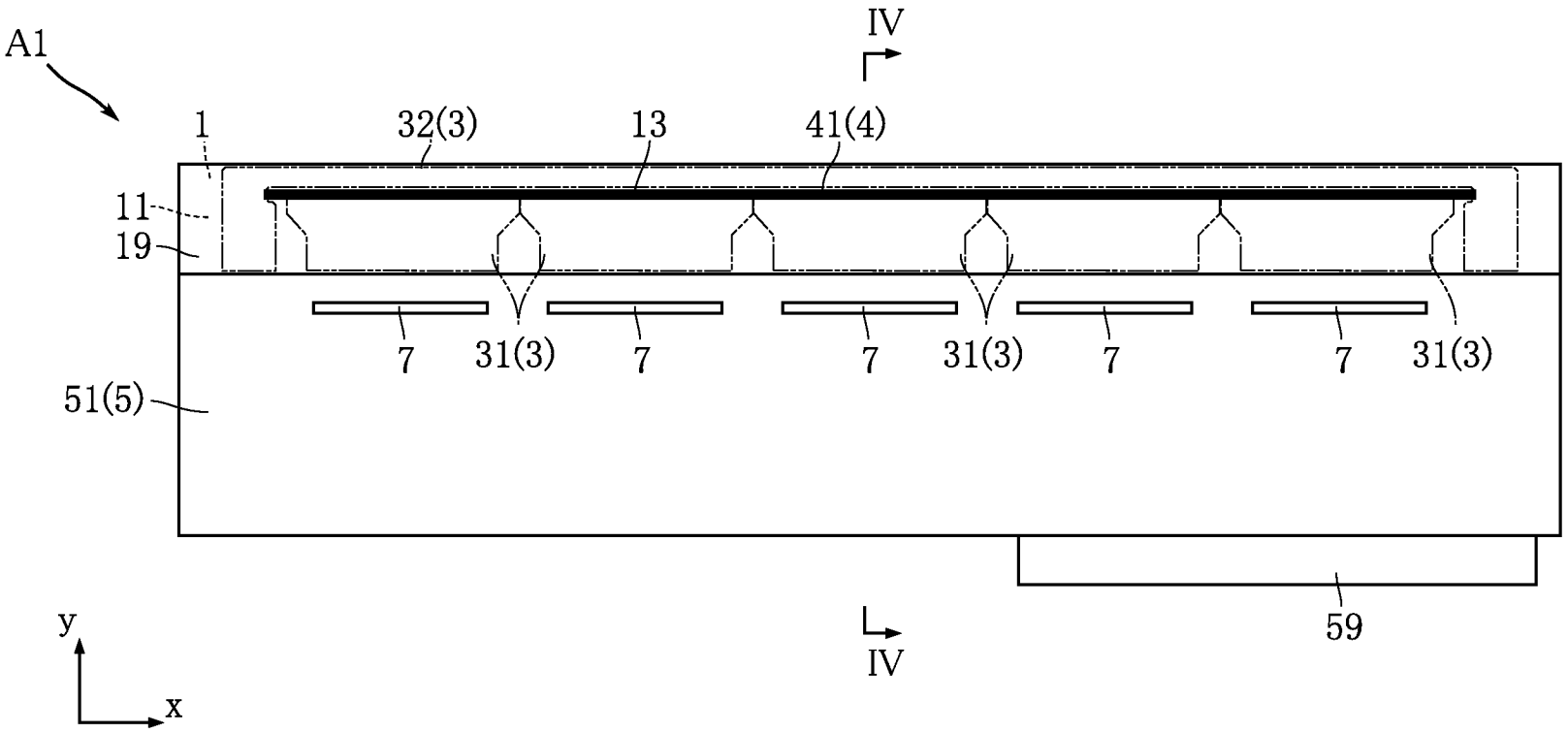
FIG. 1 is a plan view showing a thermal printhead according to a first embodiment.

Hereinafter, embodiments of the present disclosure will be described specifically with reference to the drawings.

Terms such as "first", "second", and "third" in the present disclosure are used simply as labels and are not necessarily intended to denote the sequence of the target objects.

FIGS. 1 to 6 show a thermal printhead according to a first embodiment. A thermal printhead A1 of the present embodiment includes a first substrate 1, a reflection layer 15, an insulating layer 19, a protection layer 2, a wiring layer 3, a resistor layer 4, a second substrate 5, a driver IC 7, and a heat dissipation member 8. The thermal printhead A1 is incorporated in a printer that carries out printing on a printing medium (not shown) that is conveyed held between platen rollers 91. Examples of this kind of printing medium include heat-sensitive paper for creating a barcode sheet or a receipt.

Figure 2:
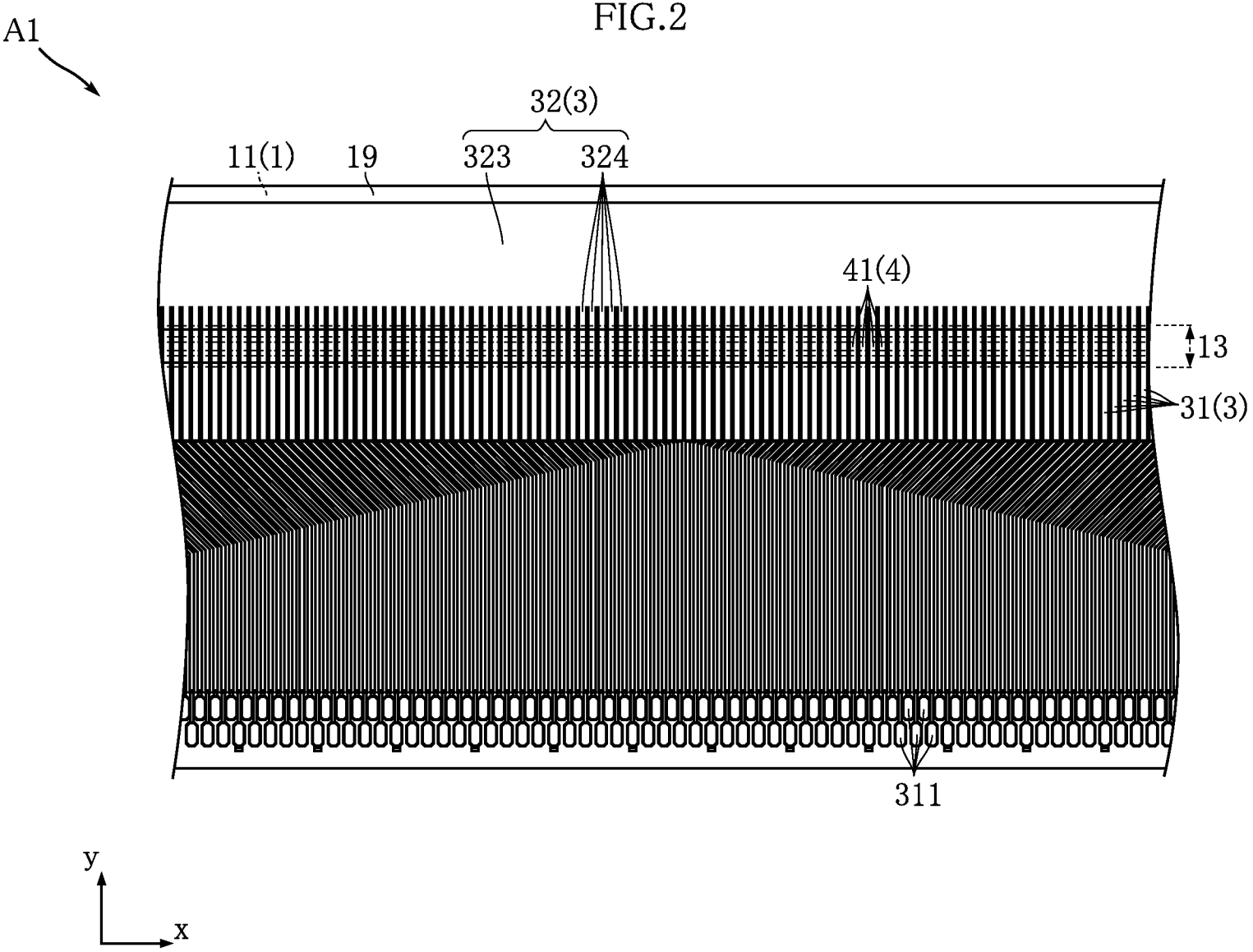
FIG. 2 is a plan view showing a portion of the thermal printhead according to the first embodiment.
Figure 3:
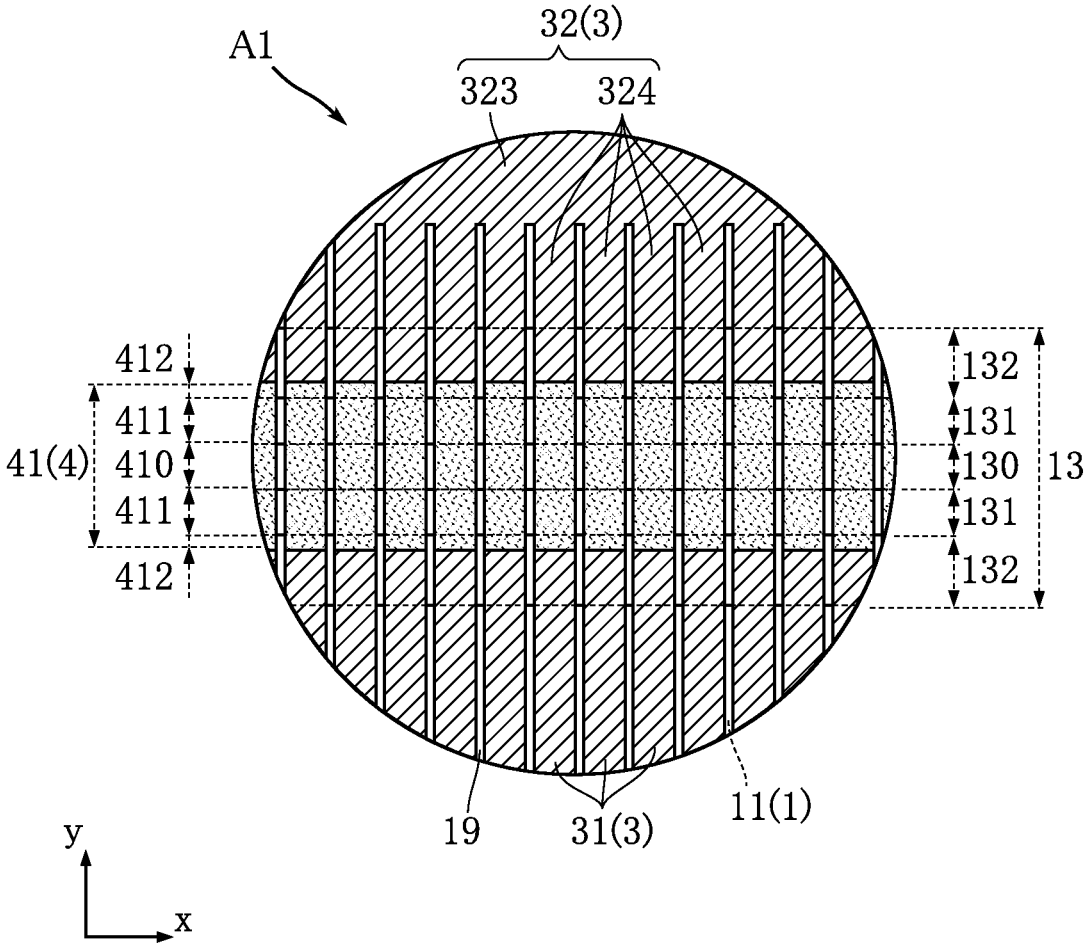
FIG. 3 is an enlarged plan view showing a portion of the thermal printhead according to the first embodiment.
Figure 4:
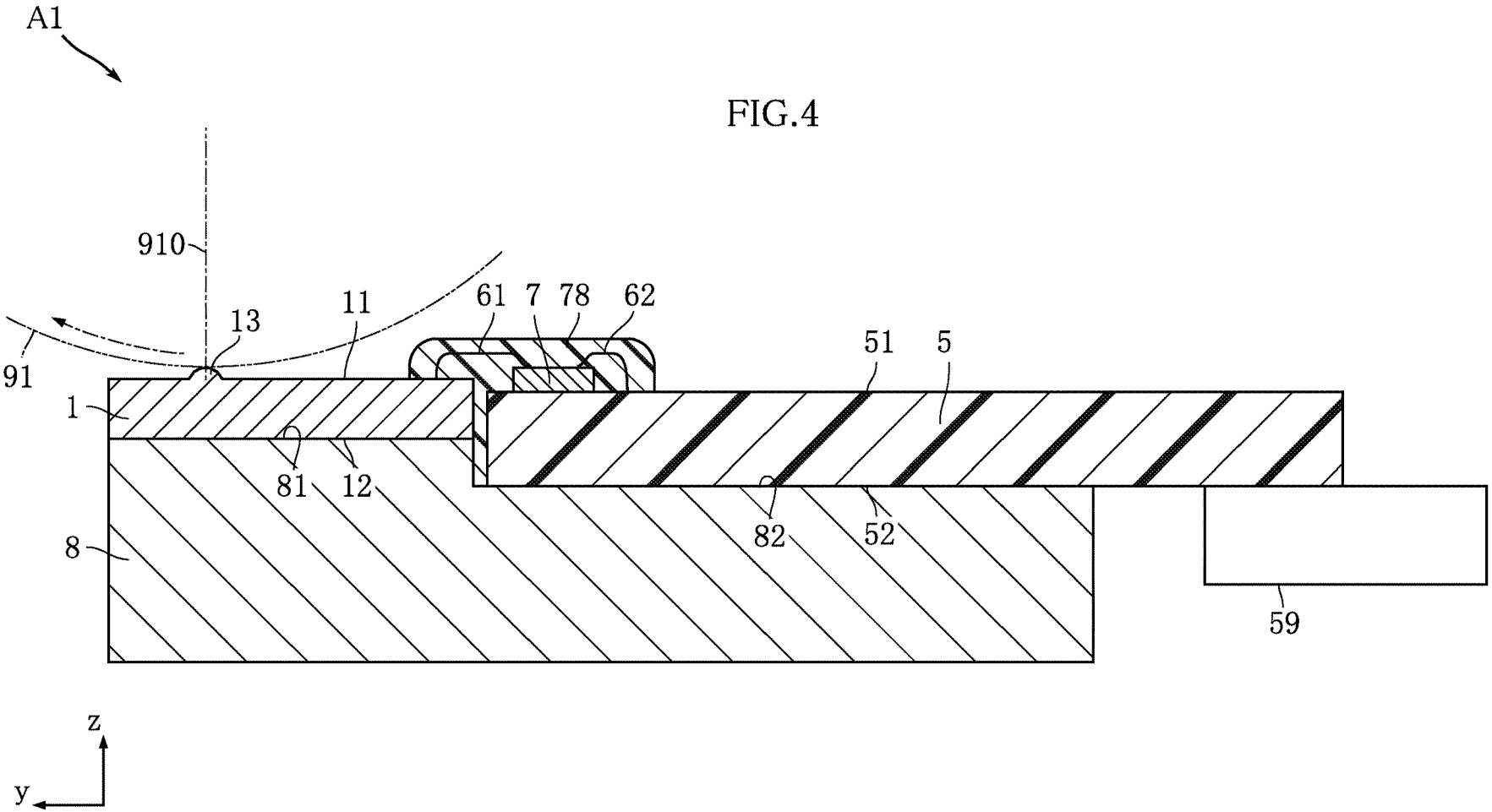
FIG. 4 is a cross-sectional view taken along line IV-IV shown in FIG. 1.
Figure 5:
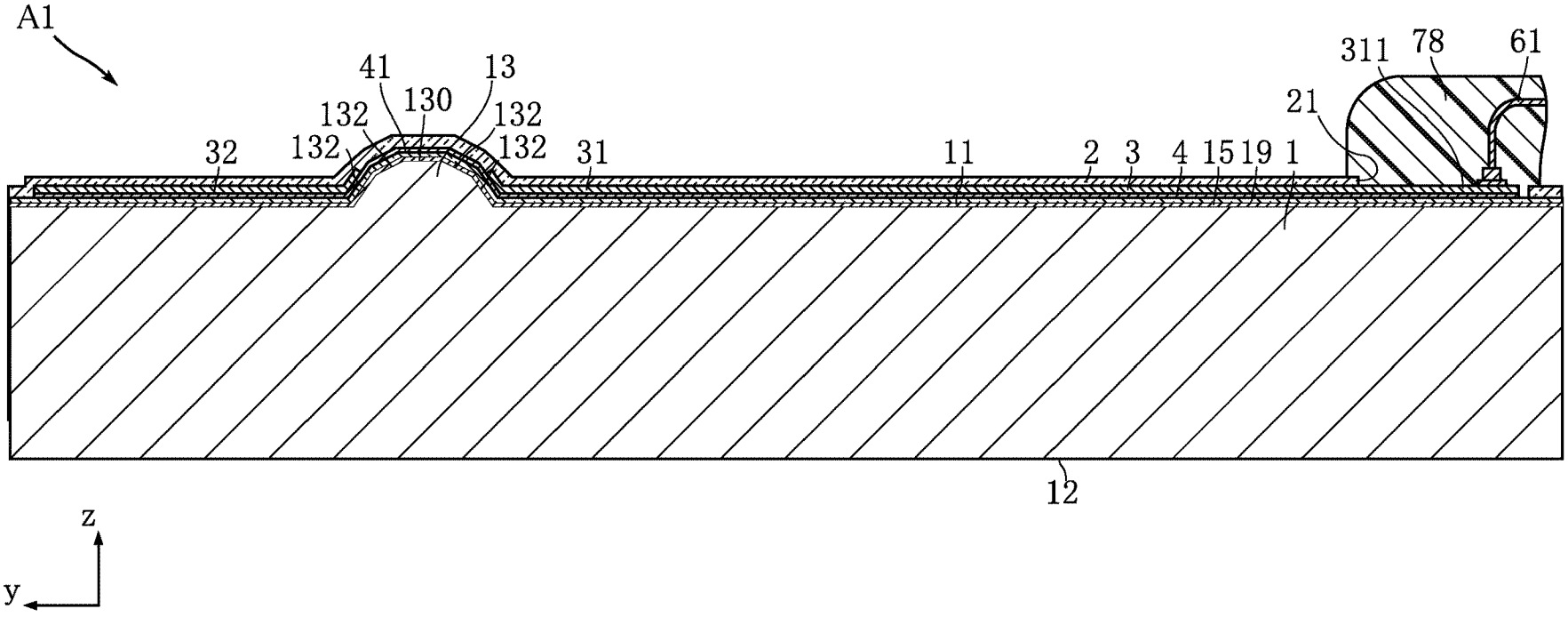
FIG. 5 is a cross-sectional view showing a portion of the thermal printhead according to the first embodiment.
Figure 6:
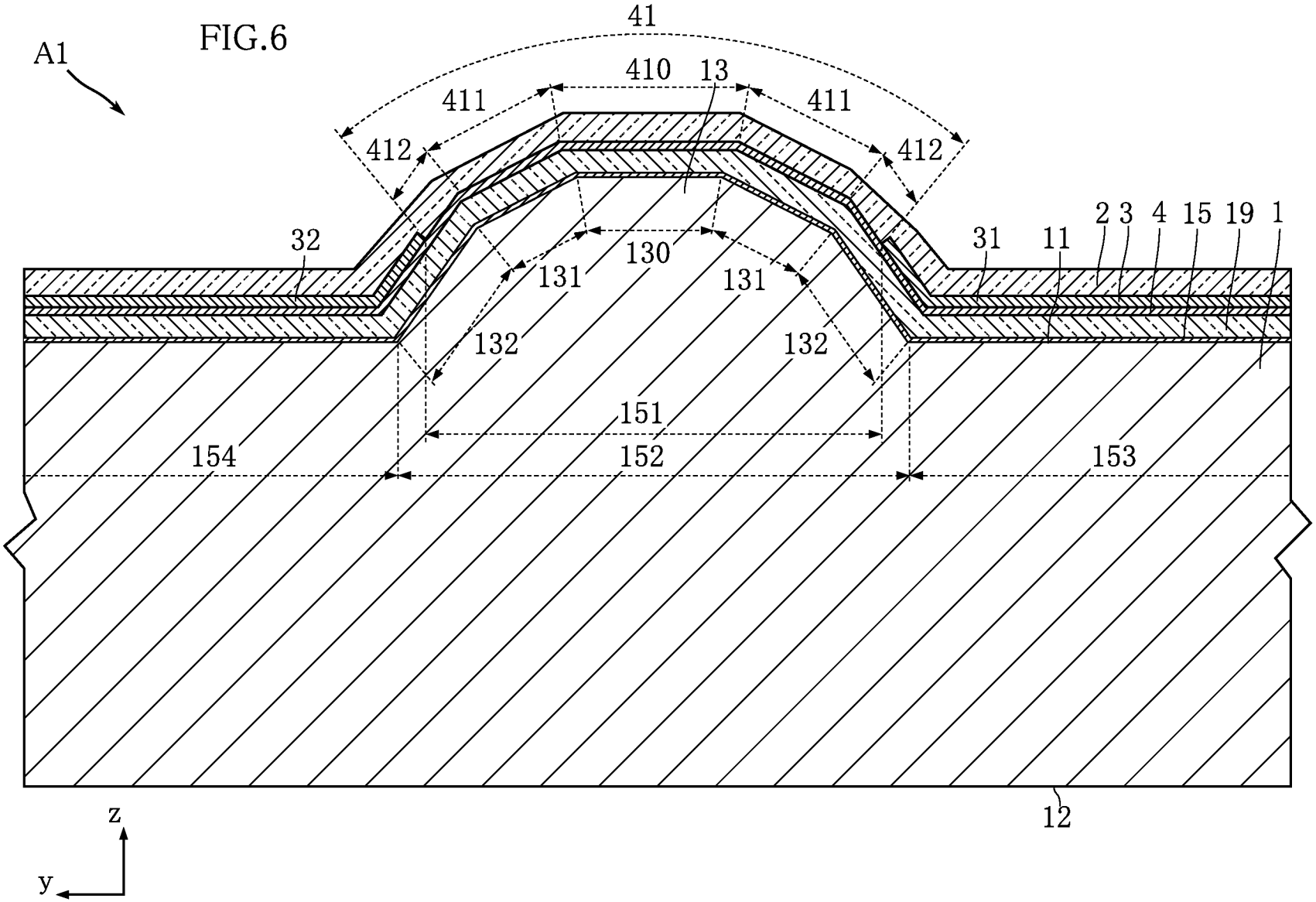
FIG. 6 is an enlarged cross-sectional view showing a portion of the thermal printhead according to the first embodiment.

FIG. 1 is a plan view showing the thermal printhead A1. FIG. 2 is a plan view showing a portion of the thermal printhead A1. FIG. 3 is an enlarged plan view showing a portion of the thermal printhead A1. FIG. 4 is a cross-sectional diagram taken along line IV-IV shown in FIG. 1. FIG. 5 is a cross-sectional view showing a portion of the thermal printhead A1. FIG. 6 is an enlarged cross-sectional view showing a portion of the thermal printhead A1. In order to facilitate comprehension, the protection layer 2 is not shown in FIGS. 1 to 3. In order to facilitate comprehension, later-described protection resin 78 is not shown in FIGS. 1 and 2. In order to facilitate comprehension, a later-described wire 61 is not shown in FIG. 2. In FIGS. 1 to 3, the lower side of the diagram in the secondary scanning direction y is the upstream side, and the upper side of the diagram is the downstream side. In FIGS. 4 to 6, the right side of the diagram in the secondary scanning direction y is the upstream side, and the left side of the diagram is the downstream side.

The first substrate 1 supports the wiring layer 3 and the resistor layer 4 and corresponds to the substrate of the present disclosure. The first substrate 1 has a long and thin rectangular shape in which the longitudinal direction is a primary scanning direction x and the width direction is a secondary scanning direction y. In the following description, the thickness direction of the first substrate 1 is described as a thickness direction z. Although the thickness of the first substrate 1 is not particularly limited, the thickness of the first substrate 1 is, for example, 725 μm. Also, the dimension in the primary scanning direction x of the first substrate 1 is, for example, 100 mm to 150 mm, and the dimension in the secondary scanning direction y of the first substrate 1 is, for example, 2.0 mm to 5.0 mm.

In the present embodiment, the first substrate 1 is composed of a single-crystal semiconductor and is made of Si, for example. As shown in FIGS. 4 and 5, the first substrate 1 has a first front surface 11 and a first rear surface 12. The first front surface 11 and the first rear surface 12 face mutually opposite sides in the thickness direction z. The wiring layer 3 and the resistor layer 4 are provided on the first front surface 11. The first front surface 11 corresponds to the front surface of the present disclosure.

The first substrate 1 includes a protrusion 13. The protrusion 13 protrudes from the first front surface 11 in the thickness direction z and extends lengthwise in the primary scanning direction x. In the example illustrated in the drawings, the protrusion 13 is formed near the downstream side in the secondary scanning direction y of the first substrate 1. Also, due to the fact that the protrusion 13 is part of the first substrate 1, it is composed of Si, which is a single-crystal semiconductor.

In the present embodiment, the protrusion 13 has a peak portion 130, a pair of first inclined portions 131, and a pair of second inclined portions 132.

The peak portion 130 is the portion of the protrusion 13 that has the greatest distance from the first front surface 11. In the present embodiment, the peak portion 130 is composed of a flat surface parallel to the first front surface 11. The peak portion 130 is a long and thin rectangular surface that extends lengthwise in the primary scanning direction x as viewed in the thickness direction z.

The pair of first inclined portions 131 are connected to both sides of the peak portion 130 in the secondary scanning direction y. Each of the pair of first inclined portions 131 is inclined by an angle $\alpha 1$ with respect to the first front surface 11. The first inclined portion 131 is a long and thin rectangular flat surface that extends lengthwise in the primary scanning direction x as viewed in the thickness direction z. Note that the protrusion 13 may also include inclined portions (not shown) that connect to the pair of first inclined portions 131 and are adjacent to both ends in the primary scanning direction x of the peak portion 130.

A pair of second inclined portions 132 are connected at both sides in the secondary scanning direction y to the pair of first inclined portions 131. Each of the pair of second inclined portions 132 is inclined by an angle $\alpha 2$, which is greater than the angle $\alpha 1$, with respect to the first front surface 11. The second inclined portions 132 are long and thin rectangular flat surfaces that extend lengthwise in the primary scanning direction x as viewed in the thickness direction z. In the present embodiment, the pair of second inclined portions 132 are connected to the first front surface 11. Note that the protrusion 13 may also include inclined portions (not shown) that connect to the pair of second inclined portions 132 and are located outward in the primary scanning direction x of both ends in the primary scanning direction x of the peak portion 130.

In the present embodiment, the first front surface 11 is a (100) surface. According to an exemplary later-described manufacturing method, the angle $\alpha 1$ formed by the first inclined portion 131 and the first front surface 11 is 30.1 degrees, and the angle $\alpha 2$ formed by the second inclined portion 132 and the first front surface 11 is 54.8 degrees. The dimension in the thickness direction z of the protrusion 13 is, for example, 150 μm to 300 μm.

As shown in FIGS. 5 and 6, the insulating layer 19 covers the first front surface 11 and the protrusion 13, and is for more reliably insulating the first front surface 11 of the first substrate. The insulating layer 19 is composed of an insulating material such as $SiO_2$, SiN, or TEOS (tetraethyl orthosilicate), and in the present embodiment, TEOS is used. The thickness of the insulating layer 19 is not particularly limited, and in one example, it is 5 μm to 15 μm, for example, and preferably about 10 μm.

The reflection layer 15 is provided on the side of the insulating layer 19 opposite to the resistor layer 4. In the present embodiment, the reflection layer 15 is interposed between the insulating layer 19 and the first substrate 1. The reflection layer 15 is composed of a material with a larger heat reflectivity than the insulating layer 19. In the present disclosure, heat reflectivity is a physical property in which the sum of the transmissivity and absorptivity with respect to heat received by an object through heat radiation (also called radiation) is 1. That is, the smaller the transmissivity and the absorptivity of the material are relatively, the larger the heat reflectivity tends to be. The material of the reflection layer 15 is not particularly limited, and a metal is preferably used. Examples of the metal constituting the reflection layer 15 include Cu, Ti, and Al. In the example illustrated in the drawings, the reflection layer 15 is composed of Cu. Also, the thickness of the reflection layer 15 is not particularly limited, and in the present embodiment, for example, it is thinner than the wiring layer 3, and for example, is 0.05 μm to 0.3 μm, and is about 0.1 μm. For example, sputtering or CVD can be used to form the reflection layer 15.

The reflection layer 15 is provided at a position overlapping with the multiple heat generation portions 41 as viewed in the thickness direction of the portion of the resistor layer 4 constituting the later-described heat generation portions 41, and in the present embodiment, as viewed in the z direction. In the example illustrated in the drawings, the reflection layer 15 covers all of the first front surface 11 and the protrusion 13 of the first substrate 1, and has a reflection first portion 151, a reflection second portion 152, a reflection third portion 153, and a reflection fourth portion 154.

The reflection first portion 151 is a portion that overlaps with the heat generation portions 41 as viewed in the z direction. The reflection second portion 152 is a portion that overlaps with the protrusion 13 as viewed in the z direction. In the example illustrated in the drawings, the reflection first portion 151 is included in the reflection second portion 152. The reflection third portion 153 is a portion located upstream in the y direction with respect to the reflection second portion 152, and overlaps with the first front surface 11 as viewed in the z direction. The reflection fourth portion 154 is a portion located downstream in the y direction with respect to the reflection second portion 152, and overlaps with the first front surface 11 as viewed in the z direction.

The reflection layer 15 of the present example is insulated from the wiring layer 3 and the resistor layer 4. That is, the insulating layer 19 is interposed over the entire region between the reflection layer 15 and the wiring layer 3 and resistor layer 4.

The resistor layer 4 is supported by the first substrate 1, and in the present embodiment, the resistor layer 4 is supported by the first substrate 1 via the insulating layer 19. The resistor layer 4 includes multiple heat generation portions 41. The multiple heat generation portions 41 locally heat the printing medium due to current being selectively applied thereto. The multiple heat generation portions 41 are arranged along the primary scanning direction x and are separated from each other in the primary scanning direction x. The shapes of the heat generation portions 41 are not particularly limited, and in the present embodiment, they are rectangular shapes whose longitudinal directions are the secondary scanning direction as viewed in the thickness direction z. The resistor layer 4 is composed of TaN, for example. The thickness of the resistor layer 4 is not particularly limited, and for example, it is 0.02 μm to 0.1 μm, and preferably about 0.05 μm.

As shown in FIGS. 3 and 6, in the present embodiment, the heat generation portions 41 each include a peak portion 410, a pair of first portions 411, and a pair of second portions 412. The peak portion 410 is a portion formed on at least part of peak portion 130 of the protrusion 13 in the secondary scanning direction y of the heat generation portion 41. The first portion 411 is a portion that is formed on at least part of the first inclined portion 131 of the protrusion 13 in the secondary scanning direction y, in the heat generation portion 41. The second portion 412 is a portion that is formed on at least part of the second inclined portion 132 of the protrusion 13 in the secondary scanning direction y, in the heat generation portion 41. Note that in the present embodiment, the insulating layer 19 is interposed between the first substrate 1 and the resistor layer 4, but as described above, the insulating layer 19 is a layer that is sufficiently thin. For this reason, if the heat generation portions 41 are formed so as to overlap as viewed in the thickness direction z, or in views in the normal line directions of the peak portion 130, the first inclined portions 131, and the second inclined portions 132, it is described that the heat generation portions 41 are formed on the first peak portion 130, the first inclined portions 131, and the second inclined portions 132, and the same also applies below.

In the present embodiment, the peak portion 410 is formed over the entire length of the peak portion 130 in the secondary scanning direction y. Also, the heat generation portions 41 straddles the boundaries between the peak portion 130 and the pair of first inclined portions 131. Also, the pair of first portions 411 are formed over the entire length of the pair of first inclined portions 131 in the secondary scanning direction y. The heat generation portions 41 straddle the boundaries between the pair of first inclined portions 131 and the pair of second inclined portions 132. Also, the pair of second portions 412 are formed on only part of the second inclined portions 132 in the secondary scanning direction y.

The wiring layer 3 is for forming a conductive path for applying current to the multiple heat generation portions 41. The wiring layer 3 is supported by the first substrate 1, and in the present embodiment, as shown in FIGS. 5 and 6, the wiring layer 3 is stacked on the resistor layer 4. The wiring layer 3 is composed of a metal material with a lower resistance than the resistor layer 4, and is composed of Cu, for example. Also, the wiring layer 3 may be configured to have a layer composed of Cu, and a layer with a thickness of about 100 nm, which is composed of Ti and is interposed between the layer composed of Cu and the resistor layer 4. The thickness of the wiring layer 3 is not particularly limited, and for example, it is 0.3 μm to 2.0 μm.

As shown in FIGS. 1 to 3, 5, and 6, in the present embodiment, the wiring layer 3 has multiple individual electrodes 31 and a common electrode 32. As shown in FIGS. 3 and 6, the portions that are exposed from the wiring layer 3 between the multiple individual electrodes 31 and the common electrode 32 in the resistor layer 4 are the multiple heat generation portions 41.

As shown in FIGS. 3 and 6, the multiple individual electrodes 31 each have a band shape that extends approximately in the secondary scanning direction y, and are arranged upstream in the secondary scanning direction y with respect to the multiple heat generation portions 41. In the present embodiment, the ends of the individual electrodes 31 on the downstream side in the secondary scanning direction y are arranged at positions overlapping the second inclined portions 132 located upstream in the secondary scanning direction y of the protrusion 13. As shown in FIGS. 2 and 5, the individual electrodes 31 have individual pads 311. The individual pads 311 are portions to which wires 61 for electrically connecting to the driver IC 7 are connected.

As shown in FIGS. 2, 3, 5, and 6, the common electrode 32 has a coupling portion 323 and multiple band-shaped portions 324. The multiple band-shaped portions 324 are arranged downstream of the multiple heat generation portions 41 in the secondary scanning direction y. The ends of the multiple band-shaped portions 324 located upstream in the secondary scanning direction y are located on the side of the heat generation portions 41 opposite to the ends of the multiple individual electrodes 31 located downstream in the secondary scanning direction y. The ends of the band-shaped portions 324 located upstream in the secondary scanning direction y are arranged at positions overlapping the second inclined portions 132 located downstream of the protrusion 13 in the secondary scanning direction y. The coupling portion 323 is located downstream of the multiple band-shaped portions 324 in the secondary scanning direction y, and the multiple band-shaped portions 324 are connected. The coupling portion 323 is a relatively wide portion that extends in the primary scanning direction x and has a dimension in the secondary scanning direction y that is larger than the dimension in the primary scanning direction x of the band-shaped portion 324. As shown in FIG. 1, the coupling portion 323 extends from the downstream side of the multiple heat generation portions 41 in the secondary scanning direction y toward the upstream side in the secondary scanning direction y, bypassing both sides in the primary scanning direction x.

In the present embodiment, the portions of the multiple band-shaped portions 324 on the downstream side in the secondary scanning direction y and the coupling portion 323 are formed on the first front surface 11 of the first substrate 1.

The protection layer 2 covers the wiring layer 3 and the resistor layer 4. The protection layer 2 is composed of an insulating material and protects the wiring layer 3 and the resistor layer 4. The material of the protection layer 2 is, for example, $SiO_2$, SiN, SiC, AlN, or the like, and the protection layer 2 is constituted by a single layer or multiple layers of these materials. The thickness of the protection layer 2 is not particularly limited, and for example, it is about 1.0 μm to 10 μm.

As shown in FIG. 5, in the present embodiment, the protection layer 2 has pad openings 21. The pad openings 21 penetrate through the protection layer 2 in the thickness direction. The multiple pad openings 21 expose multiple individual pads 311 of the individual electrodes 31.

As shown in FIGS. 1 and 4, the second substrate 5 is arranged upstream of the first substrate 1 in the secondary scanning direction y. The second substrate 5 is, for example, a PCB substrate, and is equipped with the driver IC 7 and a later-described connector 59. The shape and the like of the second substrate 5 is not particularly limited, and in the present embodiment, it is a rectangular shape whose longitudinal direction is the primary scanning direction x. The second substrate 5 has a second front surface 51 and a second rear surface 52. The second front surface 51 is a surface facing the same side as the first front surface 11 of the first substrate 1, and the second rear surface 52 is a surface facing the same side as the first rear surface 12 of the first substrate 1. In the present embodiment, the second front surface 51 is located on the lower side of the drawing in the thickness direction z relative to the first front surface 11.

The driver IC 7 is mounted on the second front surface 51 of the second substrate 5, and is for applying current individually to the multiple heat generation portions 41. In the present embodiment, the driver IC 7 is connected to the multiple individual electrodes 31 by the multiple wires 61. The electric conduction control of the driver IC 7 follows a command signal input from the thermal printhead A1 via the second substrate 5. The driver IC 7 is connected to a wiring layer (not shown) of the second substrate 5 by multiple wires 62. In the present embodiment, multiple driver ICs 7 are provided according to the number of the multiple heat generation portions 41.

The driver ICs 7, the multiple wires 61, and the multiple wires 62 are covered by the protection resin 78. The protection resin 78 is composed of, for example, an insulating resin, and is, for example, black. The protection resin 78 is formed so as to straddle the first substrate 1 and the second substrate 5.

The connector 59 is used to connect the thermal printhead A1 to the printer (not shown). The connector 59 is attached to the second substrate 5 and is connected to the wiring layer (not shown) of the second substrate 5.

The heat dissipation member 8 supports the first substrate 1 and the second substrate 5, and is for dissipating part of the heat generated by the multiple heat generation portions 41 to the outside via the first substrate 1. The heat dissipation member 8 is a block-shaped member composed of a metal such as aluminum, for example. In the present embodiment, the heat dissipation member 8 has a first support surface 81 and a second support surface 82. The first support surface 81 and the second support surface 82 face the upper side in the thickness direction z and are arranged aligned in the secondary scanning direction y. The first rear surface 12 of the first substrate 1 is bonded to the first support surface 81. The second rear surface 52 of the second substrate 5 is bonded to the second support surface 82.

Next, an example of a method for manufacturing the thermal printhead A1 will be described below with reference to FIGS. 7 to 16.

Figure 7:
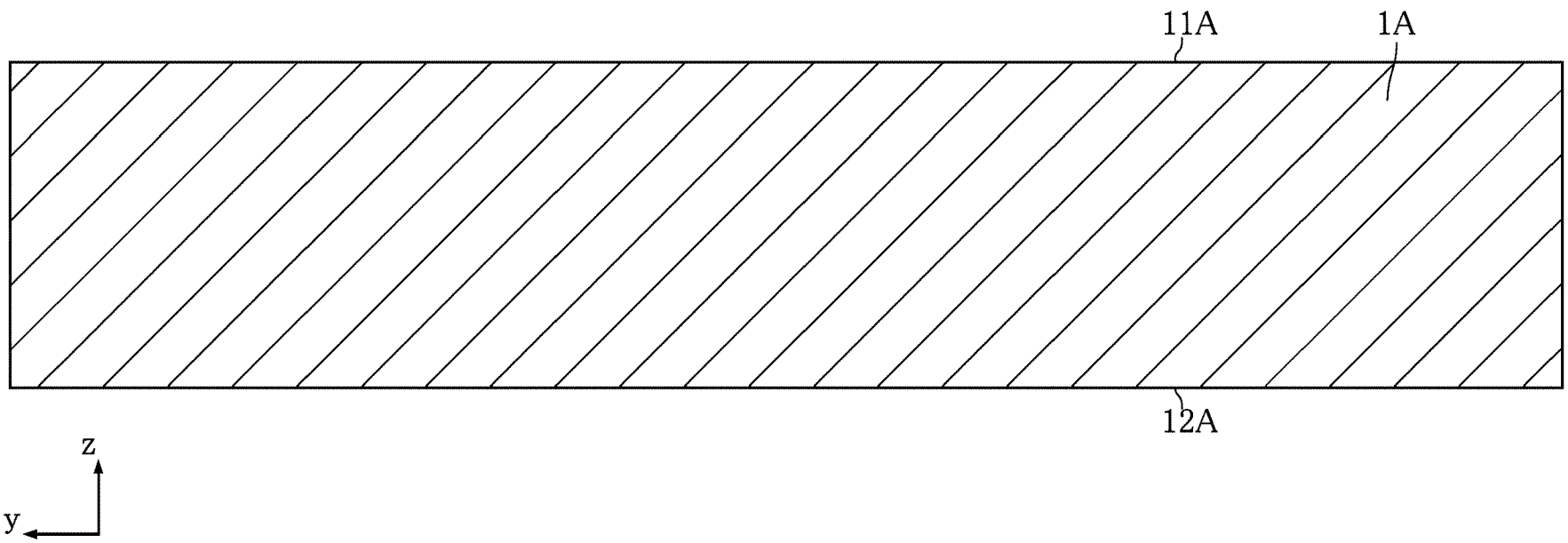
FIG. 7 is a cross-sectional view of a portion, showing an example of a method for manufacturing the thermal printhead according to the first embodiment.

First, as shown in FIG. 7, a substrate material 1A is prepared. The substrate material 1A is composed of a single-crystal semiconductor and is a Si wafer, for example. The thickness of the substrate material 1A is not particularly limited, and in the present embodiment, it is 725 μm, for example. The substrate material 1A has a front surface 11A and a rear surface 12A that face mutually opposite sides. The front surface 11A is a (100) surface.

Figure 8:
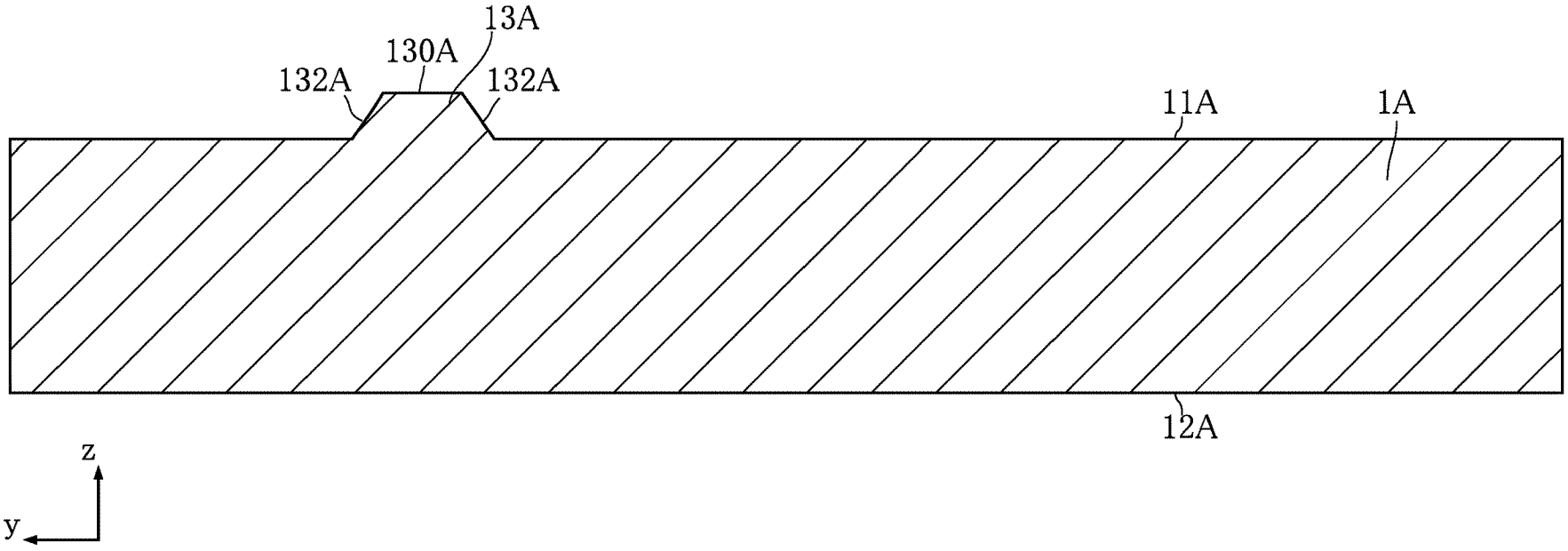
FIG. 8 is a cross-sectional view of a portion, showing an example of a method for manufacturing the thermal printhead according to the first embodiment.
Figure 9:
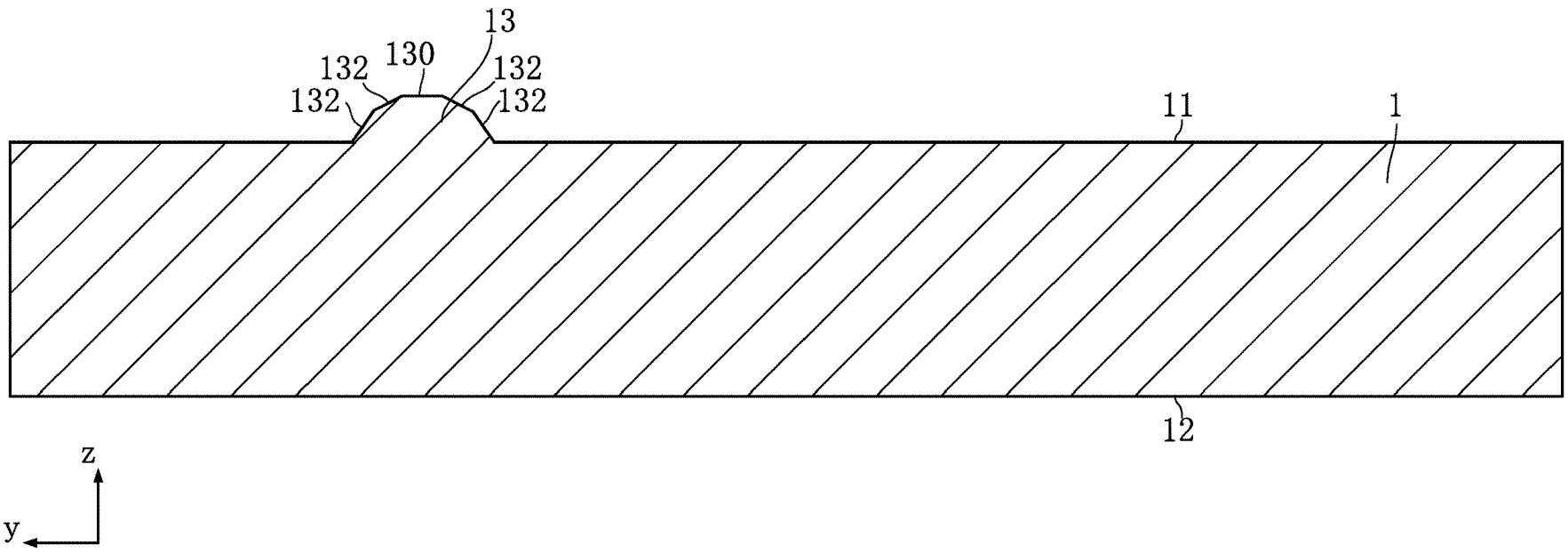
FIG. 9 is a cross-sectional view of a portion, showing an example of a method for manufacturing the thermal printhead according to the first embodiment.
Figure 10:
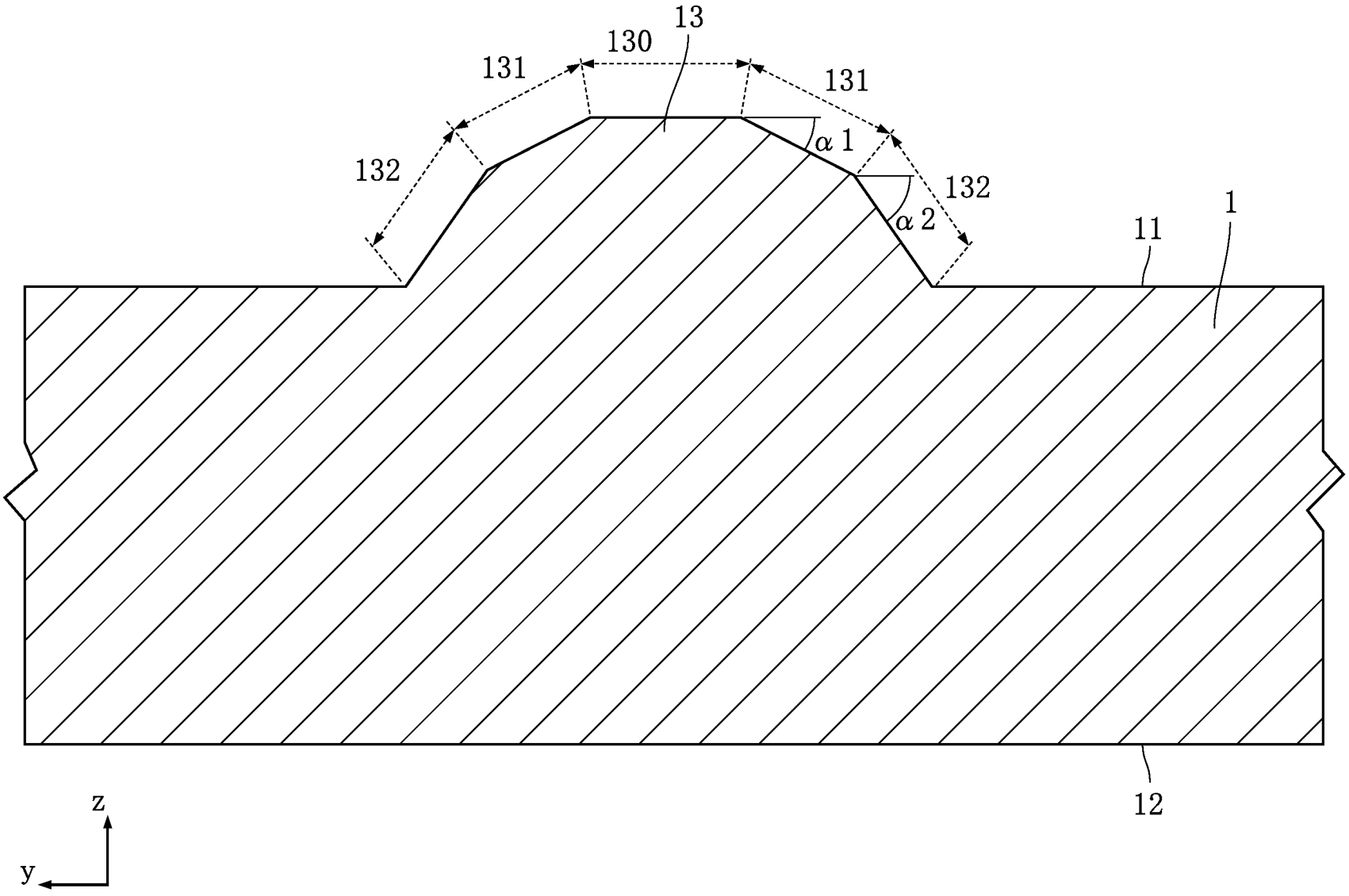
FIG. 10 is an enlarged cross-sectional view of a portion, showing an example of a method for manufacturing the thermal printhead according to the first embodiment.

Next, after the front surface 11A is covered with a predetermined mask layer, anisotropic etching using KOH, for example, is performed. Accordingly, as shown in FIG. 8, a protrusion 13A is formed on the substrate material 1A. The protrusion 13A protrudes from the front surface 11A and extends lengthwise in the primary scanning direction x. The protrusion 13A has a peak portion 130A and a pair of inclined portions 132A. The peak portion 130A is a surface that is parallel to the front surface 11A and is a (100) surface in the present embodiment. The pair of inclined portions 132A are located on both sides in the secondary scanning direction y of the peak portion 130A and are interposed between the peak portion 130A and the front surface 11A. The inclined portions 132A are flat surfaces that are inclined with respect to the peak portion 130A and the front surface 11A. In the present embodiment, the angle formed by the inclined portion 132A and the front surface 11A and peak portion 130A is 54.8 degrees.

Next, after the mask layer is removed, etching using KOH, for example, is performed once again. Accordingly, the substrate material 1A is the first substrate 1 having the first front surface 11, the first rear surface 12, and the protrusion 13 shown in FIGS. 9 and 10. The protrusion 13 has a peak portion 130, the pair of first inclined portions 131, and the pair of second inclined portions 132. The peak portion 130 is the portion that was the peak portion 130A, and the pair of second inclined portions 132 are the portions that were the pair of inclined portions 132A. The pair of first inclined portions 131 are portions obtained by etching the boundaries between the peak portion 130A and the pair of inclined portions 132A using KOH. The angle α1 formed by the pair of first inclined portions 131 and the first front surface 11 is 30.1 degrees, and the angle α2 formed by the pair of second inclined portions 132 and the first front surface 11 is 54.8 degrees.

Figure 11:
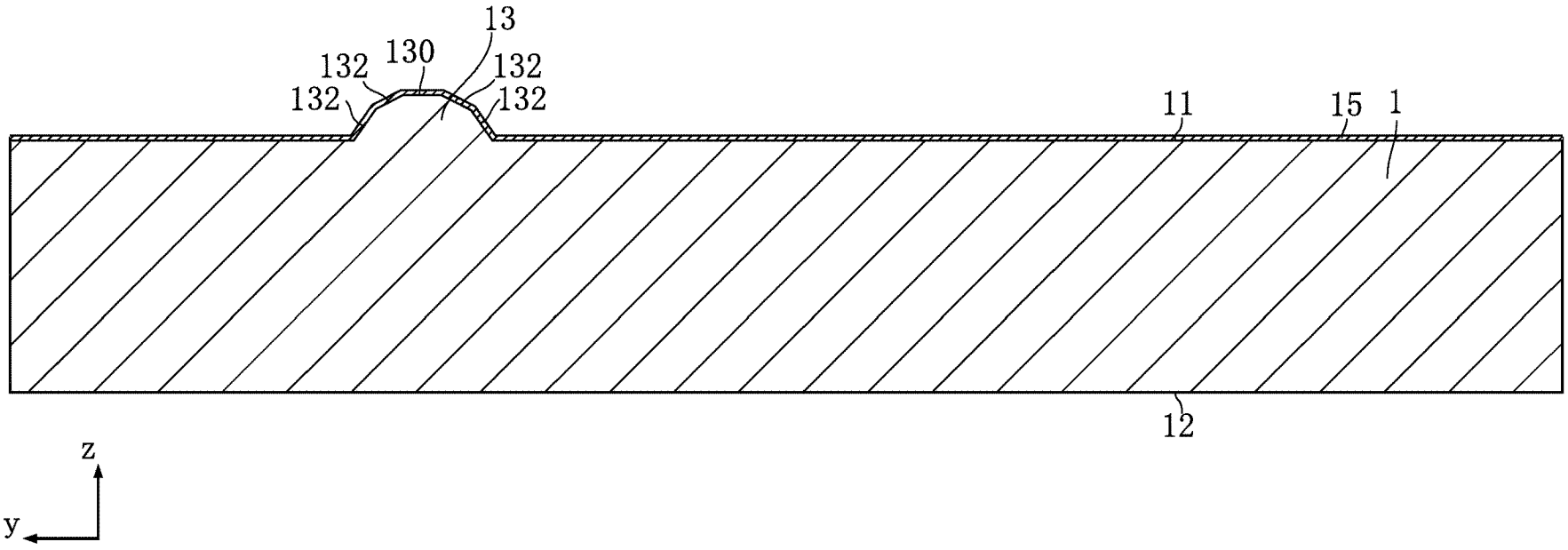
FIG. 11 is a cross-sectional view of a portion, showing an example of a method for manufacturing the thermal printhead according to the first embodiment.

Next, as shown in FIG. 11, the reflection layer 15 is formed. The reflection layer 15 is formed by depositing metal on the first substrate 1 using sputtering or CVD, for example. As described above, the material of the reflection layer 15 is not particularly limited, and in the example illustrated in the drawings, Cu is used. The thickness of the reflection layer 15 is 0.05 μm to 0.3 μm, for example, and is about 0.1 μm, for example. In the example illustrated in the drawings, the reflection layer 15 is formed on the entire surfaces of the first front surface 11 and the protrusion 13 of the first substrate 1.

Figure 12:
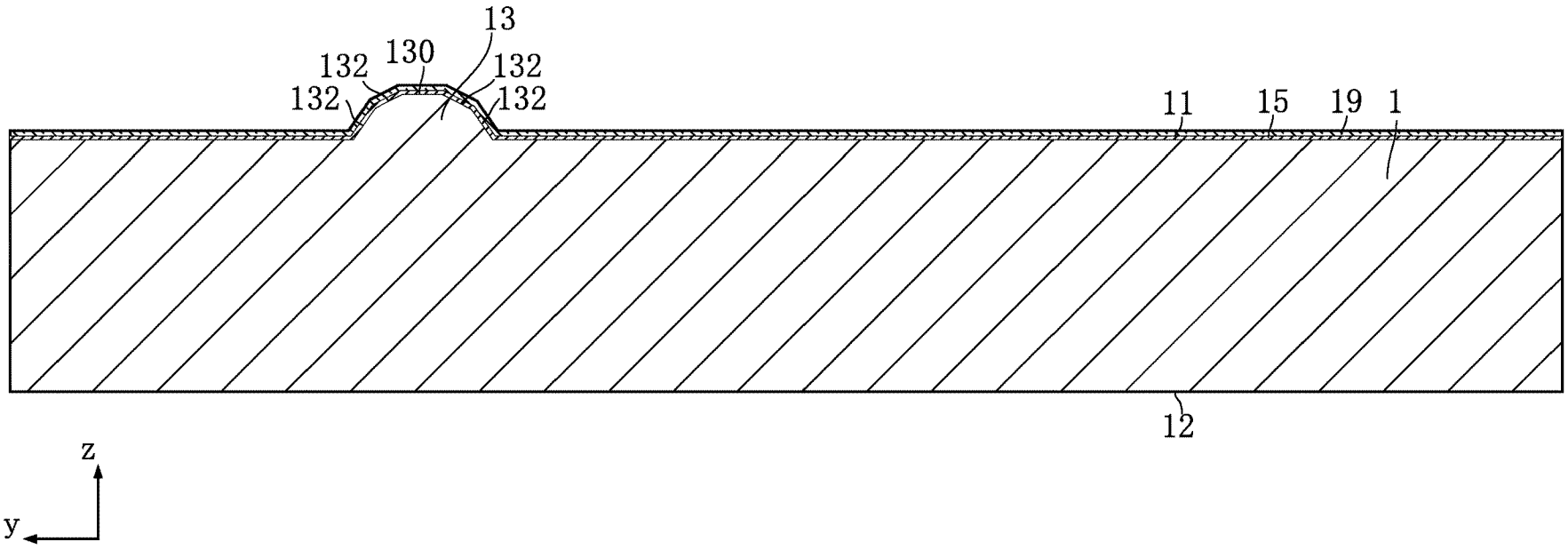
FIG. 12 is a cross-sectional view of a portion, showing an example of a method for manufacturing the thermal printhead according to the first embodiment.

Next, as shown in FIG. 12, the insulating layer 19 is formed. The insulating layer 19 is formed by depositing TEOS on the reflection layer 15 using CVD, for example.

Figure 13:
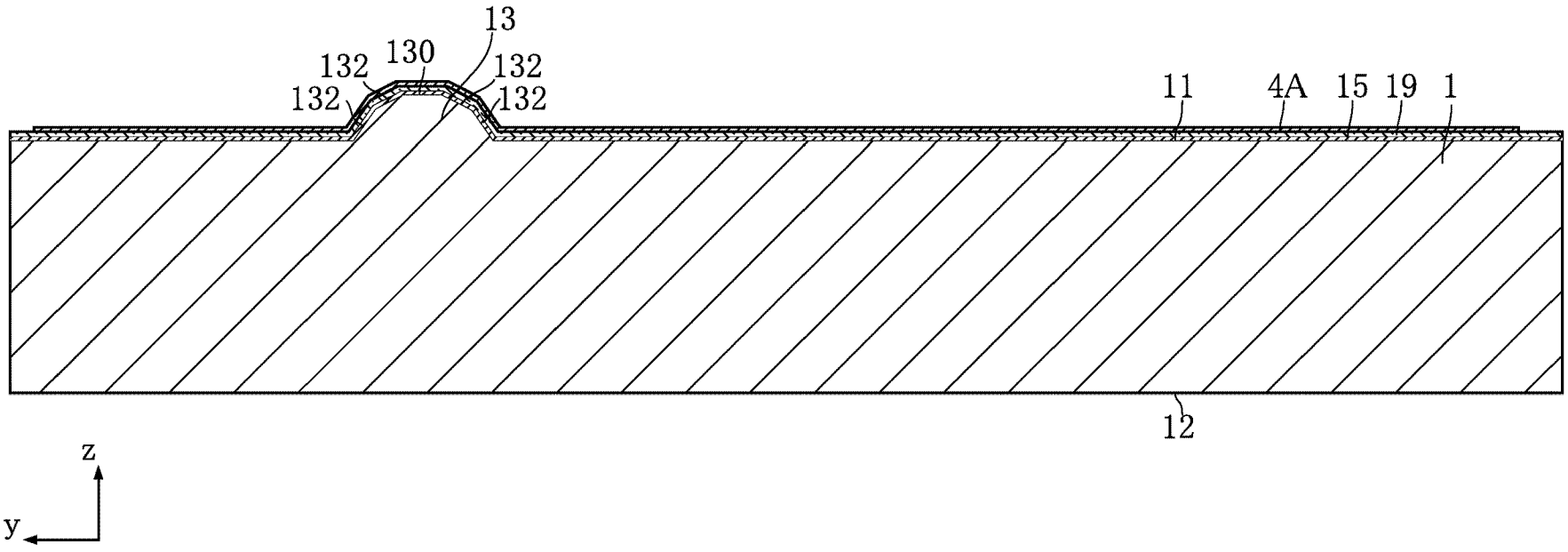
FIG. 13 is a cross-sectional view of a portion, showing an example of a method for manufacturing the thermal printhead according to the first embodiment.

Next, as shown in FIG. 13, a resistor film 4A is formed. The resistor film 4A is formed by forming a thin film of TaN on the insulating layer 19 through sputtering, for example.

Figure 14:
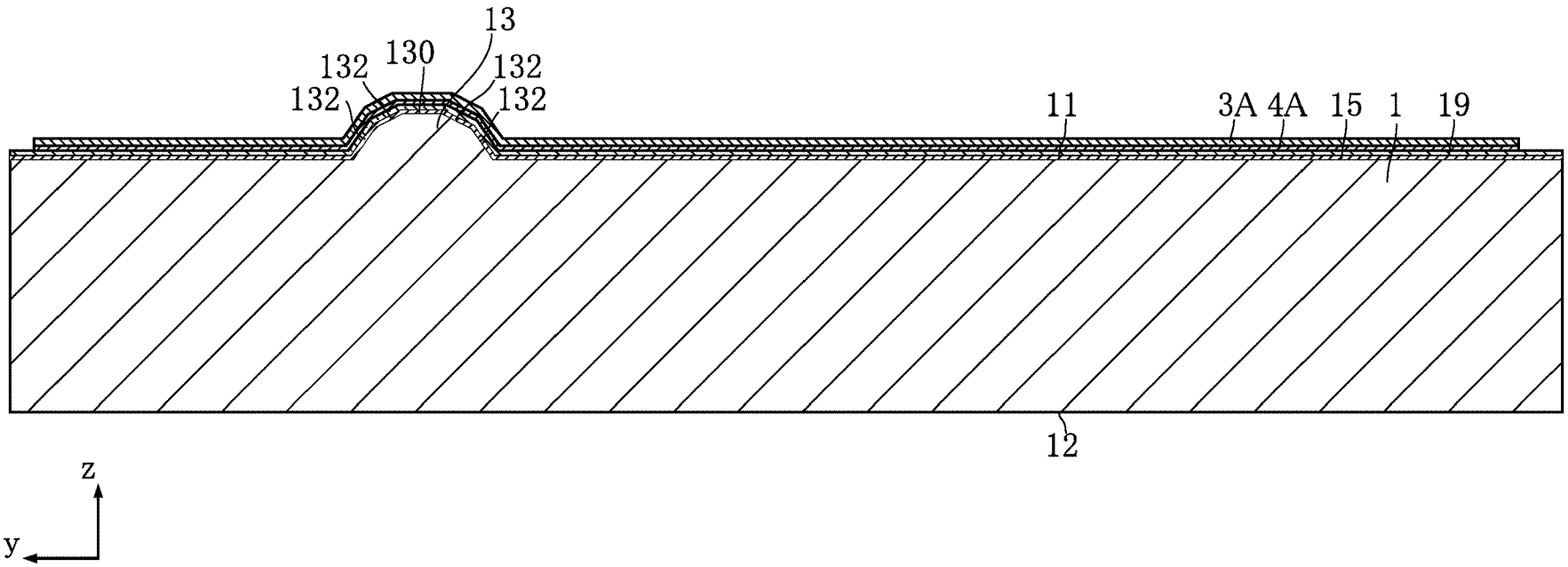
FIG. 14 is a cross-sectional view of a portion, showing an example of a method for manufacturing the thermal printhead according to the first embodiment.

Next, as shown in FIG. 14, a conduction film 3A that covers the resistor film 4A is formed. The conduction film 3A is formed by forming a layer composed of Cu through plating, sputtering, or the like, for example. Also, a Ti layer may also be formed before the Cu layer is formed.

Figure 15:
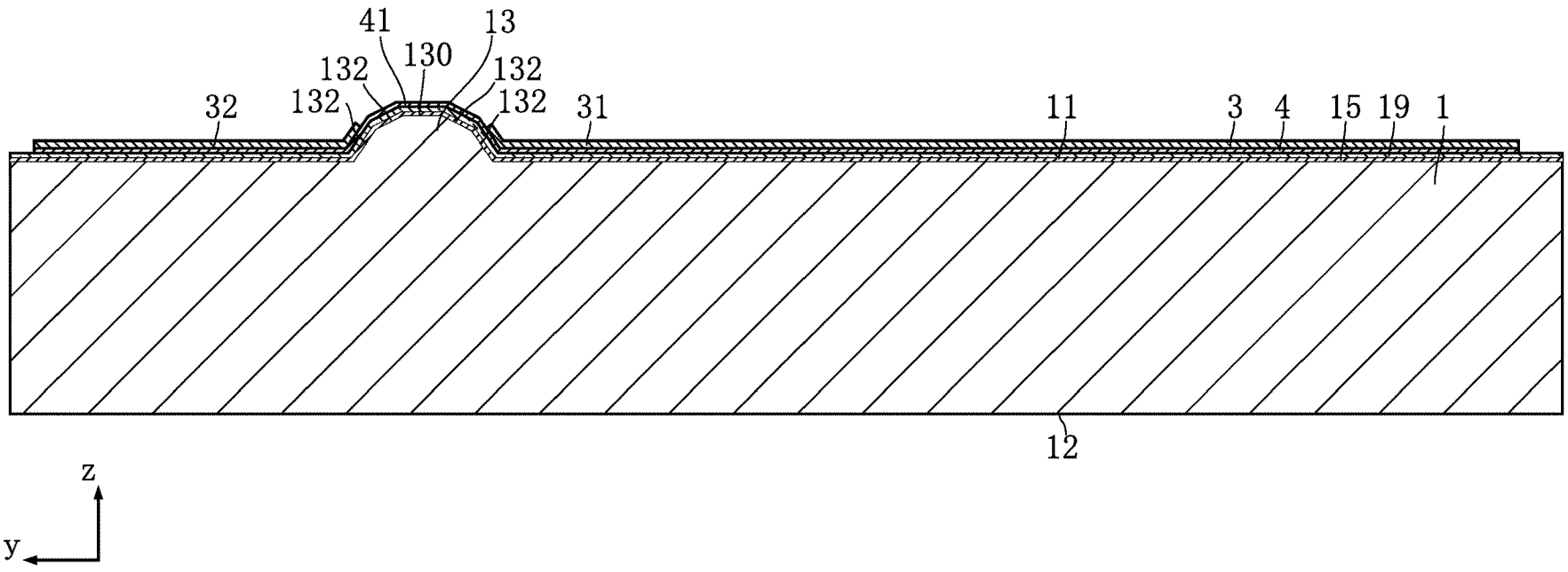
FIG. 15 is a cross-sectional view of a portion, showing an example of a method for manufacturing the thermal printhead according to the first embodiment.
Figure 16:
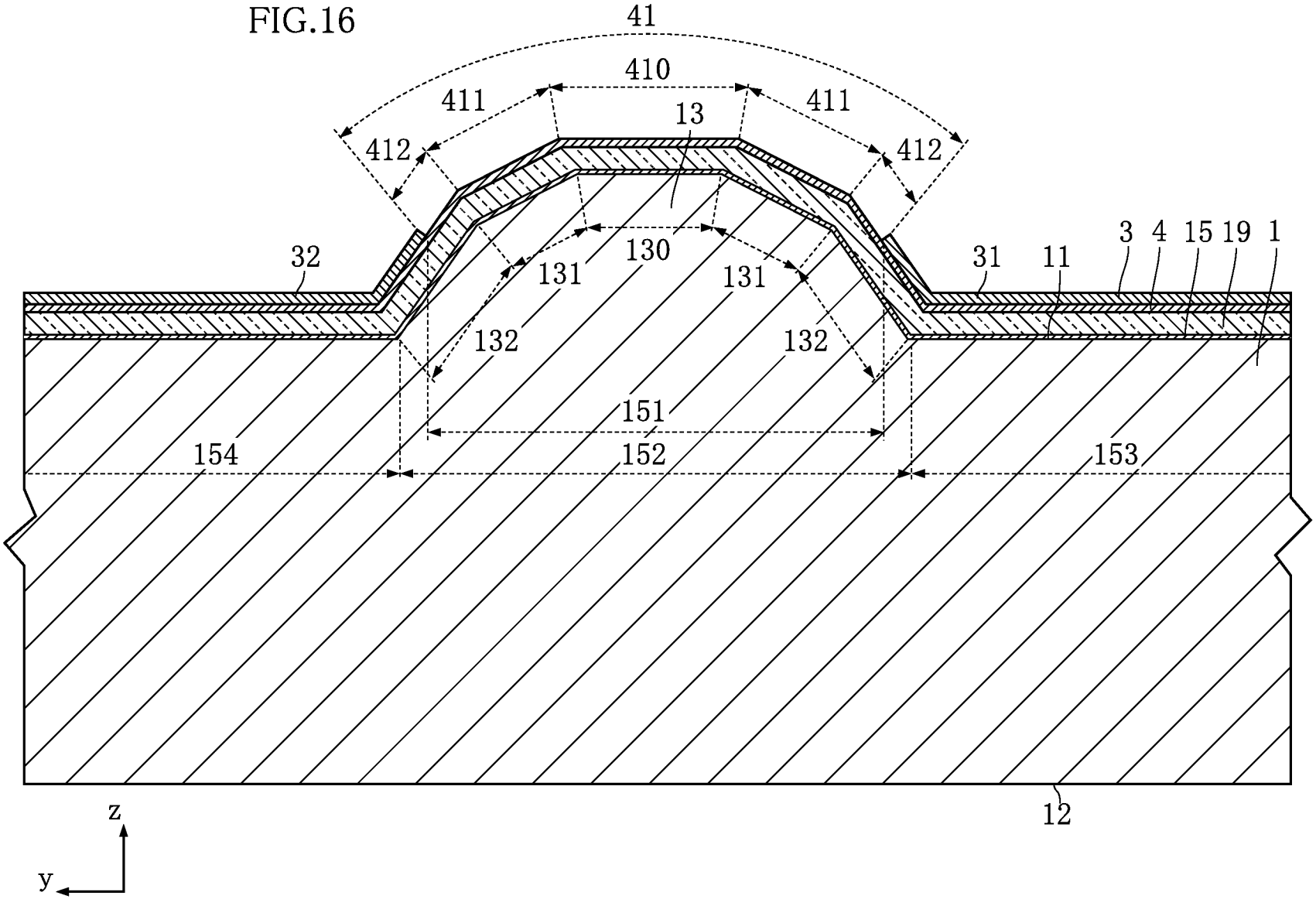
FIG. 16 is an enlarged cross-sectional view of a portion, showing an example of a method for manufacturing the thermal printhead according to the first embodiment.

Next, as shown in FIGS. 15 and 16, the wiring layer 3 and the resistor layer 4 are obtained by carrying out selective etching of the conduction film 3A and selective etching of the resistor film 4A. The wiring layer 3 has the above-described multiple individual electrodes 31 and the common electrode 32. The resistor layer 4 has the multiple heat generation portions 41.

Next, the protection layer 2 is formed. The formation of the protection layer 2 is executed by depositing SiN and SiC on the insulating layer 19, the wiring layer 3, and the resistor layer 4 using CVD, for example. Also, the pad openings 21 are formed by partially removing the protection layer 2 through etching or the like. Thereafter, the first substrate 1 and the second substrate 5 are attached to the first support surface 81, the driver ICs 7 are mounted on the second substrate 5, the multiple wires 61 and the multiple wires 62 are bonded, the protection resin 78 is formed, and the like, and thereby the above-described thermal printhead A1 is obtained.

Next, actions of the thermal printhead A1 will be described.

According to the present embodiment, the reflection layer 15 is provided on the side of the insulating layer 19 opposite to the multiple heat generation portions 41. The reflection layer 15 overlaps with the multiple heat generation portions 41 as viewed in the z direction, which is a view in the thickness direction of the heat generation portion 41. Also, the reflection layer 15 is composed of a material with a larger heat reflectivity than the insulating layer 19. Accordingly, when the heat generation portions 41 generate heat due to current being applied to the resistor layer 4, the heat that passes through the insulating layer 19 from the heat generation portion 41 can be reflected toward the heat generation portion 41 by the reflection layer 15. Accordingly, it is possible to control the heat that escapes toward the first rear surface 12 through the first substrate 1, for example, and it is possible to transmit a greater amount of heat to the printing paper. Accordingly, with the thermal printhead A1, printing quality can be improved.

Increasing the thickness of the insulating layer 19 can contribute to controlling the amount of heat that escapes toward the first rear surface 12 through the first substrate 1 due to heat transmission. However, the greater the thickness of the insulating layer 19 is made, the more time is required for the step of forming the insulating layer 19 in the method for manufacturing the thermal printhead A1. In the present embodiment, heat dissipation caused by thermal radiation can be suppressed by the reflection layer 15. For this reason, the amount of heat that escapes from the heat generation portion 41 toward the first rear surface 12 can be reduced without increasing the thickness of the insulating layer 19 much. Accordingly, it is possible to improve the printing quality and avoid an excessive increase in the manufacturing time.

The reflection layer 15 has the reflection second portion 152 and is formed in a region larger than that of the multiple heat generation portions 41 as viewed in the z direction. Accordingly, a greater amount of the heat that escapes from the heat generation portion 41 toward the first rear surface 12 can be reflected toward the printing paper. Also, a configuration in which the reflection layer 15 has a reflection third portion 153 and a reflection fourth portion 154 is preferable for further improving the heat reflection effect.

The reflection layer 15 is composed of metal, and is composed of Cu, for example. Metals such as Cu have a significantly higher heat reflectivity compared to $SiO_2$ and the like. For this reason, the heat reflection effect achieved by the reflection layer 15 can be improved. Also, a thermal reflection effect can be expected with the reflection layer 15 composed of this kind of material, even if the thickness is reduced. Accordingly, the reflection layer 15 can be formed in a shorter amount of time, and thus a reduction in the efficiency of manufacturing the thermal printhead A1 can be avoided.

Also, the protrusion 13 of the first substrate 1 has the peak portion 130 and the first inclined portions 131. The heat generation portion 41 has a peak portion 410 formed on the peak portion 130 and first portions 411 formed on the first inclined portions 131, and is formed straddling the boundaries between the peak portion 130 and the first inclined portions 131. For this reason, as shown in FIG. 4, when the platen roller 91 is pressed onto the thermal printhead A1, the platen roller 91 comes into contact with one or both of the peak portion 410 and the first portion 411 due to elastic deformation of the platen roller 91. As shown in FIG. 4, in the case of using a configuration in which a center 910 of the platen roller 91 matches the center of the protrusion 13 in the secondary scanning direction y, the platen roller 91 comes into contact with the peak portion 410 with a strong force. On the other hand, if the center 910 of the platen roller 91 unexpectedly shifts in the secondary scanning direction y with respect to the center of the protrusion 13, the pressing force of the platen roller 91 and the peak portion 410 will decrease. However, in the present embodiment, since the heat generation portion 41 has the first portion 411, if the platen roller 91 shifts, the percentage of the platen roller 91 that comes into contact with the first portion 411 increases, and the platen roller 91 is still suitably pressed against the heat generation portion 41. Accordingly, with the thermal printhead A1, even if the platen roller 91 shifts unexpectedly, the diameter of the platen roller 91 is different, or the like, reduction of the printing quality can be suppressed and the printing quality can be improved.

Also, in the present embodiment, the peak portion 410 is formed over the entire length of the peak portion 130 in the secondary scanning direction y and the pair of first portions 411 are provided on both sides of the peak portion 410 in the secondary scanning direction y. For this reason, even if the shifting of the platen roller 91 occurs upstream or downstream in the secondary scanning direction y, reduction of the printing quality can be suppressed. Also, the pair of first portions 411 are formed over the entire length of the first inclined portions 131 in the secondary scanning direction y. This is preferable for suppressing reduction of the printing quality in the case where the platen roller 91 shifts unexpectedly.

Also, in the present embodiment, the protrusion 13 has the pair of second inclined portions 132. That is, the protrusion 13 is configured such that the first inclined portions 131 and the second inclined portions 132, which are inclined in two stages with respect to the peak portion 130 (first front surface 11), are arranged side-by-side in the secondary scanning direction y. For this reason, the angle formed by the peak portion 130 and the first inclined portion 131 can be reduced, which is preferable for improving the printing quality. Also, the smaller the angle formed by the peak portion 130 and the first inclined portion 131 is, the more the prevention of wear in the protection layer 2 caused by the passage of the printing paper during printing can be suppressed. Also, due to the first portion 411 being provided over the entire length of the first inclined portion 131 in the secondary scanning direction y, the ends of the individual electrodes 31 and the common electrodes 32 in the secondary scanning direction are located on the pair of second inclined portions 132 instead of being located on the pair of first inclined portions 131. For this reason, it is possible to avoid a case in which a level difference caused by the presence of the edges of the wiring layer 3 occurs at the position overlapping the first inclined portion 131, which is advantageous for smooth passage of the printing paper and preventing the attachment of paper residue. Also, providing the pair of second portions 412 is more preferable for suppressing reduction of the printing quality in the case where the platen roller 91 shifts unexpectedly.

The common electrodes 32 are located downstream of the multiple heat generation portions 41 in the secondary scanning direction y, and thus only the multiple individual electrodes 31 are aligned upstream of the multiple heat generation portions 41 in the secondary scanning direction y. Accordingly, the alignment pitch of the multiple individual electrodes 31 in the primary scanning direction x can be shortened, and more detailed printing can be achieved.

FIGS. 17 to 27 show modified examples and other embodiments of the present disclosure. Note that in these drawings, elements that are the same as or similar to those of the above-described embodiment are denoted by reference numerals that are the same as those of the above-described embodiment.

Figure 17:
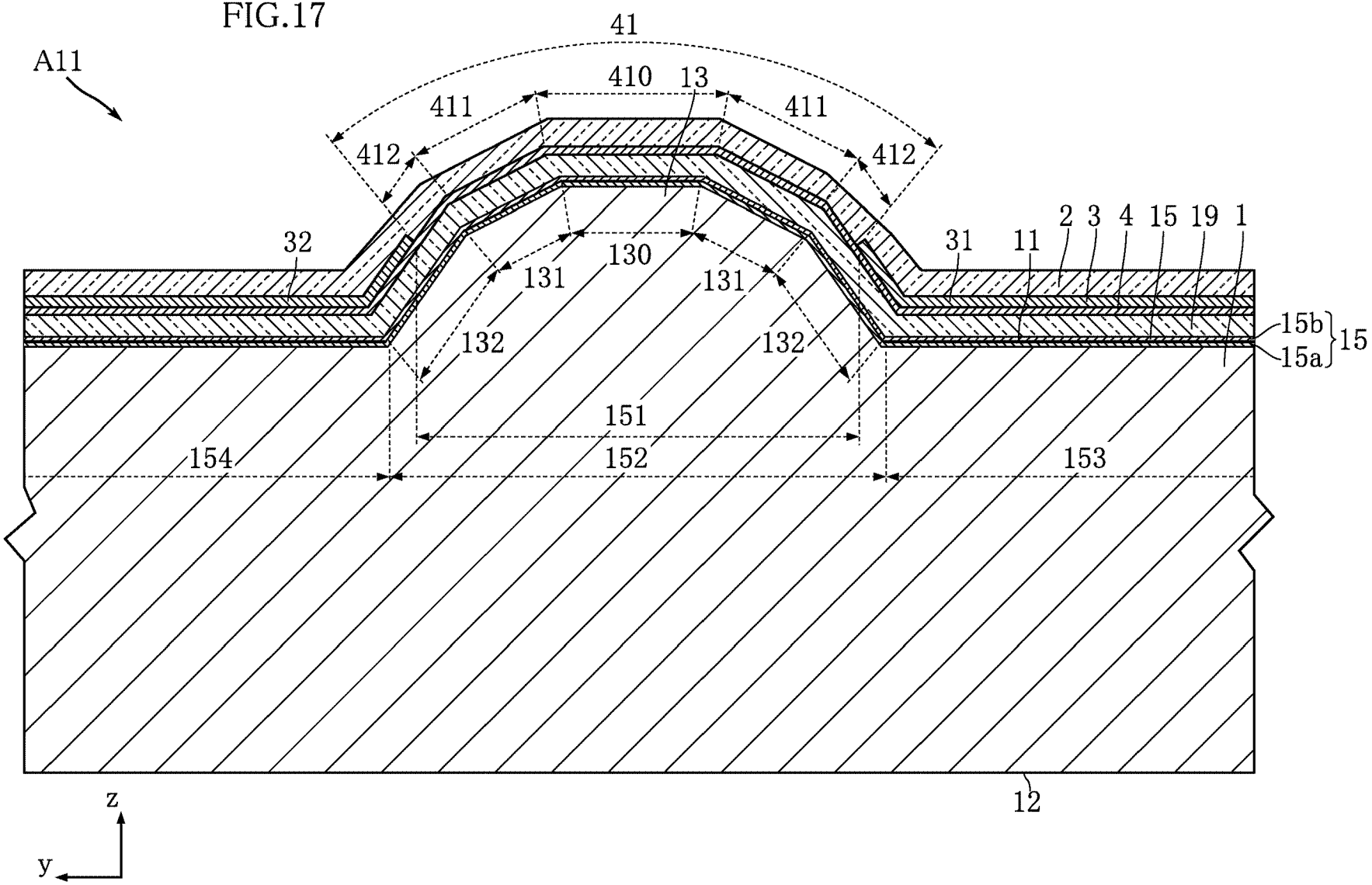
FIG. 17 is an enlarged cross-sectional view of a portion, showing a first modified example of the thermal printhead according to the first embodiment.

FIG. 17 shows a first modified example of the thermal printhead A1. In the thermal printhead A11 of the present modified example, the reflection layer 15 is composed of a reflection first layer 15*a* and a reflection second layer 15*b*.

The reflection first layer 15*a* is formed directly on the first front surface 11 and the protrusion 13 of the first substrate 1. The reflection second layer 15*b* is formed on the reflection first layer 15*a* and is in contact with the insulating layer 19. The reflection first layer 15*a* is composed of Ti, for example. The reflection second layer 15*b* is composed of Cu, for example. The thickness of the reflection layer 15 of the present modified example may also be about the same as the thickness of the reflection layer 15 of the above-described example, and may also be smaller than the thickness of the reflection layer 15 of the above-described example.

According to the present modified example, the portion of the reflection layer 15 that comes into contact with the first substrate 1 is formed by the reflection first layer 15*a*. The reflection first layer 15*a* is composed of Ti and can improve the force of bonding with the first substrate 1 composed of Si. Accordingly, it is possible to more reliably suppress a case in which the reflection layer 15 separates from the first substrate 1, or the like.

Figure 18:
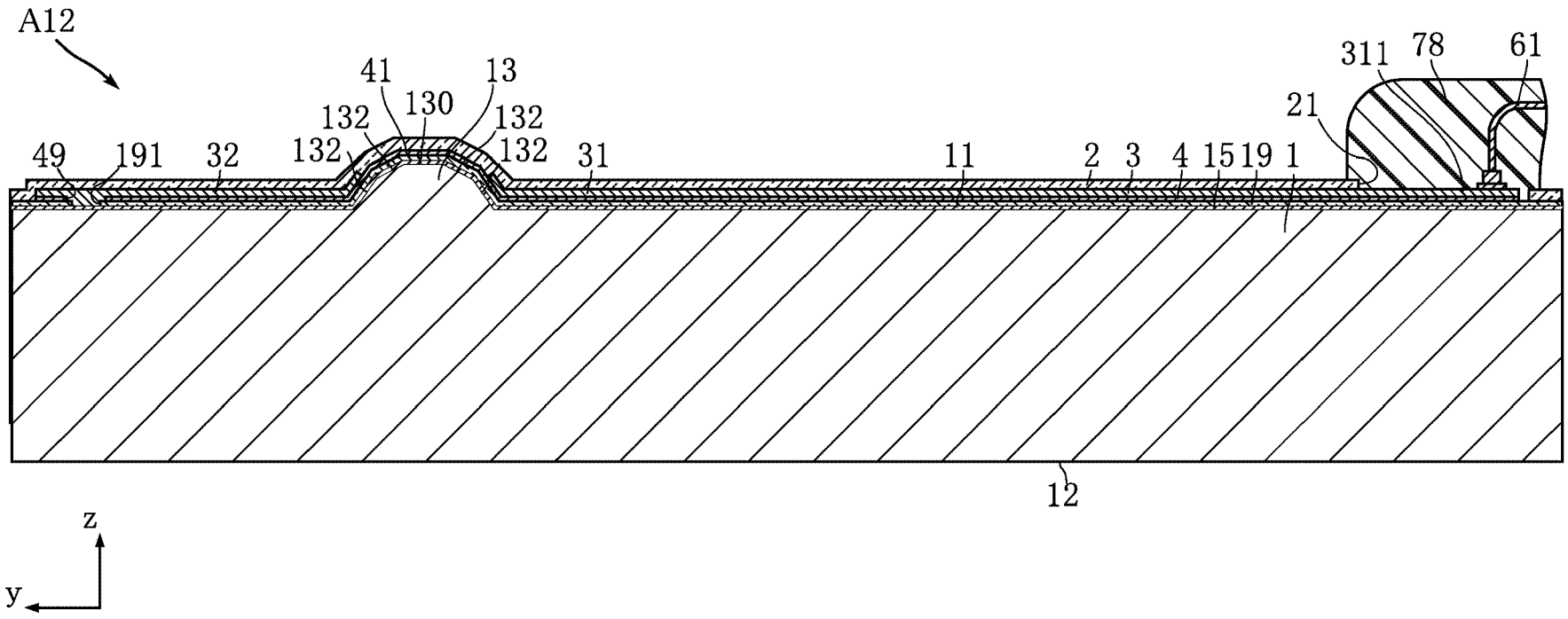
FIG. 18 is an enlarged cross-sectional view of a portion, showing a second modified example of the thermal printhead according to the first embodiment.

FIG. 18 shows a second modified example of the thermal printhead A1. In a thermal printhead A12 of the present modified example, the reflection layer 15 is electrically connected to part of the wiring layer 3.

In the present example, a through portion 49 is formed in the resistor layer 4. Also, a through portion 191 is formed in the insulating layer 19. The through portion 49 is a hole or the like that penetrates through the resistor layer 4. A through portion 191 is a hole or the like that penetrates through the insulating layer 19. The through portion 49 and the through portion 191 overlap with each other, and in the example illustrated in the drawings, the through portion 49 is enveloped in the through portion 191 as viewed in the z direction. The common electrode 32 of the wiring layer 3 is in contact with the reflection layer 15 through the through portion 191 and the through portion 49. Accordingly, the reflection layer 15 is electrically connected to the common electrodes 32.

According to this kind of modified example, there is no need to form a conduction path that bypasses the individual electrodes 31 in the x direction in order to electrically connect the common electrode 32 to the second substrate 5 and the connector 59 illustrated as examples in FIG. 4. Accordingly, the thermal printhead A12 can be made smaller as viewed in the z direction. Also, the reflection layer 15 is a site whose area tends to be increased. For this reason, it is possible to achieve lower resistance in the conduction path between the common electrode 32 and the second substrate 5 and connector 59.

Figure 19:
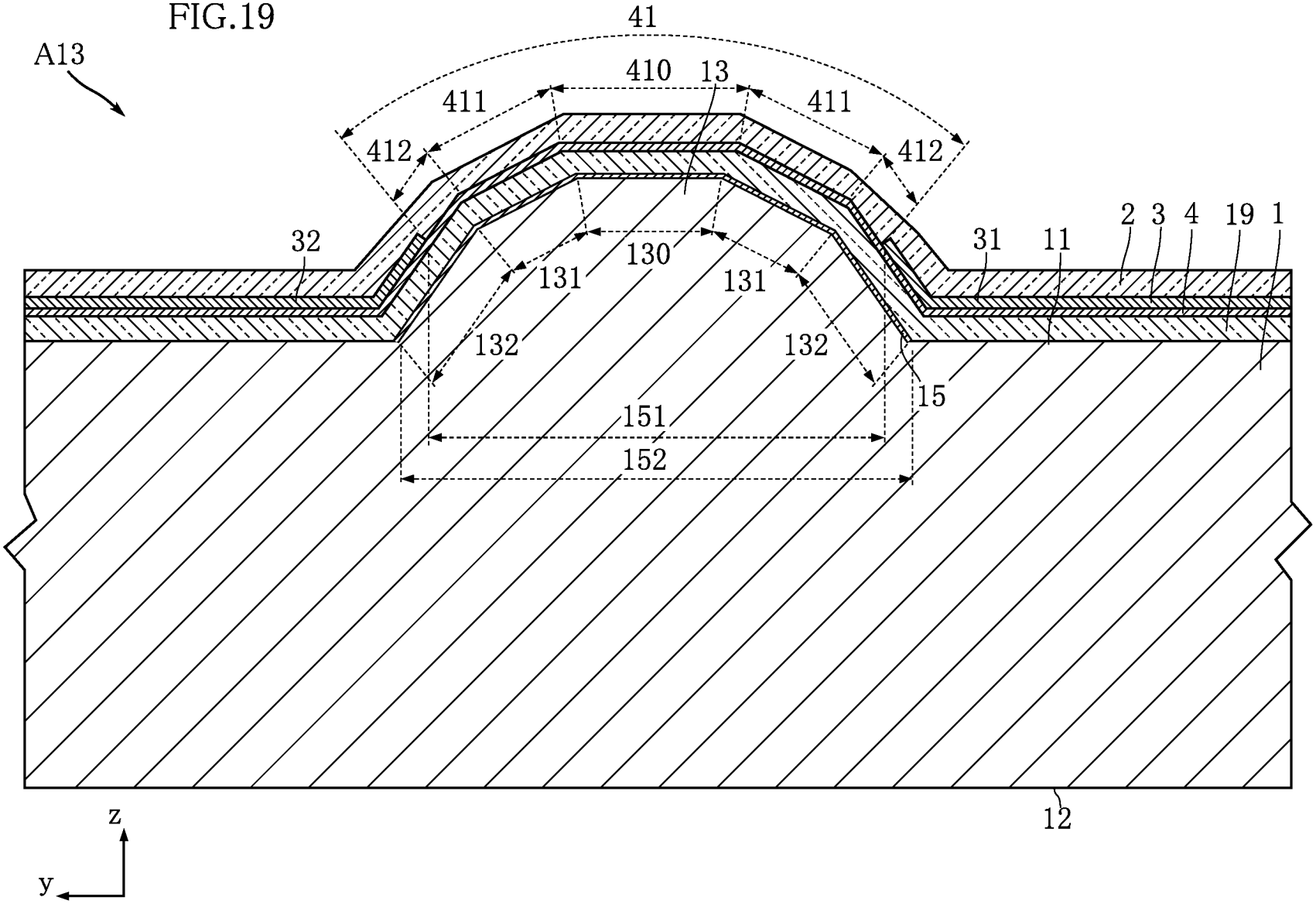
FIG. 19 is an enlarged cross-sectional view of a portion, showing a third modified example of the thermal printhead according to the first embodiment.

FIG. 19 shows a third modified example of the thermal printhead A1. In a thermal printhead A13 of the present modified example, a configuration is used in which the reflection layer 15 has the reflection first portion 151 and the reflection second portion 152 but does not have the above-described reflection third portion 153 and reflection fourth portion 154.

In the present example, the reflection layer 15 is formed on a region overlapping with the protrusion 13 as viewed in the z direction. On the other hand, the reflection layer 15 is not formed on the region overlapping with the first front surface 11 as viewed in the z direction.

According to this kind of modified example as well, printing quality can be improved. Also, by reducing the area for forming the reflection layer 15, it is possible to achieve a reduction of the manufacturing cost.

Figure 20:
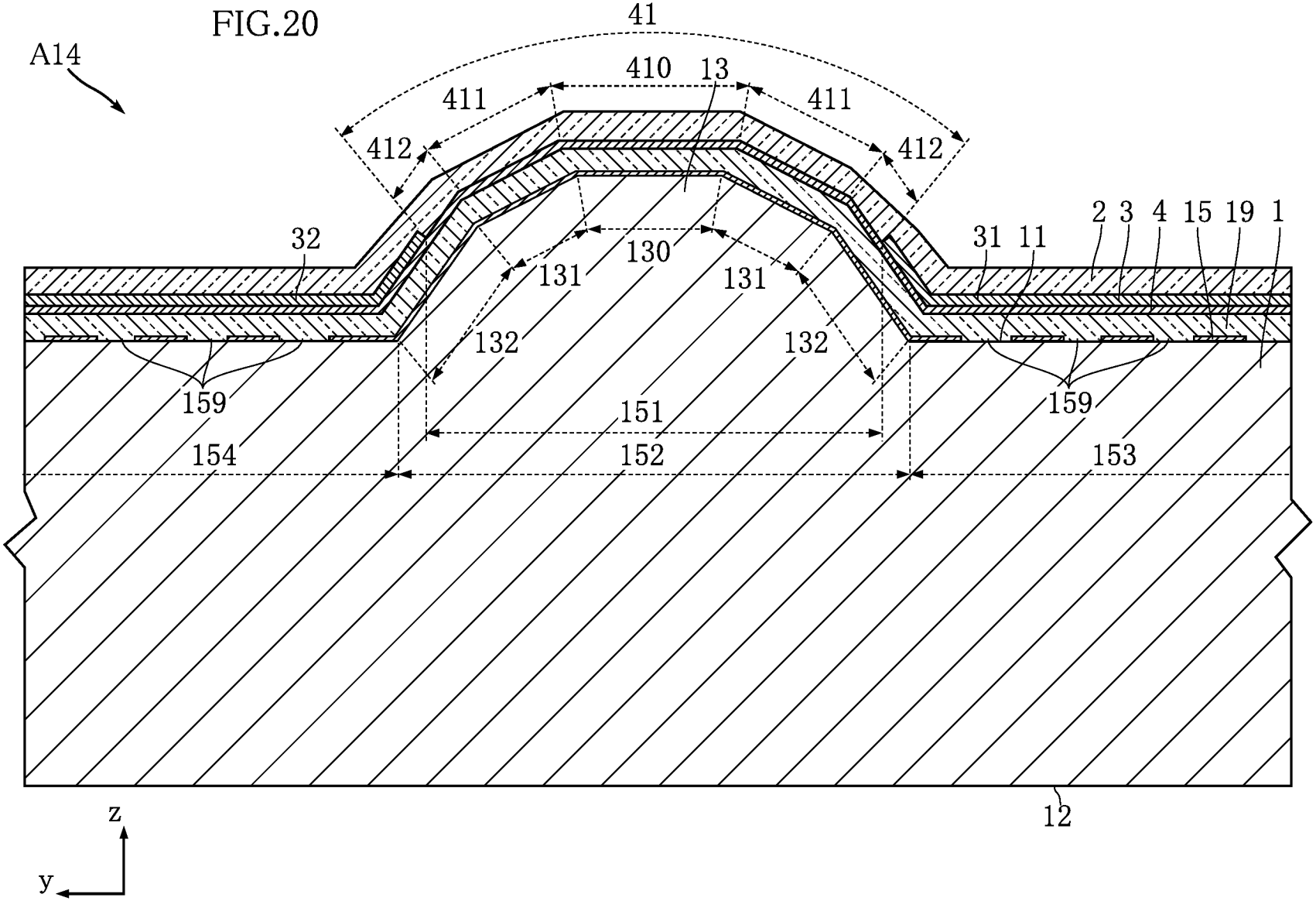
FIG. 20 is an enlarged cross-sectional view of a portion, showing a fourth modified example of the thermal printhead according to the first embodiment.

FIG. 20 shows a fourth modified example of the thermal printhead A1. In a thermal printhead A14 of the present modified example, the reflection layer 15 has the above-described reflection first portion 151, reflection second portion 152, reflection third portion 153, and reflection fourth portion 154, and further has multiple through portions 159.

The multiple through portions 159 are holes or slits that penetrate through the reflection layer 15 in the thickness direction. The multiple through portions 159 are arranged dispersed as appropriate in the x direction and the y direction as viewed in the z direction. In the example illustrated in the drawings, the multiple through portions 159 are formed on the reflection third portion 153 and the reflection fourth portion 154, but are not formed on the reflection second portion 152. That is, the multiple through portions 159 overlap with the first front surface 11 in the z direction but do not overlap with the protrusion 13 and do not overlap with the multiple heat generation portions 41.

According to this kind of modified example, the first substrate 1 and the insulating layer 19 can be brought into contact with each other through the multiple through portions 159, and the bonding force of the insulating layer 19 and the first substrate 1 can be increased. Also, there is an advantage in that leeway for selecting a material that has a relatively lower bonding force between the first substrate 1 and the insulating layer 19 as the material of the reflection layer 15 is obtained by ensuring bonding through the multiple through portions 159. Also, due to the multiple through portions 159 not being provided at positions overlapping with the multiple heat generation portions 41, it is possible to prevent a decrease in thermal reflection caused by the multiple through portions 159.

Figure 21:
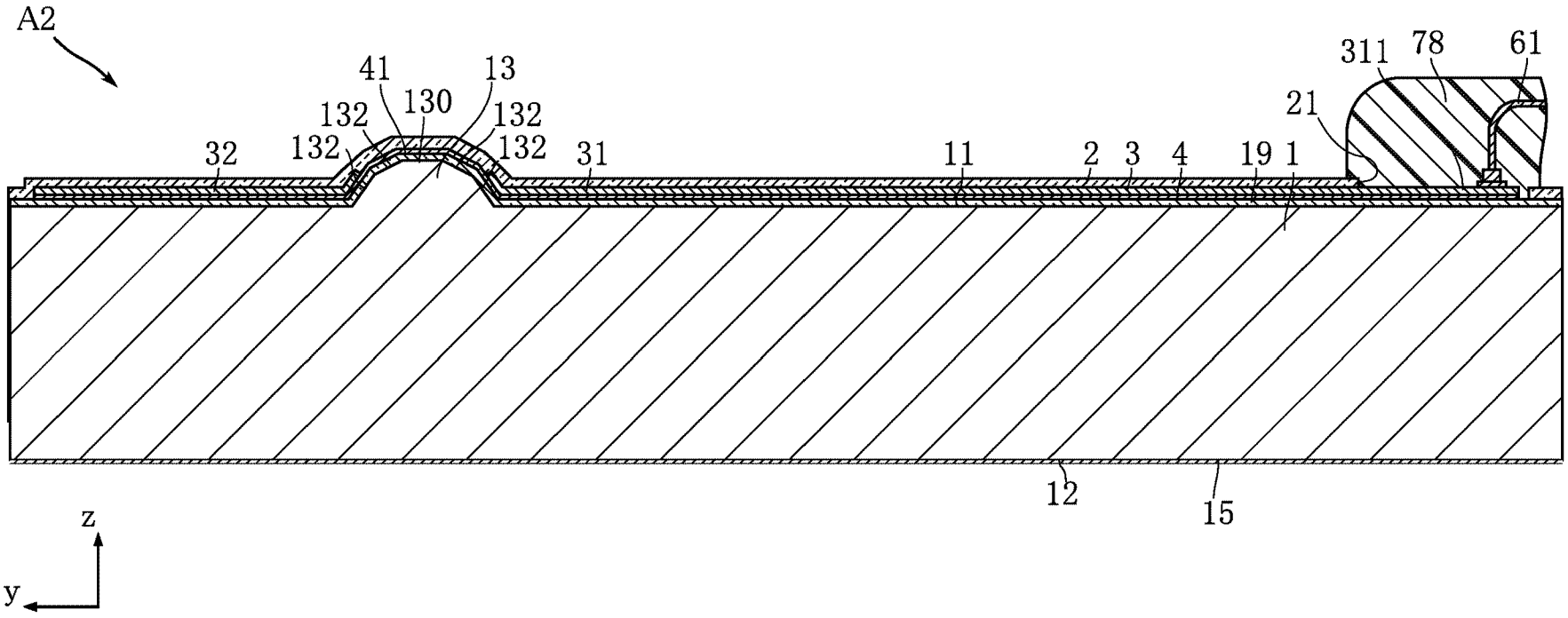
FIG. 21 is a cross-sectional view of a portion, showing a thermal printhead according to a second embodiment.

FIG. 21 shows a thermal printhead according to a second embodiment. A thermal printhead A2 of the present embodiment differs from the above-described embodiment in that the reflection layer 15 is formed on the first rear surface 12 of the first substrate 1.

In the present embodiment as well, the first substrate 1 is composed of Si. Si allows heat to pass more easily compared to a metal such as Cu, for example. According to the configuration in which the reflection layer 15 is provided on the first rear surface 12 as well, the heat that has passed through the first substrate 1 can be reflected by the reflection layer 15, and the printing quality can be improved.

Figure 22:
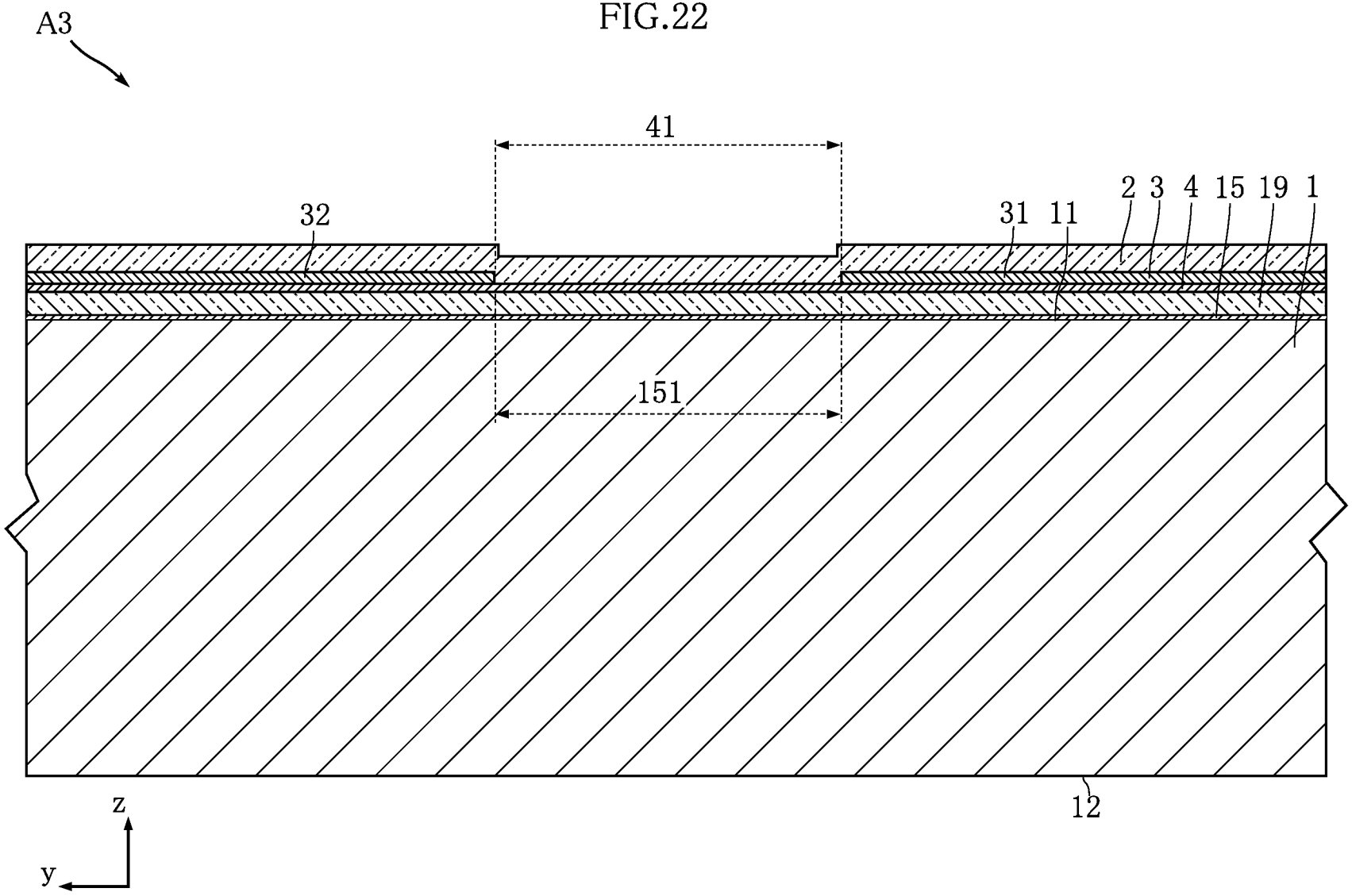
FIG. 22 is an enlarged cross-sectional view of a portion, showing a thermal printhead according to a third embodiment.

FIG. 22 shows a thermal printhead according to a third embodiment. A thermal printhead A3 of the present embodiment differs from the above-described embodiment in that the first substrate 1 is made of ceramic.

The first substrate 1 has the first front surface 11 and the first rear surface 12 but does not have the protrusion 13 of the above-described embodiment. The reflection layer 15 is formed so as to cover all of the first front surface 11. All of the reflection layer 15 is covered by the insulating layer 19. The insulating layer 19 is a layer with an approximately uniform thickness overall. For this reason, the multiple heat generation portions 41 are not configured to protrude with respect to the surrounding site.

According to this kind of embodiment as well, printing quality can be improved due to thermal reflection achieved by the reflection layer 15.

Figure 23:
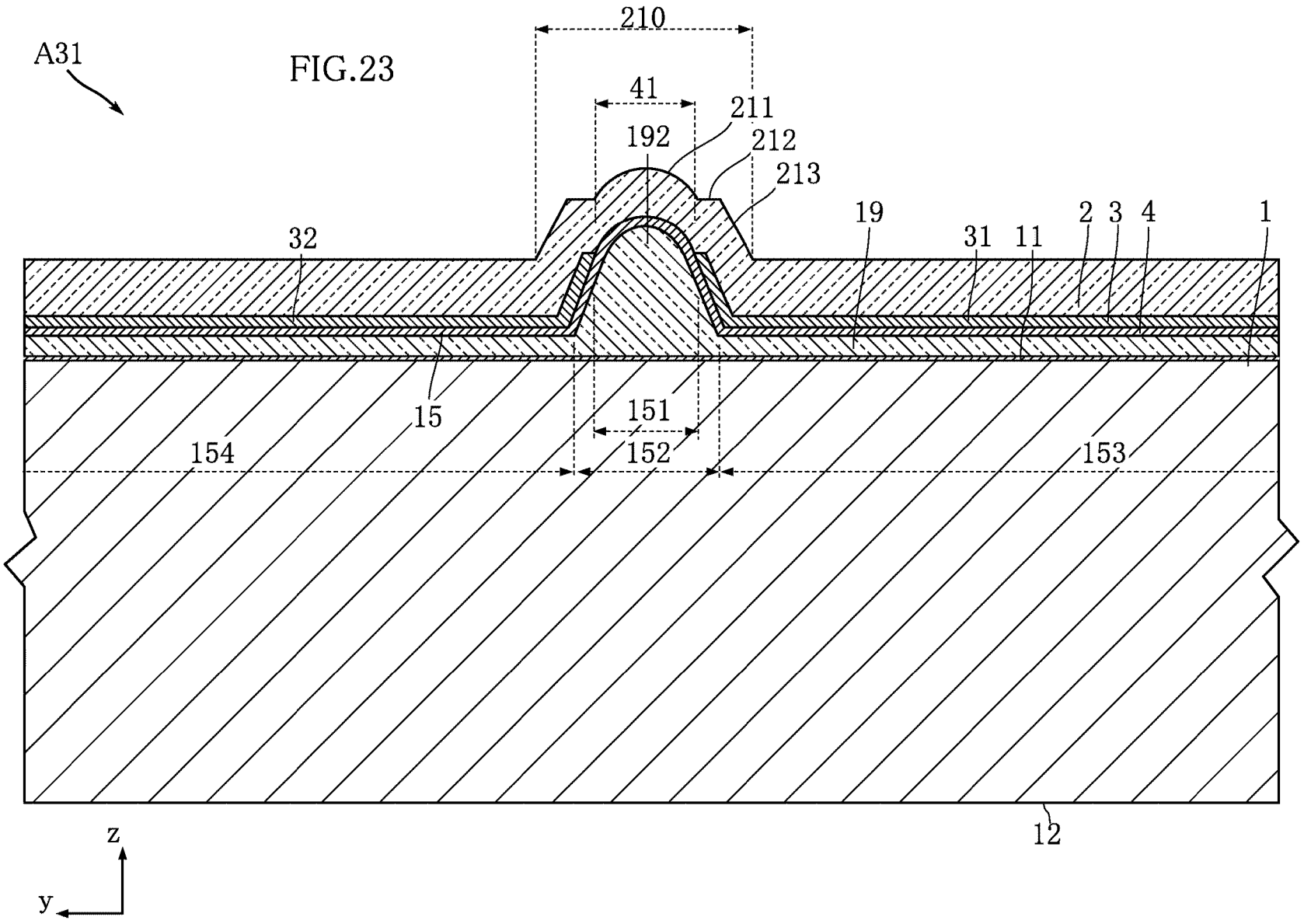
FIG. 23 is an enlarged cross-sectional view of a portion, showing a first modified example of the thermal printhead according to the third embodiment.

FIG. 23 shows a first modified example of the thermal printhead A3. In a thermal printhead A31 of the present modified example, the insulating layer 19 has a protrusion 192. The protrusion 192 is a site in which the insulating layer 19 partially protrudes in the z direction. The protrusion 192 has a shape that extends lengthwise in the x direction. The individual electrodes 31 and the common electrode 32 are provided on both sides of the protrusion 192 in the y direction. The multiple heat generation portions 41 are provided in a region overlapping with the protrusion 192 as viewed in the z direction.

The protection layer 2 includes a protrusion 210. The protrusion 210 overlaps with the protrusion 192 as viewed in the z direction and has a shape that protrudes in the z direction. The protrusion 210 has a first surface 211, a pair of second surfaces 212, and a pair of third surfaces 213. The first surface 211 is a surface of the protrusion 210 that is the furthest away from the first substrate 1 in the z direction, and in the example shown in the drawings, it is a curved surface that bulges in the z direction. The pair of second surfaces 212 are connected to both ends in the y direction of the first surface 211. The second surfaces 212 are surfaces that are approximately perpendicular to the z direction. The pair of third surfaces 213 are connected to the outer sides of the second surfaces 212 in the y direction. The pair of third surfaces 213 are surfaces that are inclined so as to be closer to the first substrate 1 in the z direction the further they are from the second surface 212 in the y direction.

According to this kind of modified example as well, printing quality can be improved due to thermal reflection achieved by the reflection layer 15. Also, by providing the protrusion 192, the multiple heat generation portions 41 can be pressed more strongly against the printing paper via the first surface 211 and the pair of second surfaces 212 of the protrusion 210 of the protection layer 2, which is preferable for improving the printing quality.

Figure 24:
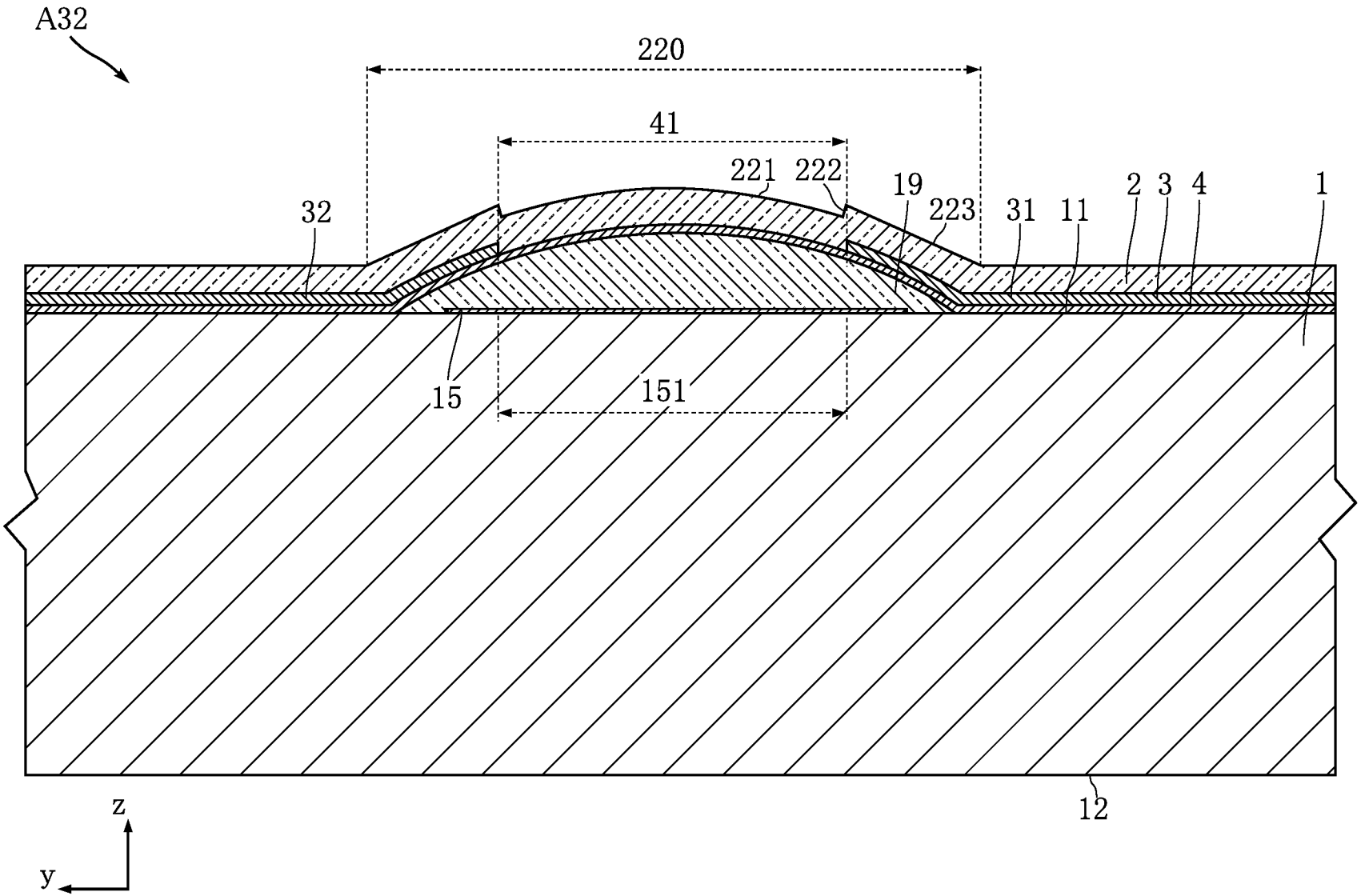
FIG. 24 is an enlarged cross-sectional view of a portion, showing a second modified example of the thermal printhead according to the third embodiment.

FIG. 24 shows a second modified example of the thermal printhead A3. In a thermal printhead A32 of the present modified example, the insulating layer 19 is provided so as to cover only part of the first front surface 11 in the y direction. The insulating layer 19 has a shape that gently protrudes in the z direction and extends lengthwise in the x direction. The multiple heat generation portions 41 are provided on the insulating layer 19. The reflection layer 15 is provided in a region enveloped in the insulating layer 19 as viewed in the z direction. That is, the reflection layer 15 is formed only between the first front surface 11 and the insulating layer 19 of the first substrate 1 and does not come into contact with the wiring layer 3 and the resistor layer 4.

The protection layer 2 includes a protrusion 220. The protrusion 220 has a shape that overlaps with the insulating layer 19 as viewed in the z direction and protrudes in the z direction overall. The protrusion 220 has a first surface 221, a pair of second surfaces 222, and a pair of third surfaces 223. The first surface 221 is a surface of the protrusion 220 that is located in the approximate center in the y direction, and in the example shown in the drawings, it is a curved surface that gently bulges in the z direction. The pair of second surfaces 222 are connected to both ends in the y direction of the first surface 221. The second surfaces 222 have shapes that are further away from the first substrate 1 in the z direction the further away they are from the first surface 221 in the y direction, and the second surfaces 222 are slightly inclined with respect to the z direction. The pair of third surfaces 223 are surfaces that are gently inclined so as to be closer to the first substrate 1 in the z direction the further away they are from the second surface 222 in the y direction.

According to this kind of modified example as well, printing quality can be improved due to thermal reflection achieved by the reflection layer 15. Also, by including the insulating layer 19 with a bulging shape, the multiple heat generation portions 41 can be more strongly pressed against the printing paper via the protrusion 220 of the protection layer 2, which is preferable for improving the printing quality.

Figure 25:
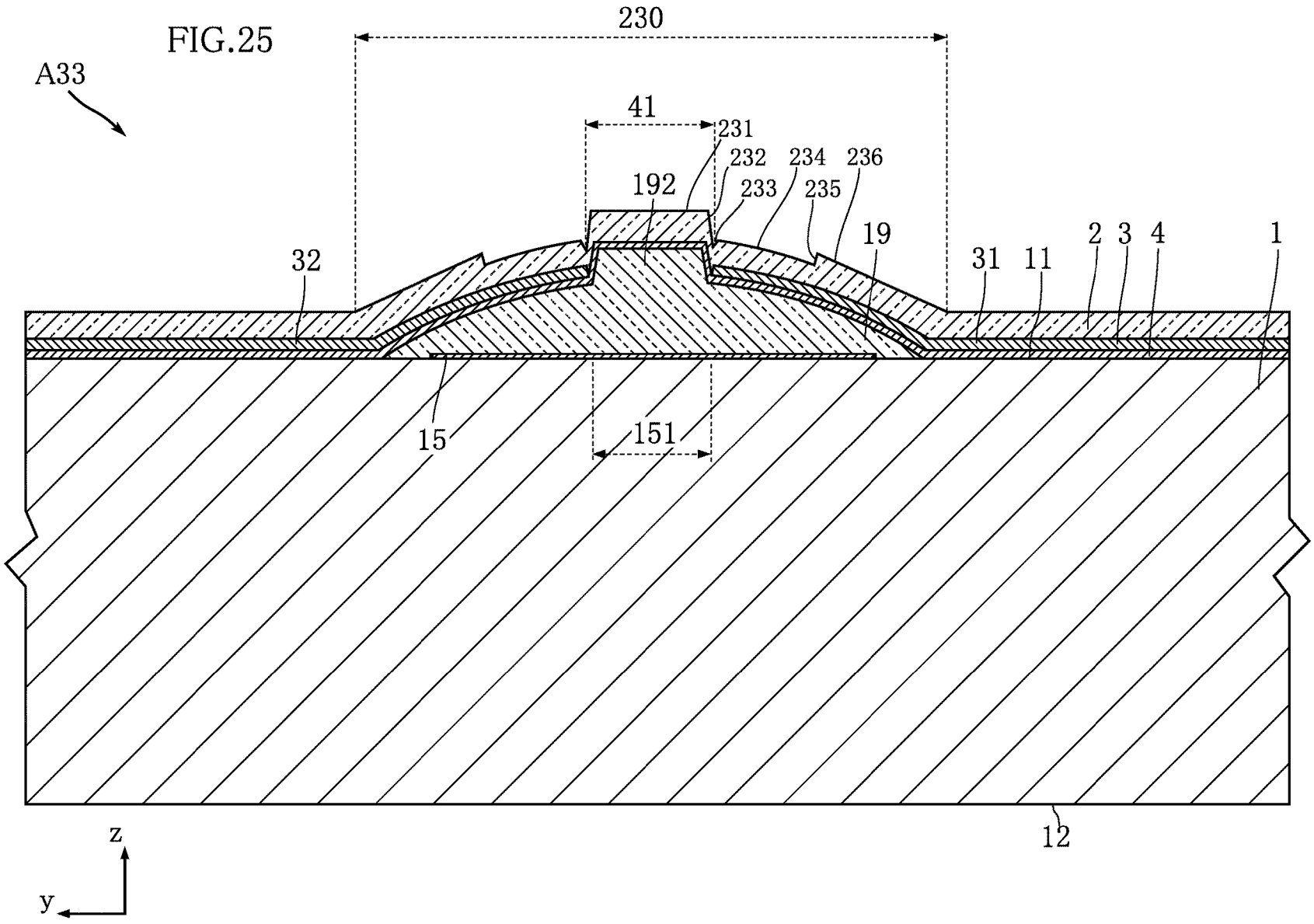
FIG. 25 is an enlarged cross-sectional view of a portion, showing a third modified example of the thermal printhead according to the third embodiment.

FIG. 25 shows a third modified example of the thermal printhead A3. In a thermal printhead A33 of the present modified example, the insulating layer 19 is provided so as to cover only part of the first front surface 11 in the y direction, and the thermal printhead 33 further includes a protrusion 192. The protrusion 192 is formed into a shape in which part of the insulating layer 19 partially protrudes relative to the surrounding site. In the present modified example, the multiple heat generation portions 41 are provided on the protrusion 192. Similarly to the reflection layer 15 of the thermal printhead A32, the reflection layer 15 is provided in a region enveloped by the insulating layer 19 as viewed in the z direction.

The protection layer 2 includes a protrusion 230. The protrusion 230 has a shape that overlaps with the insulating layer 19 as viewed in the z direction and protrudes in the z direction overall. The protrusion 230 has a first surface 231, a pair of second surfaces 232, a pair of third surfaces 233, a pair of fourth surfaces 234, a pair of fifth surfaces 235, and a pair of sixth surfaces 236. The first surface 231 is a surface of the protrusion 210 that is the furthest away from the first substrate 1 in the z direction, and in the example shown in the drawings, it is a surface that is approximately perpendicular to the z direction. The pair of second surfaces 232 are connected to both ends of the first surface 231 in the y direction. The second surface 232 has a shape that is closer to the first surface 1 in the z direction the further away it is from the first surface 231 in the y direction, and the second surface 232 is slightly inclined with respect to the z direction. The pair of third surfaces 233 are connected to the outer sides of the second surfaces 232 in the y direction. The third surfaces 233 are inclined so as to be further away from the first substrate 1 in the z direction the further away they are from the second surface 232 in the y direction. The dimension in the z direction of the third surfaces 233 is smaller than the dimension in the z direction of the second surfaces 232. The pair of fourth surfaces 234 are connected to the outer sides of the pair of third surfaces 233 in the y direction. The fourth surfaces 234 are inclined so as to be closer to the first substrate 1 in the z direction the further away they are from the third surfaces 233 in the y direction, and the fourth surfaces 234 are gently curved surfaces. The pair of fifth surfaces 235 are connected to the outer sides of the pair of fourth surfaces 234 in the y direction. The fifth surfaces 235 have shapes that are further away from the first substrate 1 in the z direction the further away they are from the fourth surfaces 234 in the y direction, and the fifth surfaces 235 are slightly inclined with respect to the z direction. The pair of sixth surfaces 236 are connected to the outer sides of the pair of fifth surfaces 235 in the y direction. The sixth surfaces 236 are inclined so as to be closer to the first substrate 1 in the z direction the further away they are from the fifth surfaces 235 in the y direction, and the sixth surfaces 236 are gently curved surfaces.

According to this kind of modified example as well, printing quality can be improved due to thermal reflection achieved by the reflection layer 15. Also, due to the insulating layer 19 including the protrusion 192, the multiple heat generation portions 41 can be more strongly pressed against the printing paper via the protrusion 230 of the protection layer 2, and the printing quality can be further improved.

Figure 26:
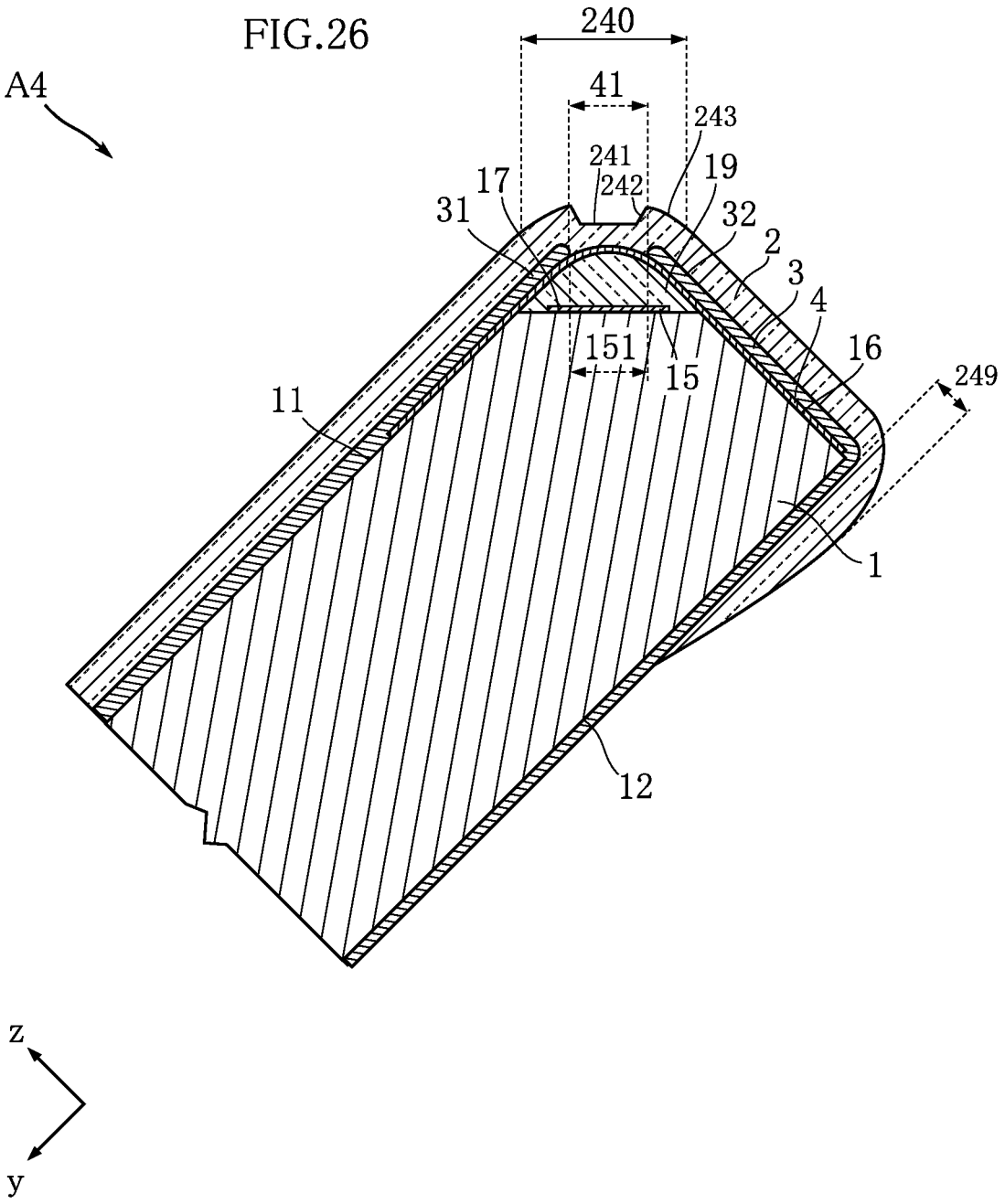
FIG. 26 is an enlarged cross-sectional view of a portion, showing a thermal printhead according to a fourth embodiment.

FIG. 26 shows a thermal printhead according to a fourth embodiment. In a thermal printhead A4 of the present embodiment, the first substrate 1 has the first front surface 11, the first rear surface 12, an end surface 16, and an inclined surface 17. The first substrate 1 is composed of ceramic. The end surface 16 is a surface that is located between the first front surface 11 and the first rear surface 12 in the z direction and is perpendicular to the y direction. The end surface 16 is connected to the first rear surface 12. The inclined surface 17 is interposed between the first front surface 11 and the end surface 16 and connects the first front surface 11 and the end surface 16. The inclined surface 17 is inclined with respect to the first front surface 11 and the end surface 16.

The insulating layer 19 is formed on the inclined surface 17 of the first substrate 1. The insulating layer 19 is flush with the first front surface 11 and the end surface 16 and has an approximately triangular shape as viewed in the x direction.

The resistor layer 4 covers at least part of the first front surface 11 and at least part of the insulating layer 19 and the end surface 16. The resistor layer 4 covers all of the insulating layer 19.

The wiring layer 3 exposes the resistor layer 4 on the insulating layer 19. Accordingly, the multiple heat generation portions 41 are provided on the insulating layer 19.

The reflection layer 15 is provided between the inclined surface 17 and the insulating layer 19 of the first substrate 1. The reflection layer 15 is not in contact with the wiring layer 3 and the resistor layer 4. Also, as viewed in the thickness direction of the portion of the resistor layer 4 constituting the multiple heat generation portions 41, that is, as viewed in the up-down direction of the drawing in FIG. 26, which is inclined in the y direction and the z direction, the reflection layer 15 overlaps with the multiple reflection layers 15 and has a reflection first portion 151.

The protection layer 2 is formed so as to overlap with the first front surface 11, the reflection layer 15, the end surface 16, and the first rear surface 12 of the first substrate 1. The protection layer 2 includes a protrusion 240. The protrusion 240 overlaps with the insulating layer 19 as viewed in a direction perpendicular to the inclined surface 17, and has a shape that bulges overall. The protrusion 240 has a first surface 241, a pair of second surfaces 242, and a pair of third surfaces 243. The first surface 241 is located in the approximate center as viewed in the x direction of the protrusion 240 and is an approximately flat surface in the example illustrated in the drawings. The pair of second surfaces 242 connect to both sides of the first surface 241 and are surfaces with shapes that are further away from the inclined surface 17 the further away they are from the first surface 241. The pair of third surfaces 243 are connected to the outer sides of the pair of second surfaces 242, and are surfaces that bulge gently as viewed in the x direction.

Also, the protection layer 2 has a bulging portion 249. The bulging portion 249 covers the portion of the first rear surface 12 on the side on which the inclined surface 17 is located in the y direction. The bulging portion 249 is a shape that bulges away from the first rear surface 12 in the z direction.

According to this kind of embodiment as well, printing quality can be improved due to thermal reflection of the reflection layer 15. Also, the multiple heat generation portions 41 can be more strongly pressed against the printing paper.

Figure 27:
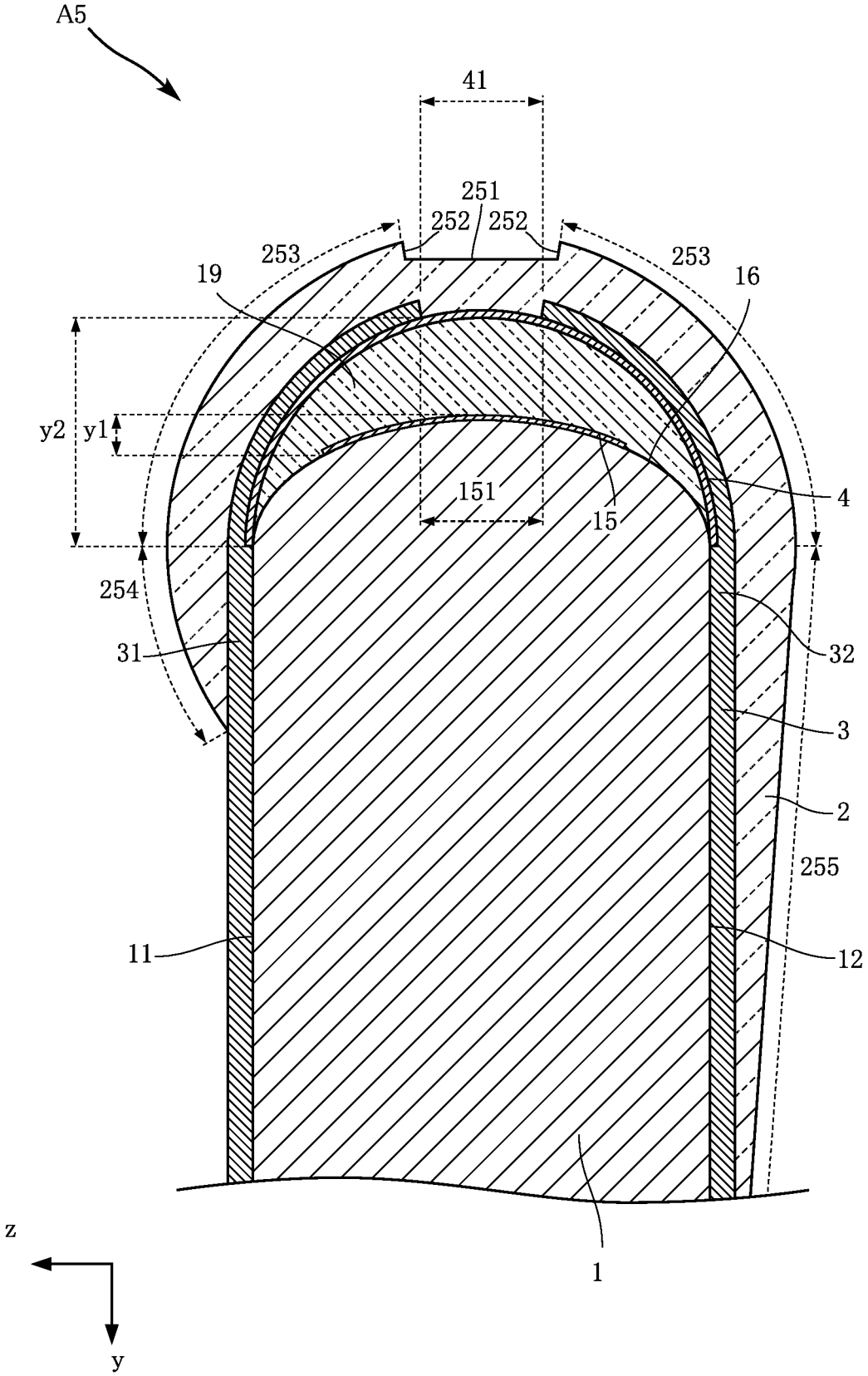
FIG. 27 is an enlarged cross-sectional view of a portion, showing a thermal printhead according to a fifth embodiment.

FIG. 27 shows a thermal printhead according to a fifth embodiment. In a thermal printhead A5 of the present embodiment, the first substrate 1 has the first front surface 11, the first rear surface 12, and an end surface 16. The first substrate 1 is composed of ceramic. The end surface 16 is connected to the first front surface 11 and the first rear surface 12. The end surface 16 is a curved surface that bulges in the y direction.

The reflection layer 15 is formed so as to cover part of the end surface 16. Due to being formed along the end surface 16, the reflection layer 15 is curved overall such that its dimension in the y direction is a dimension y1. The insulating layer 19 is formed so as to cover the end surface 16 and the reflection layer 15 of the first substrate 1. The insulating layer 19 is a shape that bulges in the y direction.

The resistor layer 4 is formed so as to cover the insulating layer 19. The wiring layer 3 exposes the resistor layer 4 in the region overlapping with the insulating layer 19 as viewed in the y direction. Accordingly, the multiple heat generation portions 41 are provided on the insulating layer 19.

As viewed in the thickness direction of a portion of the resistor layer 4 that constitutes the heat generation portion 41, that is, as viewed in the y direction, the reflection layer 15 overlaps with the multiple heat generation portions 41. The resistor layer 4 is curved overall by being formed on the insulating layer 19. The portion of the resistor layer 4 that overlaps with the wiring layer 3 is curved such that its dimension in the y direction is a dimension y2. The dimension y2 is larger than the dimension y1.

The protection layer 2 has a first surface 251, a pair of second surfaces 252, a pair of third surfaces 253, a fourth surface 254, and a fifth surface 255. The first surface 251 is a surface of the protection layer 2 that is located in the approximate center in the x direction, and in the example illustrated in the drawings, it is a surface that is approximately perpendicular with respect to the y direction. The pair of second surfaces 252 are connected to both ends of the first surface 251 in the z direction and are inclined so as to be further away from the first substrate 1 in the y direction the further away they are from the first surface 251 in the z direction. The pair of third surfaces 253 are connected to the outer sides of the pair of third surfaces 253 in the z direction. The third surface 253 is a curved surface with a bulging shape that approximately conforms to the shape of the insulating layer 19. One end of the fourth surface 254 is connected to one of the third surfaces 253, and the other end is in contact with the wiring layer 3. The fourth surface 254 is a curved surface that smoothly connects from the third surface 253. The fifth surface 255 is connected to the other third surface 253. The fifth surface 255 has a shape that is located closer to the first rear surface 12 the further away it is from the third surface 253 in the y direction. The fifth surface 255 has a larger area than the third surface 253 and is an approximately flat surface.

According to the present embodiment as well, printing quality can be improved due to thermal reflection of the reflection layer 15. Also, the multiple heat generation portions 41 can be more strongly pressed against the printing paper.

Appendix A1

A thermal printhead including:

a substrate;

a resistor layer including a plurality of heat generation portions that are supported by the substrate and are aligned in a primary scanning direction;

a wiring layer that is supported by the substrate and forms a conductive path to the plurality of heat generation portions;

an insulating layer interposed between the substrate and the resistor layer; and a reflection layer that is located on the side of the insulating layer opposite to the plurality of heat generation portions, overlaps with the plurality of heat generation portions as viewed in a thickness direction of the plurality of heat generation portions, and has a greater heat reflectivity than the insulating layer.

Appendix A2

The thermal printhead according to Appendix A1, wherein the reflection layer is interposed between the insulating layer and the substrate.

Appendix A3

The thermal printhead according to Appendix A2, wherein the substrate is composed of a single-crystal semiconductor.

Appendix A4

The thermal printhead according to Appendix A3, wherein the substrate is composed of Si.

Appendix A5

The thermal printhead according to Appendix A3 or A4, wherein the reflection layer includes Cu.

Appendix A6

The thermal printhead according to any one of Appendixes A3 to A5, wherein the reflection layer includes Ti.

Appendix A7

The thermal printhead according to Appendix A6, wherein the reflection layer includes: a reflection first layer that comes into contact with the substrate; and a reflection second layer formed on the reflection first layer.

Appendix A8

The thermal printhead according to Appendix A7, wherein the reflection second layer comes into contact with the insulating layer.

Appendix A9

The thermal printhead according to Appendix A7 or A8, wherein the reflection first layer is composed of Ti and the reflection second layer is composed of Cu.

Appendix A10

The thermal printhead according to any one of Appendixes A3 to A9, wherein the reflection layer is insulated with respect to the wiring layer.

Appendix A11

The thermal printhead according to any one of Appendixes A3 to A9, wherein the reflection layer is electrically connected to part of the wiring layer.

Appendix A12

The thermal printhead according to any one of Appendixes A3 to A11, wherein the reflection layer has a through portion that allows contact between the substrate and the insulating layer.

Appendix A13

The thermal printhead according to any one of Appendixes A3 to A12, wherein the substrate has a front surface on which the insulating layer is formed and a protrusion that protrudes from the front surface and extends in the primary scanning direction, the protrusion has a peak portion at which a distance from the front surface is the greatest, and a first inclined portion that connects to the peak portion in the secondary scanning direction and is inclined with respect to the front surface, and the heat generation portions are formed on at least part of the peak portion in the secondary scanning direction and on at least part of the first inclined portion in the secondary scanning direction, straddling a boundary between the peak portion and the first inclined portion.

Appendix A14

The thermal printhead according to Appendix A13, wherein the protrusion has a second inclined portion that is connected to the first inclined portion on the side opposite to the peak portion in the secondary scanning direction, and that is inclined with respect to the front surface at an inclination angle greater than that of the first inclined portion.

Appendix A15

The thermal printhead according to Appendix A14, wherein the protrusion has a pair of the first inclined portions located on both sides of the peak portion in the secondary scanning direction.

Appendix A16

The thermal printhead according to Appendix A15, wherein the protrusion has a pair of second inclined portions located on both sides of the pair of first inclined portions in the secondary scanning direction.

Appendix A17

The thermal printhead according to Appendix A16, wherein the heat generation portions are formed over the entire length of the peak portion in the secondary scanning direction and over the entire length of the pair of first inclined portions in the secondary scanning direction.

Appendix A18

The thermal printhead according to any one of Appendixes A15 to A17, wherein the heat generation portions are further formed on at least part of the second inclined portion in the secondary scanning direction, straddling the boundary between the first inclined portion and the second inclined portion.

Figure 28:
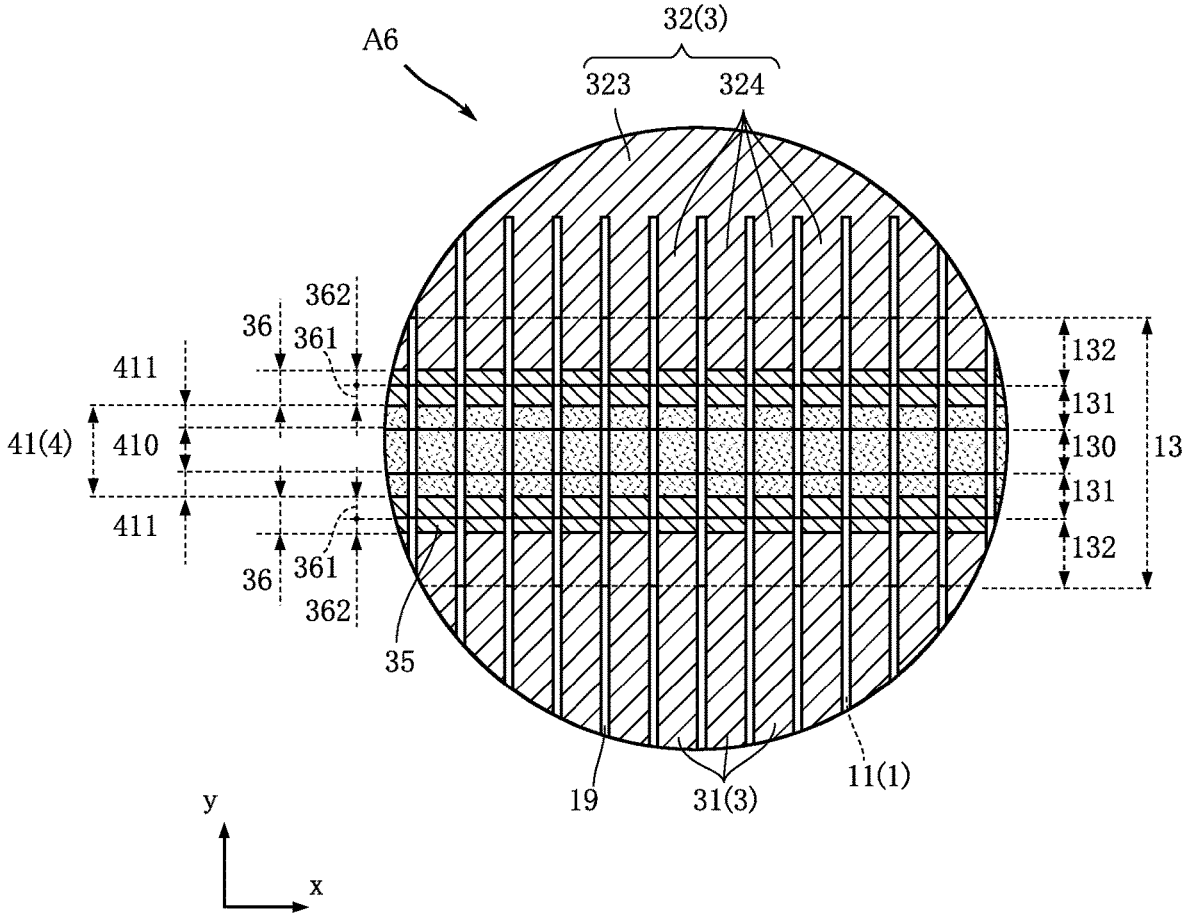
FIG. 28 is an enlarged plan view of a portion, showing a thermal printhead according to a sixth embodiment.
Figure 29:
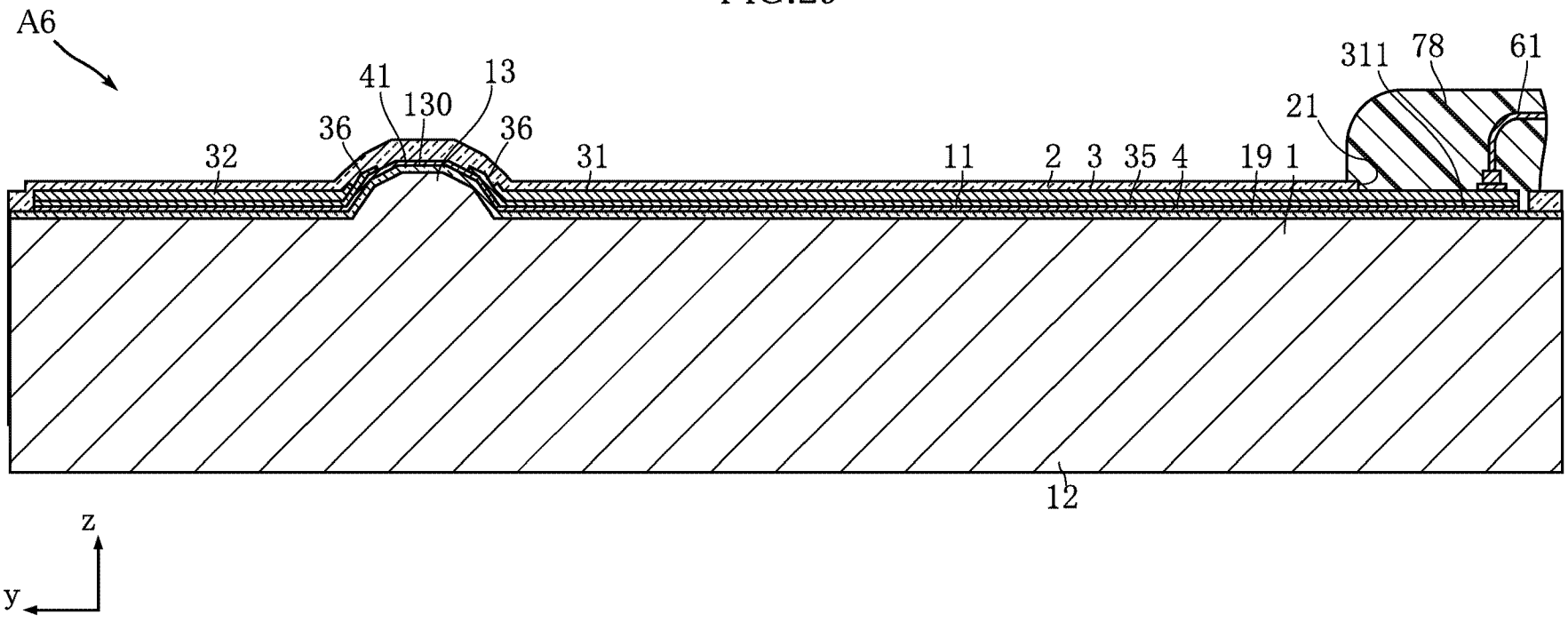
FIG. 29 is a cross-sectional view of a portion, showing a thermal printhead according to a sixth embodiment.
Figure 30:
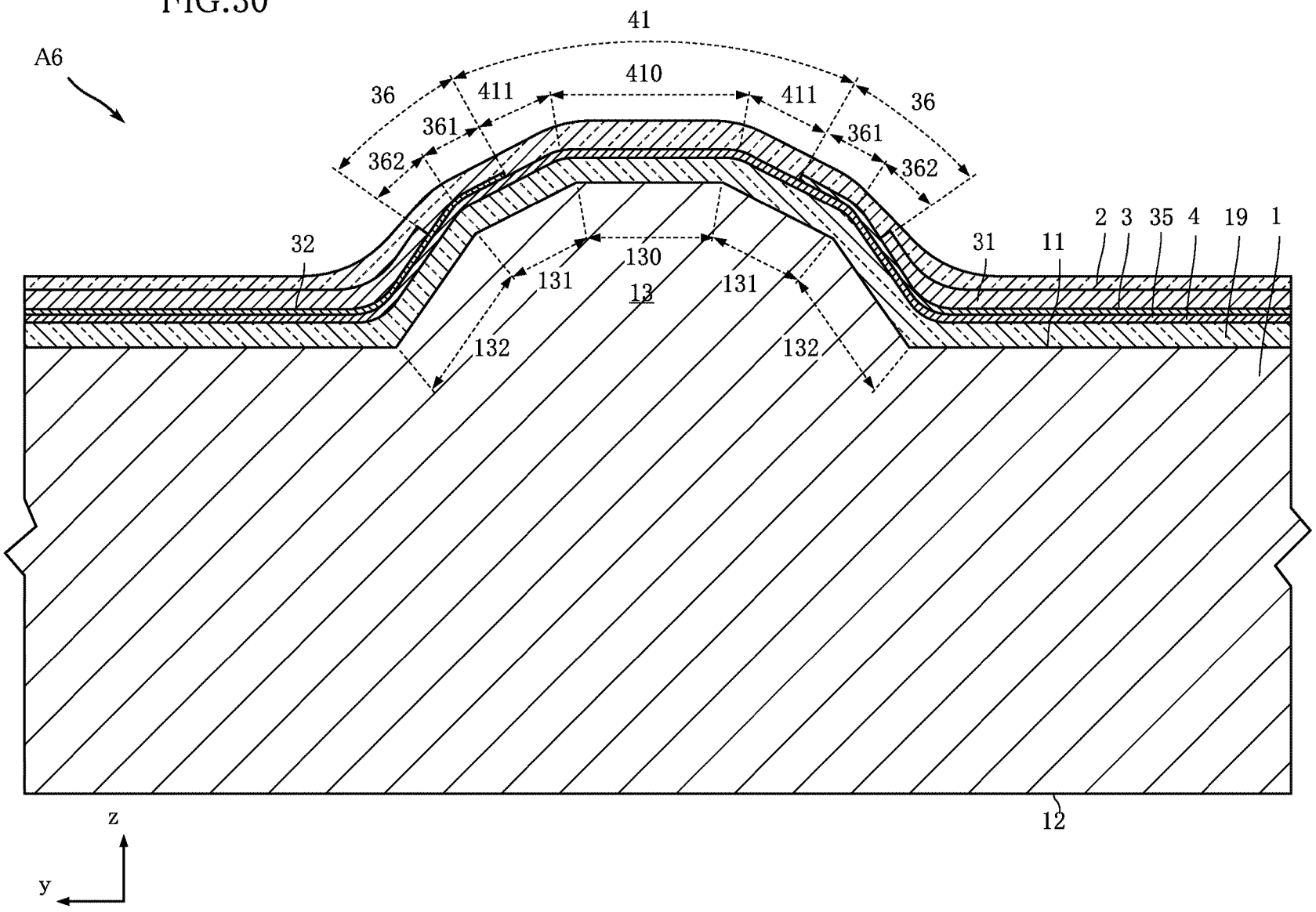
FIG. 30 is an enlarged cross-sectional view of a portion, showing the thermal printhead according to the sixth embodiment.

FIGS. 28 to 30 show a thermal printhead according to a sixth embodiment. The thermal printhead A6 of the present embodiment includes the first substrate 1, the insulating layer 19, the protection layer 2, the first conduction layer 3, the second conduction layer 35, the resistor layer 4, the second substrate 5, the driver IC 7, and the heat dissipation member 8. The thermal printhead A6 is incorporated in a printer that carries out printing on a printing medium (not shown) that is conveyed held between platen rollers 91. Examples of this kind of printing medium include heat-sensitive paper for creating a barcode sheet or a receipt.

FIG. 28 is an enlarged plan view showing a portion of the thermal printhead A6. FIG. 29 is a cross-sectional view showing a portion of the thermal printhead A6. FIG. 30 is an enlarged cross-sectional view showing a portion of the thermal printhead A6. In order to facilitate comprehension, the protection layer 2 is not shown in FIG. 28. In FIG. 28, the lower side of the drawing in the secondary scanning direction y is the upstream side, and the upper side of the drawing is the downstream side. In FIGS. 29 and 30, the right side of the drawing in the secondary scanning direction y is the upstream side, and the left side of the drawing is the downstream side.

The first substrate 1 has a configuration similar to that of the first substrate 1 of the above-described first embodiment, for example.

As shown in FIGS. 29 and 30, the insulating layer 19 covers the first front surface 11 and the protrusion 13 and is for more reliably insulating the first front surface 11 of the first substrate 1. The insulating layer 19 is composed of an insulating material such as $SiO_2$, SiN, or TEOS (tetraethyl orthosilicate), and in the present embodiment, TEOS is used. The thickness of the insulating layer 19 is not particularly limited, and in one example, it is 5 μm to 15 μm, for example, and preferably 5 μm to 10 μm.

The resistor layer 4 is supported by the first substrate 1, and in the present embodiment, the resistor layer 4 is supported by the first substrate 1 via the insulating layer 19. The resistor layer 4 includes multiple heat generation portions 41. The multiple heat generation portions 41 locally heat the printing medium due to current being selectively applied to each. In the present embodiment, the heat generation portions 41 are regions of the resistor layer 4 that are exposed from the first conduction layer 3 and the second conduction layer 35. The multiple heat generation portions 41 are arranged along the primary scanning direction x and are separated from each other in the primary scanning direction x. The shapes of the heat generation portions 41 are not particularly limited, and in the present embodiment, they are rectangular shapes whose longitudinal directions are the secondary scanning direction y as viewed in the thickness direction z. The resistor layer 4 is composed of TaN, for example. The thickness of the resistor layer 4 is not particularly limited, and for example, it is 0.02 μm to 0.1 μm, and preferably about 0.08 μm.

As shown in FIGS. 28 and 30, in the present embodiment, the heat generation portion 41 has the peak portion 410, the pair of first portions 411, and the pair of second portions 412. The peak portion 410 is a portion formed on at least part of peak portion 130 of the protrusion 13 in the secondary scanning direction y of the heat generation portion 41. The first portion 411 is a portion that is formed on at least part of the first inclined portion 131 of the protrusion 13 in the secondary scanning direction y, in the heat generation portion 41. The second portion 412 is a portion that is formed on at least part of the second inclined portion 132 of the protrusion 13 in the secondary scanning direction y, in the heat generation portion 41. Note that in the present embodiment, the insulating layer 19 is interposed between the first substrate 1 and the resistor layer 4, but as described above, the insulating layer 19 is a layer that is sufficiently thin. For this reason, if the heat generation portions 41 are formed so as to overlap as viewed in the thickness direction z, or in views in the normal line directions of the peak portion 130, the first inclined portions 131, and the second inclined portions 132, it is described that the heat generation portions 41 are formed on the peak portion 130, the first inclined portions 131, and the second inclined portions 132, and the same also applies below.

In the present embodiment, the peak portion 410 is formed over the entire length of the peak portion 130 in the secondary scanning direction y. Also, the heat generation portion 41 straddles the boundary between the peak portion 130 and the pair of first inclined portions 131. Also, the pair of first portions 411 are formed over the entire length of the pair of first inclined portions 131 in the secondary scanning direction y. The heat generation portion 41 straddles the boundaries between the pair of first inclined portions 131 and the pair of second inclined portions 132. Also, the pair of second portions 412 are formed on only part of the second inclined portions 132 in the secondary scanning direction y.

The second conduction layer 35 is a layer in which the resistance per unit length in the secondary scanning direction reaches a value between that of the heat generation portion 41 and the first conduction layer 3 of the resistor layer 4. As shown in FIGS. 28 and 30, the portions of the resistor layer 4 protruding from the second conduction layer 35 are the multiple heat generation portions 41. The second conduction layer 35 has multiple auxiliary heat generation portions 36 that are adjacent to the heat generation portions 41 in the secondary scanning direction y and come into contact with the first conduction layer 3. The auxiliary heat generation portions 36 are sites of the second conduction layer 35 that protrude from the first conduction layer 3. A material and thickness that satisfy the above-described relationship of the resistances are used as appropriate as the material and thickness of the second conduction layer 35. An example of the material of the second conduction layer 35 is a material that includes Ti. If the thickness of the heat generation portion 41 of the resistor layer 4 is 0.08 μm, the thickness of the second conduction layer 35 is about 0.02 μm to 0.06 μm, and is smaller than that of the heat generation portion 41 of the resistor layer 4. The second conduction layer 35 is formed on the resistor layer 4 and is in contact with the resistor layer 4.

In the present embodiment, the second conduction layer 35 has a pair of auxiliary heat generation portions 36. The pair of auxiliary heat generation portions 36 each have a first portion 361 and a second portion 362. The first portion 361 is a site that is formed on the first inclined portion 131 of the protrusion 13, and in the example illustrated in the drawings, the first portion 361 is formed on part of the first inclined portion 131 in the secondary scanning direction y. The second portion 362 is a site that is formed on the second inclined portion 132, and in the example illustrated in the drawings, it is formed on part of the second inclined portion 132 in the secondary scanning direction y. Also, the auxiliary heat generation portion 36 straddles the boundary between the first inclined portion 131 and the second inclined portion 132.

Due to the resistance per unit length in the secondary scanning direction y of the second conduction layer 35 being in the above-described range, when current is applied to the heat generation portions 41, the heat generation amounts of the auxiliary heat generation portions 36 will be smaller than the heat generation amounts of the heat generation portions 41 and larger than the heat generation amount of the first conduction layer 3. For example, under a current application condition according to which the heat generation portion 41 reaches about 200° C., the auxiliary heat generation portion 36 reaches about 100° C.

The first conduction layer 3 has a configuration similar to that of the wiring layer 3 in the above-described first to fifth embodiments, and is for forming a conductive path for applying current to the multiple heat generation portions 41. The first conduction layer 3 is supported by the first substrate 1, and in the present embodiment, as shown in FIGS. 29 and 30, the first conduction layer 3 is stacked on the second conduction layer 35. The first conduction layer 3 is composed of a metal material with a lower resistance than the resistor layer 4 and the second conduction layer 35, and is composed of Cu, for example. The thickness of the first conduction layer 3 is not particularly limited, and is 0.3 μm to 2.0 μm, for example. This kind of first conduction layer 3 has a smaller resistance per unit length in the secondary scanning direction y than the heat generation portion 41 and the second conduction layer 35.

As shown in FIGS. 28, 29, and 30, in the present embodiment, the first conduction layer 3 has multiple individual electrodes 31 and a common electrode 32.

As shown in FIGS. 28 and 30, the multiple individual electrodes 31 have band shapes that extend approximately in the secondary scanning direction y, and the multiple individual electrodes 31 are arranged upstream of the multiple heat generation portions 41 in the secondary scanning direction y. In the present embodiment, the ends of the individual electrodes 31 on the downstream side in the secondary scanning direction y are arranged at positions overlapping the second inclined portions 132 located upstream in the secondary scanning direction y of the protrusion 13. As shown in FIG. 29, the individual electrodes 31 have individual pads 311. The individual pads 311 are portions to which wires 61 for applying current to the driver IC 7 are connected.

As shown in FIGS. 2, 28, 29, and 30, the common electrode 32 has the coupling portions 323 and the multiple band-shaped portions 324. The multiple band-shaped portions 324 are arranged downstream of the multiple heat generation portions 41 in the secondary scanning direction y. The ends of the multiple band-shaped portions 324 located upstream in the secondary scanning direction y are located on the side of the heat generation portions 41 opposite to the ends of the multiple individual electrodes 31 located downstream in the secondary scanning direction y. The ends of the band-shaped portions 324 located upstream in the secondary scanning direction y are arranged at positions overlapping the second inclined portions 132 located downstream of the protrusion 13 in the secondary scanning direction y. The coupling portion 323 is located downstream of the multiple band-shaped portions 324 in the secondary scanning direction y, and the multiple band-shaped portions 324 are connected. The coupling portion 323 is a relatively wide portion that extends in the primary scanning direction x and has a dimension in the secondary scanning direction y that is larger than the dimension in the primary scanning direction x of the band-shaped portion 324. As shown in FIG. 1, the coupling portion 323 extends from the downstream side of the multiple heat generation portions in the secondary scanning direction y toward the upstream side in the secondary scanning direction y, bypassing both sides in the primary scanning direction x.

In the present embodiment, the portion of the multiple band-shaped portions 324 on the downstream side in the secondary scanning direction y and the coupling portion 323 are formed on the first front surface 11 of the first substrate 1.

The protection layer 2 covers the first conduction layer 3 and the resistor layer 4. The protection layer 2 is composed of an insulating material and protects the first conduction layer 3 and the resistor layer 4. The material of the protection layer 2 is, for example, $SiO_2$, SiN, SiC, or AlN, and the protection layer 2 is constituted by a single layer or multiple layers of these materials. The thickness of the protection layer 2 is not particularly limited, and for example, it is about 1.0 μm to 10 μm.

As shown in FIG. 29, in the present embodiment, the protection layer 2 has a pad opening 21. The pad opening 21 penetrates through the protection layer 2 in the thickness direction z. The multiple pad openings 21 expose the multiple individual pads 311 of the individual electrodes 31.

The second substrate 5 has a configuration similar to that of the second substrate 5 of the above-described first embodiment, for example.

The driver IC 7 has a configuration similar to that of the driver IC 7 of the above-described first embodiment, for example.

The protection resin 78 has a configuration similar to that of the protection resin 78 of the above-described first embodiment, for example.

The connector 59 has a configuration similar to that of the connector 59 of the above-described first embodiment, for example.

The heat dissipation member 8 has a configuration similar to that of the heat dissipation member 8 of the above-described first embodiment, for example.

Next, an example of a method for manufacturing the thermal printhead A6 will be described below with reference to FIGS. 31 to 36.

First, the first substrate 1 having the protrusion 13 is prepared through the steps shown in FIGS. 7 to 10, for example.

Figure 31:
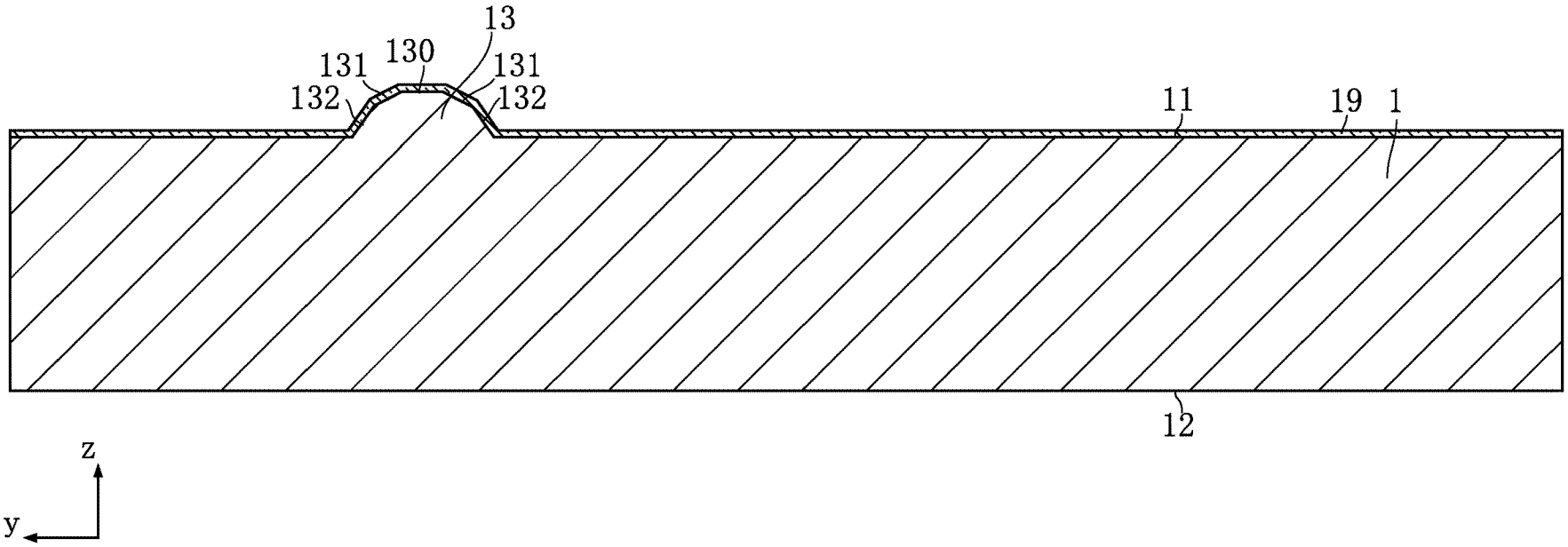
FIG. 31 is a cross-sectional view of a portion, showing an example of a method for manufacturing the thermal printhead according to the sixth embodiment.

Next, as shown in FIG. 31, the insulating layer 19 is formed. The formation of the insulating layer 19 is performed by depositing TEOS on the first front surface 11 side of the first substrate 1 using CVD, for example.

Figure 32:
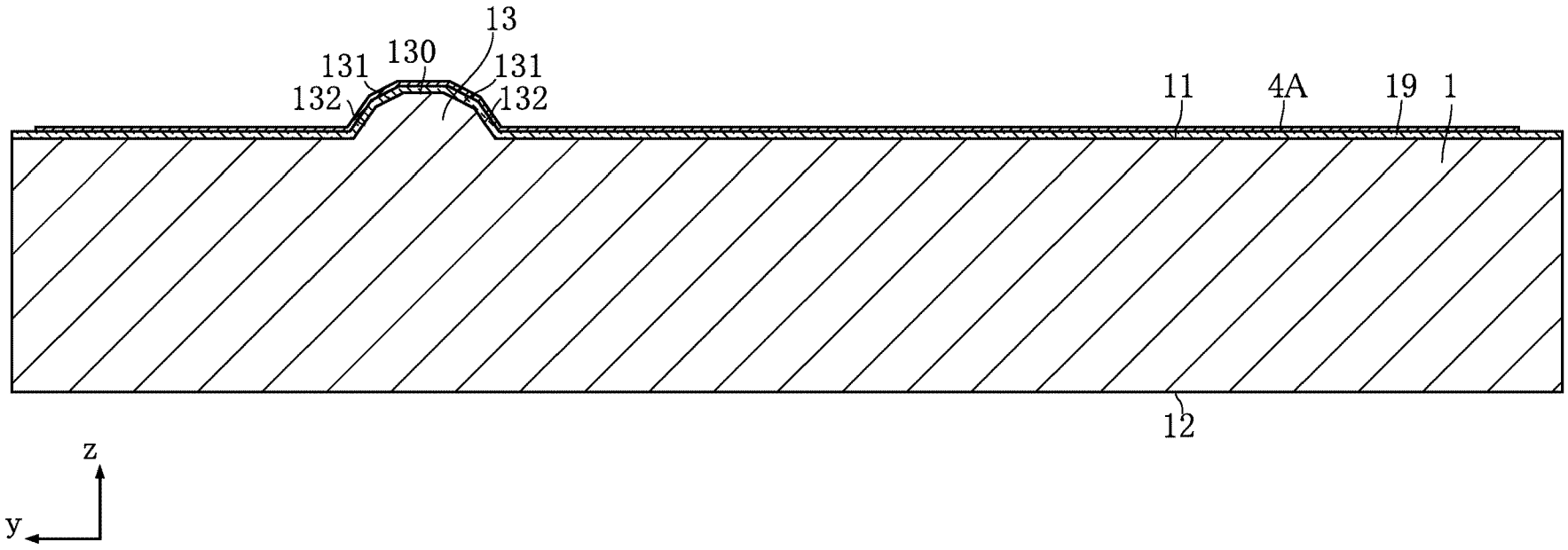
FIG. 32 is a cross-sectional view of a portion, showing an example of a method for manufacturing the thermal printhead according to the sixth embodiment.

Next, as shown in FIG. 32, a resistor film 4A is formed. The resistor film 4A is formed by forming a thin film of TaN on the insulating layer 19 through sputtering, for example.

Figure 33:
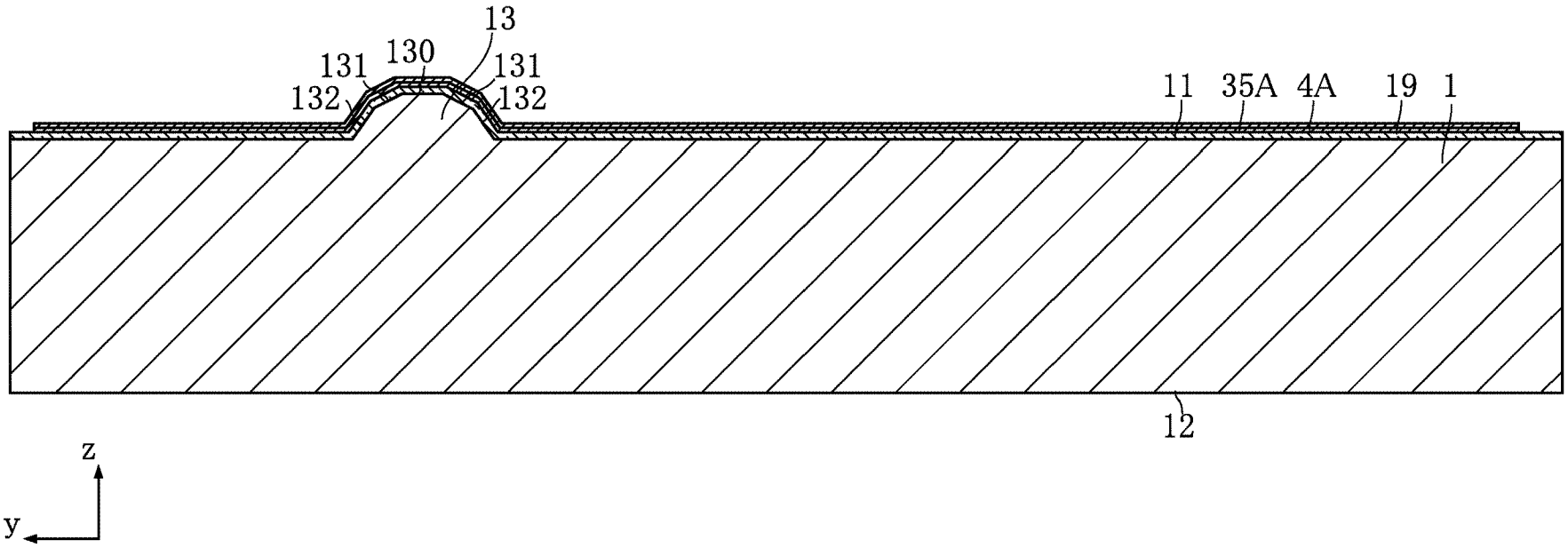
FIG. 33 is a cross-sectional view of a portion, showing an example of a method for manufacturing the thermal printhead according to the sixth embodiment.

Next, as shown in FIG. 33, the second conduction film 35A is formed. The formation of the second conduction film 35A is performed by forming a thin film of Ti on the resistor film 4A through sputtering, for example.

Figure 34:
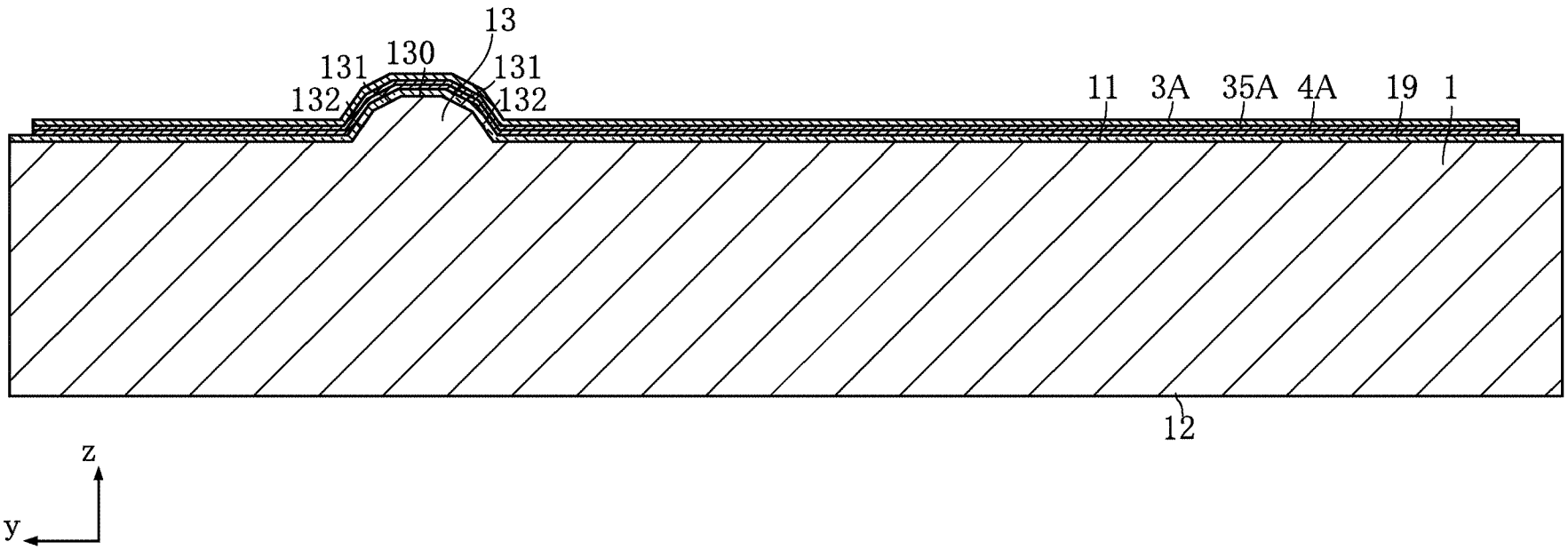
FIG. 34 is a cross-sectional view of a portion, showing an example of a method for manufacturing the thermal printhead according to the sixth embodiment.

Next, as shown in FIG. 34, the conduction film 3A that covers the second conduction film 35A is formed. The conduction film 3A is formed by forming a layer composed of Cu through plating, sputtering, or the like, for example.

Figure 35:
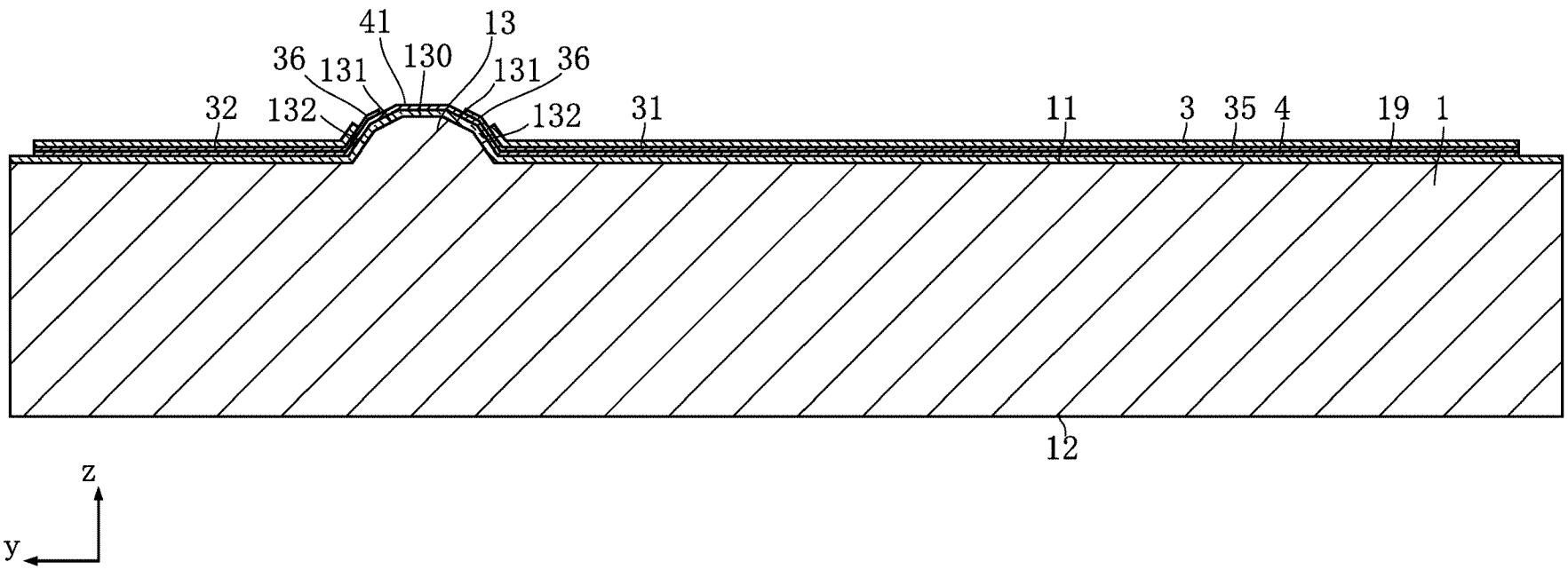
FIG. 35 is a cross-sectional view of a portion, showing an example of a method for manufacturing the thermal printhead according to the sixth embodiment.
Figure 36:
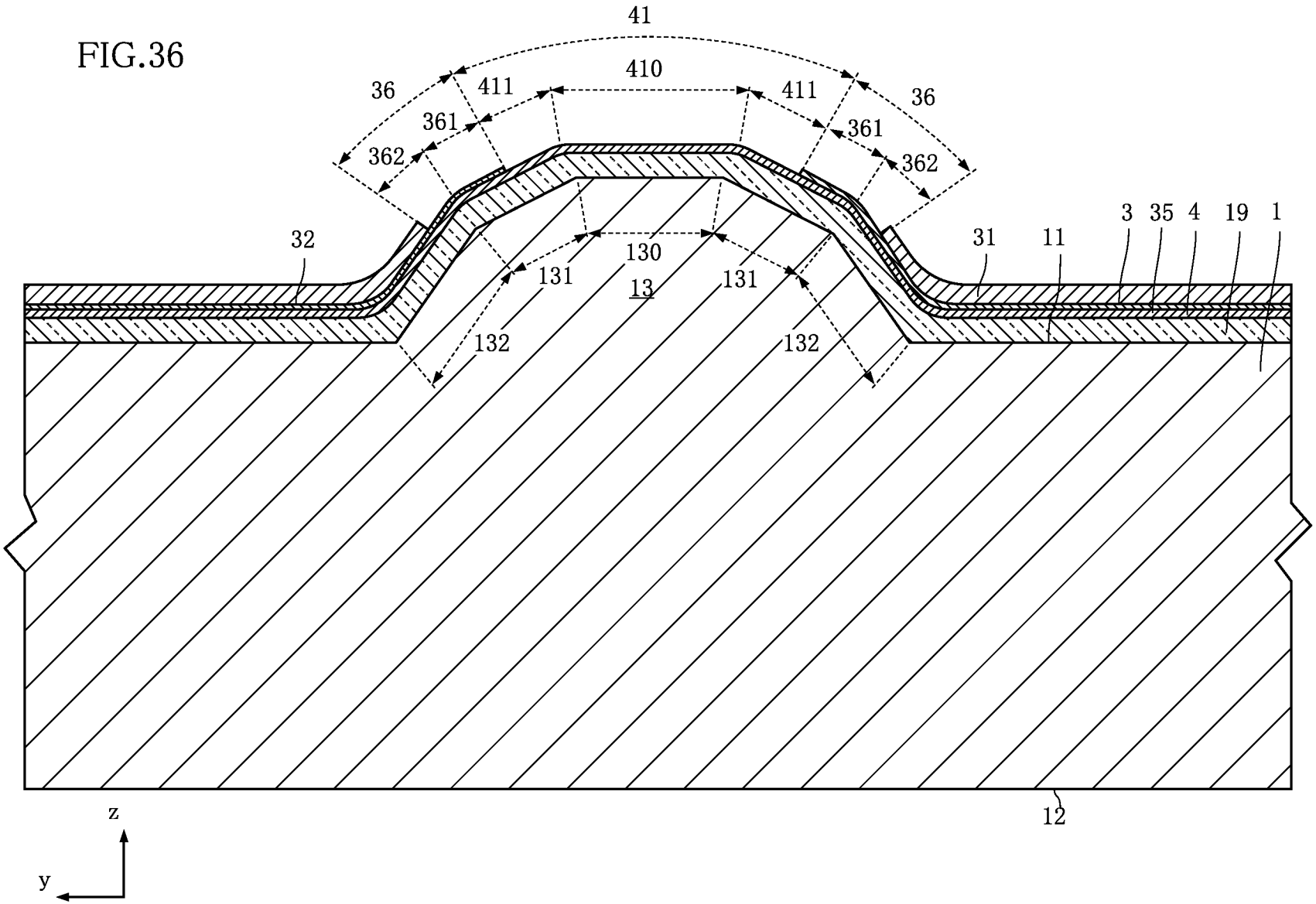
FIG. 36 is a cross-sectional view of a portion, showing an example of a method for manufacturing the thermal printhead according to the sixth embodiment.

Next, as shown in FIGS. 35 and 36, the first conduction layer 3, the second conduction layer 35, and the resistor layer 4 are obtained by carrying out selective etching of the conduction film 3A and the second conduction film 35A, and selective etching of the resistor film 4A. The first conduction layer 3 has the above-described multiple individual electrodes 31 and common electrode 32. The second conduction layer 35 has multiple auxiliary heat generation portions 36. The resistor layer 4 has the multiple heat generation portions 41.

Next, the protection layer 2 is formed. The formation of the protection layer 2 is executed by depositing SiN and SiC on the insulating layer 19, the first conduction layer 3, the second conduction layer 35, and the resistor layer 4 using CVD, for example. Also, a pad opening 21 is formed by partially removing the protection layer 2 through etching or the like. Thereafter, the first substrate 1 and the second substrate 5 are attached to the first support surface 81, the driver ICs 7 are mounted on the second substrate 5, the multiple wires 61 and the multiple wires 62 are bonded, the protection resin 78 is formed, and the like, and thereby the above-described thermal printhead A6 is obtained.

Next, actions of the thermal printhead A6 will be described.

According to the present embodiment, the second conduction layer 35 is provided at a position adjacent to the heat generation portions 41 in the secondary scanning direction y. When current is applied, the second conduction layer 35 reaches a temperature lower than that of the heat generation portion 41 and higher than that of the first conduction layer 3. Accordingly, the temperature gradient in the secondary scanning direction y can be eased compared to the case where the heat generation portion 41 and the first conduction layer 3 are adjacent to each other. This makes it possible to suppress breakage or the like caused by thermal stress, and to improve the durability and reliability of the thermal printhead A6. Providing the auxiliary heat generation portions 36 on both sides of the heat generation portion 41 in the secondary scanning direction y is preferable for improving the durability and the reliability through easing the temperature gradient.

Due to the auxiliary heat generation portion 36 being provided upstream of the heat generation portion 41, the printing paper transmitted in the secondary scanning direction y is heated by the auxiliary heat generation portions 36 and is thereafter heated by the heat generation portions 41 which have a higher temperature. Although the second conduction layer 35 generates heat to such a degree that a temperature higher than that of the first conduction layer 3 is reached, it reaches about 100° C. in the current application condition in which the heat generation portions 41 reach about 200° C., for example. With a temperature of this degree, the printing paper, which is a common heat-sensitive paper, does not generate clear color due to the heating performed by the auxiliary heat generation portions 36. On the other hand, upon being heated by the heat generation portions 41, color is generated more rapidly and clearly due to being pre-heated by the auxiliary heat generation portions 36. Accordingly, it is possible to achieve an improvement in the printing quality and the printing speed. Also, compared to the case in which the auxiliary heat generation portion 36 is not included, the printing paper can be caused to generate color even if the temperature of the heat generation portions 41 is lowered. Accordingly, the above-described temperature gradient can be further eased, which contributes to improving the durability and the reliability. Since the energy load is not concentrated only on the heat generation portions 41 and is dispersed to the auxiliary heat generation portions 36, this leads to suppressing alteration or degradation of the heat generation portions 41. Furthermore, since the above-described temperature gradient can also be eased, this contributes to improving the durability and reliability without reducing the printing efficiency.

Also, the protrusion 13 of the first substrate 1 has the peak portion 130 and the first inclined portions 131. The heat generation portion 41 has a peak portion 410 formed on the peak portion 130 and first portions 411 formed on the first inclined portions 131, and is formed straddling the boundaries between the peak portion 130 and the first inclined portion 131. For this reason, similarly to the thermal printhead A1 shown in FIG. 4, when the platen roller 91 is pressed against the thermal printhead A6, the platen roller 91 comes into contact with one or both of the peak portion 410 and the first portion 411 due to the elastic deformation of the platen roller 91. As shown in FIG. 4, in the case of using a configuration in which the center 910 of the platen roller 91 matches the center of the protrusion 13 in the secondary scanning direction y, the platen roller 91 comes into contact with the peak portion 410 with a strong force. On the other hand, if the center 910 of the platen roller 91 unexpectedly shifts in the secondary scanning direction y with respect to the center of the protrusion 13, the pressing force of the platen roller 91 and the peak portion 410 will decrease. However, in the present embodiment, since the heat generation portion 41 has the first portions 411, if the platen roller 91 shifts, the percentage of the platen roller 91 that comes into contact with the first portion 411 increases, and the platen roller 91 is still suitably pressed against the heat generation portion 41. Accordingly, with the thermal printhead A6, even if the platen roller 91 shifts unexpectedly, the diameter of the platen roller 91 is different, or the like, then reduction of the printing quality can be suppressed and the printing quality can be improved.

Also, in the present embodiment, the peak portion 410 is formed over the entire length of the peak portion 130 in the secondary scanning direction y and the pair of first portions 411 are provided on both sides of the peak portion 410 in the secondary scanning direction y. For this reason, even if the shifting of the platen roller 91 occurs upstream or downstream in the secondary scanning direction y, reduction of the printing quality can be suppressed. Also, the pair of first portions 411 are formed over the entire length of the first inclined portions 131 in the secondary scanning direction y. This is preferable for suppressing a reduction of the printing quality in the case where the platen roller 91 shifts unexpectedly.

Also, in the present embodiment, the protrusion 13 has the pair of second inclined portions 132. That is, the protrusion 13 is configured such that the first inclined portions 131 and the second inclined portions 132, which are inclined in two stages with respect to the peak portion 130 (first front surface 11), are arranged side-by-side in the secondary scanning direction y. For this reason, the angle formed by the peak portion 130 and the first inclined portion 131 can be reduced, which is preferable for improving the printing quality. Also, the smaller the angle formed by the peak portion 130 and the first inclined portion 131 is, the more the prevention of wear in the protection layer 2 caused by the passage of the printing paper during printing can be suppressed. Also, due to the first portion 411 being provided over the entire length of the first inclined portion 131 in the secondary scanning direction y, the ends of the second conduction layer 35 and the first conduction layer 3 in the secondary scanning direction y are not located on the pair of first inclined portions 131 and are located on the pair of first inclined portions 131 and the pair of second inclined portions 132. For this reason, it is possible to avoid a case in which a level difference caused by the presence of the edges of the second conduction layer 35 and the first conduction layer 3 is generated at a position overlapping with the first inclined portion 131, which is advantageous for smooth passage of the printing paper and prevention of attachment of paper residue. Also, providing the pair of second portions 412 is more preferable for suppressing reduction of the printing quality in the case where the platen roller 91 shifts unexpectedly.

The common electrode 32 is located downstream of the multiple heat generation portions 41 in the secondary scanning direction y, and thus only the multiple individual electrodes 31 are aligned upstream of the multiple heat generation portions 41 in the secondary scanning direction y. Accordingly, the alignment pitch of the multiple individual electrodes 31 in the primary scanning direction x can be shortened, and more detailed printing can be achieved.

Figure 37:
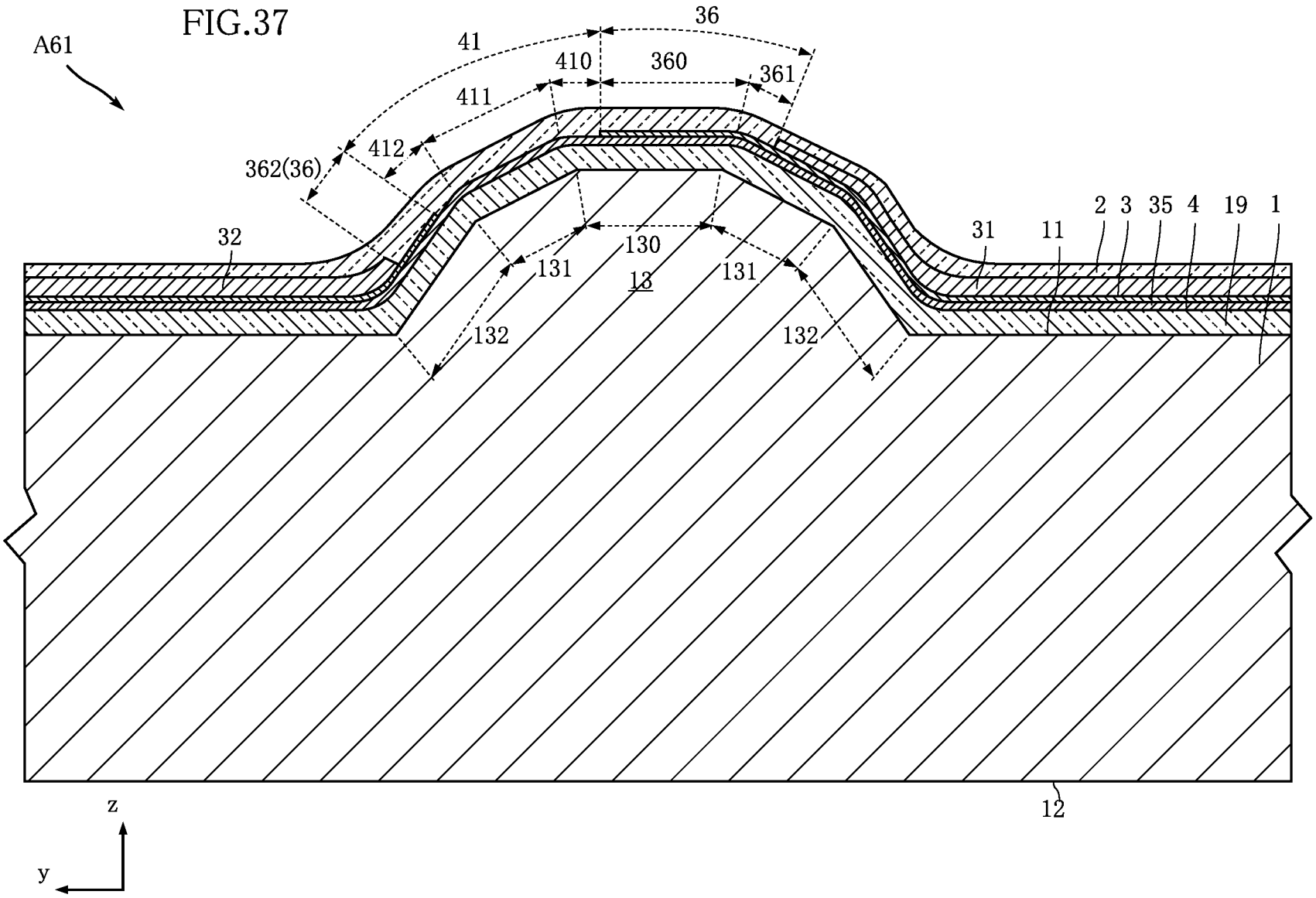
FIG. 37 is an enlarged cross-sectional view of a portion, showing a first modified example of the thermal printhead according to the sixth embodiment.

FIG. 37 shows a first modified example of the thermal printhead A6. In a thermal printhead A61 of the present modified example, the positions of the heat generation portions 41 and the pair of auxiliary heat generation portions 36 differ from those of the above-described example.

In the present embodiment, the heat generation portion 41 has the peak portion 410, the first portion 411, and the second portion 412, and there is one of each. The peak portion 410 is formed on only part of the peak portion 130 on the downstream side in the secondary scanning direction y. That is, in the present embodiment, the end of the second conduction layer 35 on the downstream side in the secondary scanning direction y is provided at a position overlapping the peak portion 130. The first portion 411 is formed over the entire length in the secondary scanning direction y of the first inclined portion 131 located downstream in the secondary scanning direction y. The heat generation portion 41 is formed straddling the boundaries between the peak portion 130 and the first inclined portions 131. The second portion 412 is formed on only part of the upstream side of the second inclined portion 132 in the secondary scanning direction y, the second inclined portion 132 being located on the downstream side in the secondary scanning direction y.

That is, the end of the second conduction layer 35 on the upstream side in the secondary scanning direction y is provided at a position overlapping the second inclined portion 132 on the downstream side in the secondary scanning direction y. The heat generation portion 41 is formed straddling the boundary between the first inclined portion 131 on the downstream side in the secondary scanning direction y and the second inclined portion 132 on the downstream side in the secondary scanning direction y.

The auxiliary heat generation portion 36 in the pair of auxiliary heat generation portions 36 that is located upstream in the secondary scanning direction y has a peak portion 360 and a first portion 361. The peak portion 360 is formed on part of the peak portion 130 in the secondary scanning direction y, and is adjacent to the peak portion 410 of the heat generation portion 41. The peak portion 360 has a larger dimension in the secondary scanning direction y than the peak portion 410. The first portion 361 is formed on part of the first inclined portion 131 in the secondary scanning direction y. That is, the end on the downstream side in the secondary scanning direction y of the individual electrode 31 of the first conduction layer 3 is located on the first inclined portion 131. The auxiliary heat generation portion 36 straddles the boundary between the peak portion 130 and the first inclined portion 131.

The one of the pair of auxiliary heat generation portions 36 that is located on the downstream side in the secondary scanning direction y has a second portion 362. The second portion 362 is formed on part of the second inclined portion 132 in the secondary scanning direction y and is adjacent to the second portion 412 of the heat generation portion 41. The second portion 362 has a larger dimension in the secondary scanning direction y than the second portion 412. The second portion 362 is formed on part of the first inclined portion 131 in the secondary scanning direction y. That is, the end on the downstream side in the secondary scanning direction y of the common electrode 32 of the first conduction layer 3 is located on the second inclined portion 132.

According to the present modified example as well, the durability and reliability of the thermal printhead A61 can be improved. Also, the heat generation portion 41 is formed biased toward the portion of the protrusion 13 on the downstream side in the secondary scanning direction y. Accordingly, in a case in which the center 910 of the platen roller 91 is biased downstream in the secondary scanning direction with respect to the protrusion 13, favorable printing quality is obtained. This kind of arrangement is advantageous for avoiding interference between the platen roller 91 and the protection resin 78, and can shorten the dimension in the secondary scanning direction y of the first substrate 1. Also, by shortening the length in the secondary scanning direction y of the heat generation portion 41, heat is generated in a concentrated manner in a smaller region of the heat generation portion 41. This is preferable for clearer printing.

Figure 38:
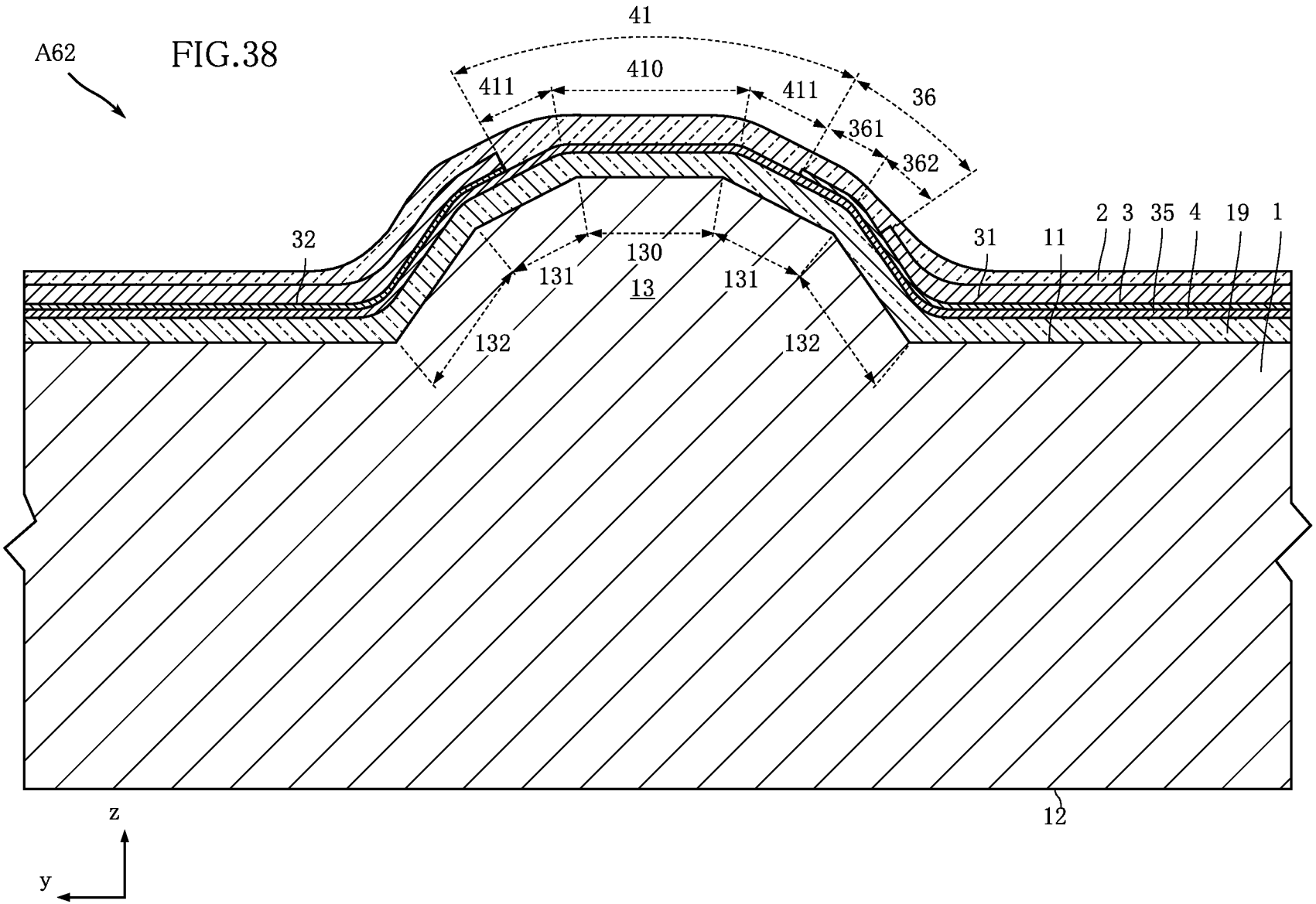
FIG. 38 is an enlarged cross-sectional view of a portion, showing a second modified example of the thermal printhead according to the sixth embodiment.

FIG. 38 shows a second modified example of the thermal printhead A6. In a thermal printhead A62 of the present modified example, the second conduction layer 35 has only one auxiliary heat generation portion 36 per heat generation portion 41.

In the present example, the auxiliary heat generation portion 36 is provided only on the upstream side in the secondary scanning direction y of the heat generation portion 41. The auxiliary heat generation portion 36 has, for example, a first portion 361 and a second portion 362. On the end of the heat generation portion 41 on the downstream side in the secondary scanning direction y, the end of the second conduction layer 35 on the upstream side in the secondary scanning direction y and the end of the first conduction layer 3 on the upstream side in the secondary scanning direction y match, or only the end of the first conduction layer 3 on the upstream side in the secondary scanning direction y is present.

According to this kind of modified example as well, the durability and reliability of the thermal printhead A62 can be improved. Also, due to the auxiliary heat generation portion 36 being provided on the upstream side in the secondary scanning direction y of the heat generation portion 41, it is possible to achieve an improvement in printing quality and printing speed.

Figure 39:
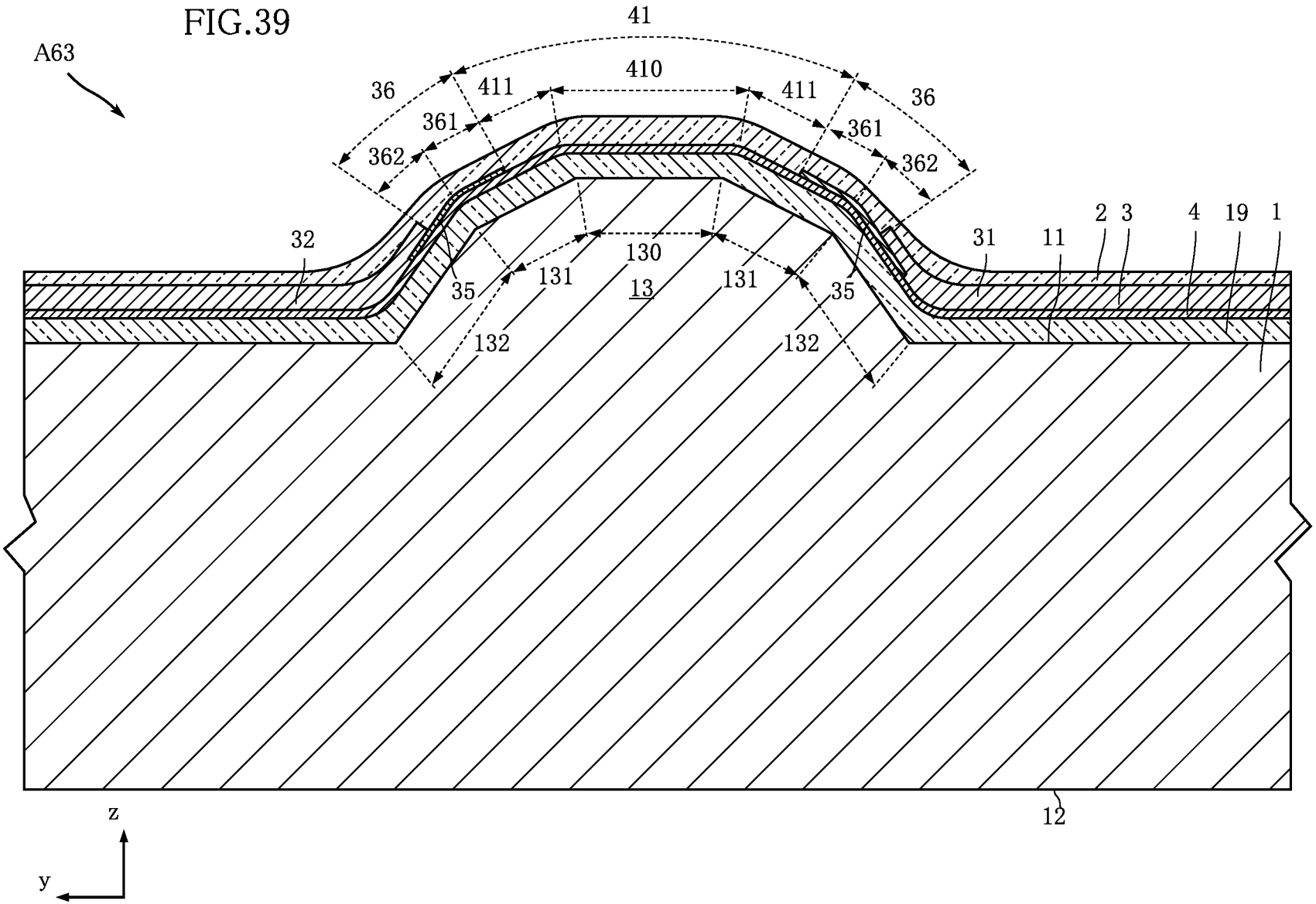
FIG. 39 is an enlarged cross-sectional view of a portion, showing a third modified example of the thermal printhead according to the sixth embodiment.

FIG. 39 shows a third modified example of the thermal printhead A6. In a thermal printhead A63 of the present modified example, the second conduction layer 35 is formed on only a portion in the secondary scanning direction y.

In the present example, the second conduction layer 35 is formed so as to cover part of the protrusion 13 and is not formed on a region that covers the first front surface 11. In the example illustrated in the drawings, the second conduction layer 35 is formed on respective parts of the pair of first inclined portions 131 and on respective parts of the pair of second inclined portions 132.

According to this kind of modified example as well, the durability and reliability can be improved. Also, by reducing the area for forming the second conduction layer 35, it is possible to achieve a reduction of the manufacturing cost.

Figure 40:
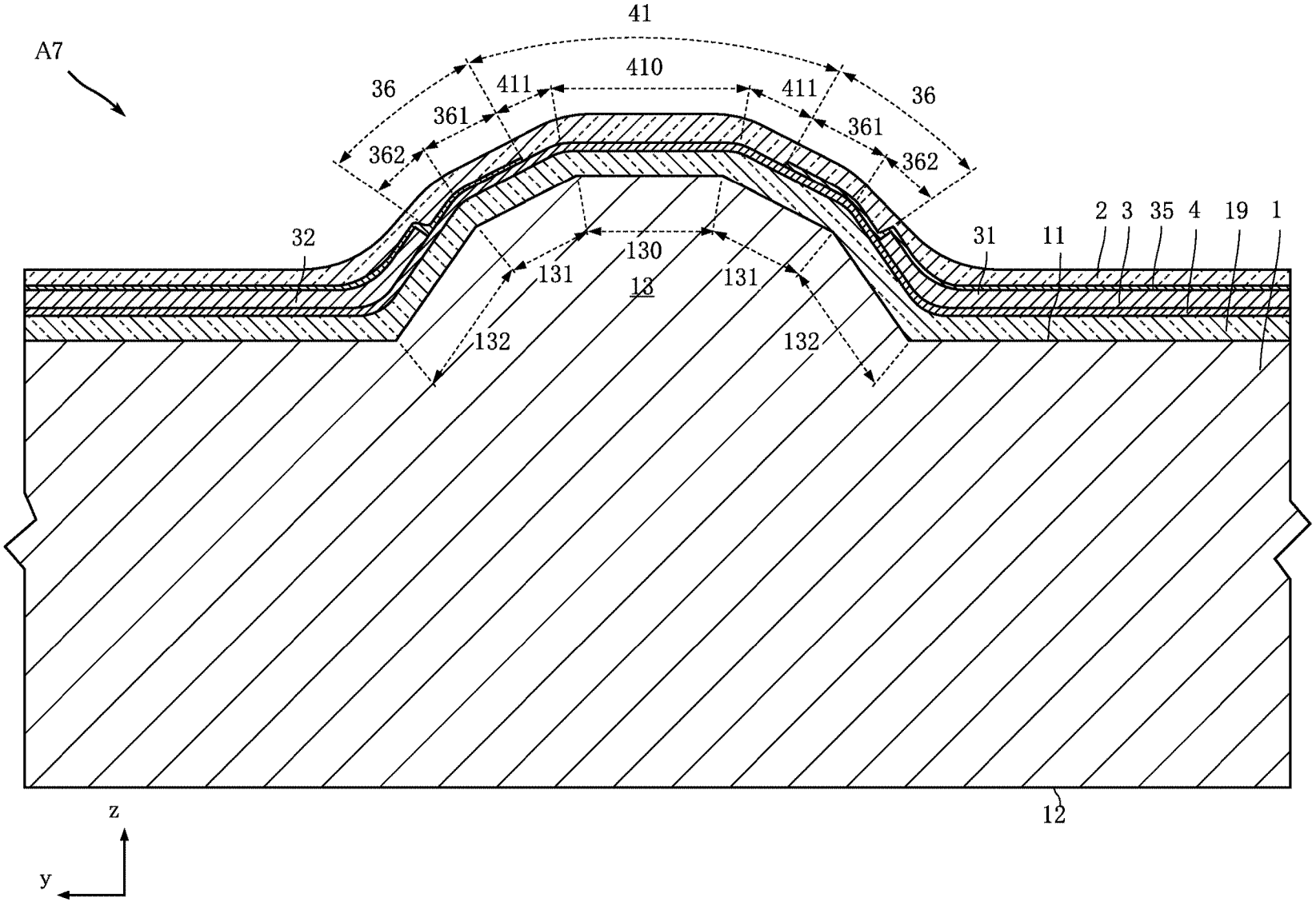
FIG. 40 is an enlarged cross-sectional view of a portion, showing a thermal printhead according to a seventh embodiment.

FIG. 40 shows a thermal printhead according to a seventh embodiment. In a thermal printhead A7 of the present embodiment, the stacking structure of the first conduction layer 3, the second conduction layer 35, and the resistor layer 4 differs from that of the above-described embodiment.

In the present embodiment, the second conduction layer 35 is formed on the resistor layer 4 and the first conduction layer 3. In the example illustrated in the drawings, the second conduction layer 35 covers all of the first conduction layer 3 and covers part of the portion of the resistor layer 4 that is exposed from the first conduction layer 3.

According to the present embodiment as well, the durability and reliability of the thermal printhead A7 can be improved. Also, as is understood from the present embodiment, the second conduction layer 35 may also be provided between the first conduction layer 3 and the resistor layer 4, and may also be provided between the second conduction layer 35 and the protection layer 2.

Figure 41:
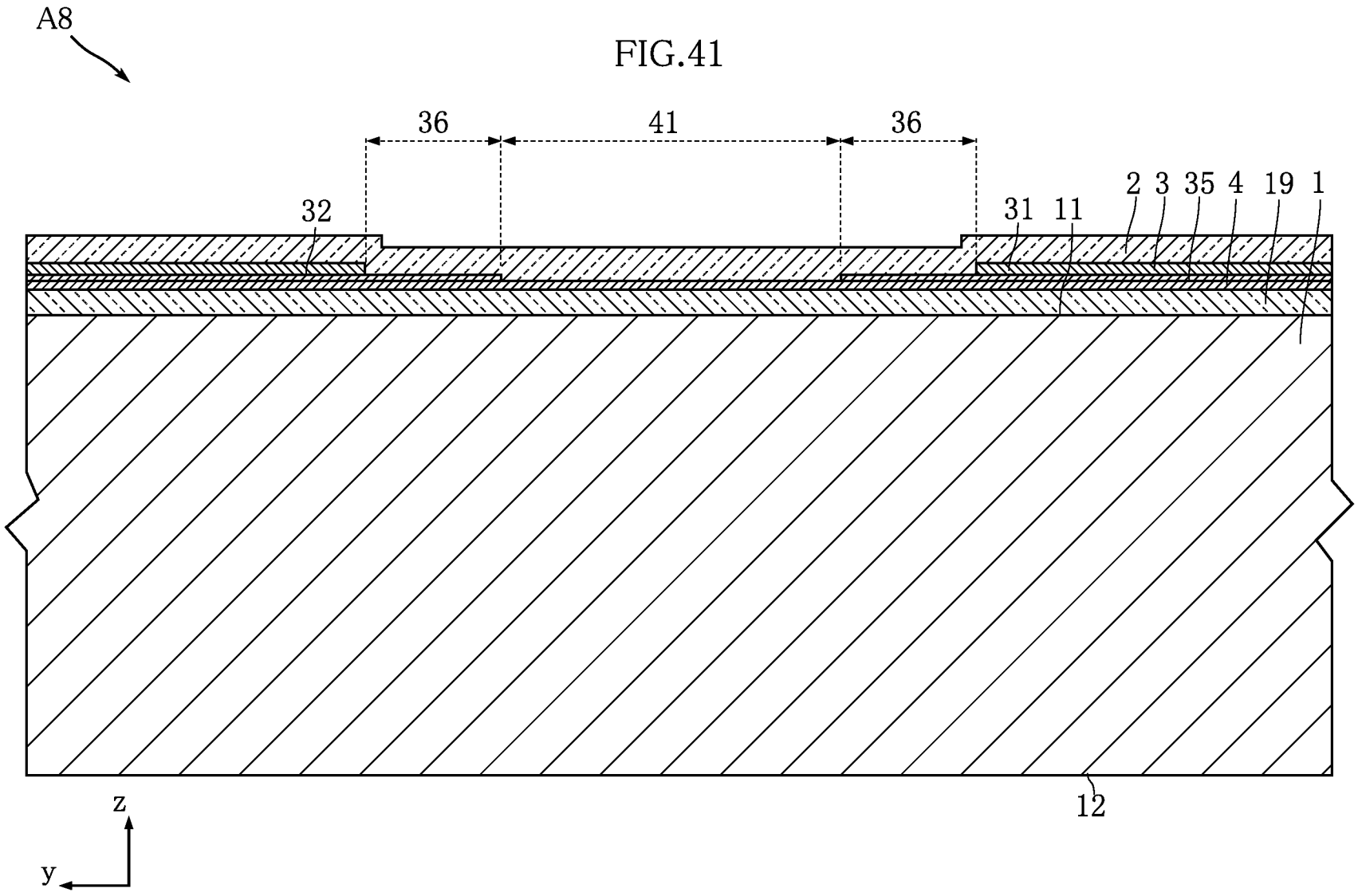
FIG. 41 is an enlarged cross-sectional view of a portion, showing a thermal printhead according to an eighth embodiment.

FIG. 41 shows a thermal printhead according to an eighth embodiment. A thermal printhead A8 of the present embodiment differs from the above-described embodiment in that the first substrate 1 is made of ceramic.

The first substrate 1 has the first front surface 11 and the first rear surface 12 but does not have the protrusion 13 of the above-described embodiment. The insulating layer 19 is a layer with an approximately uniform thickness overall. For this reason, the multiple auxiliary heat generation portions 36 and the multiple heat generation portions 41 are not configured to protrude with respect to the surrounding site.

According to this kind of embodiment as well, the durability and reliability of the thermal printhead A8 can be improved due to the presence of the auxiliary heat generation portion 36.

Figure 42:
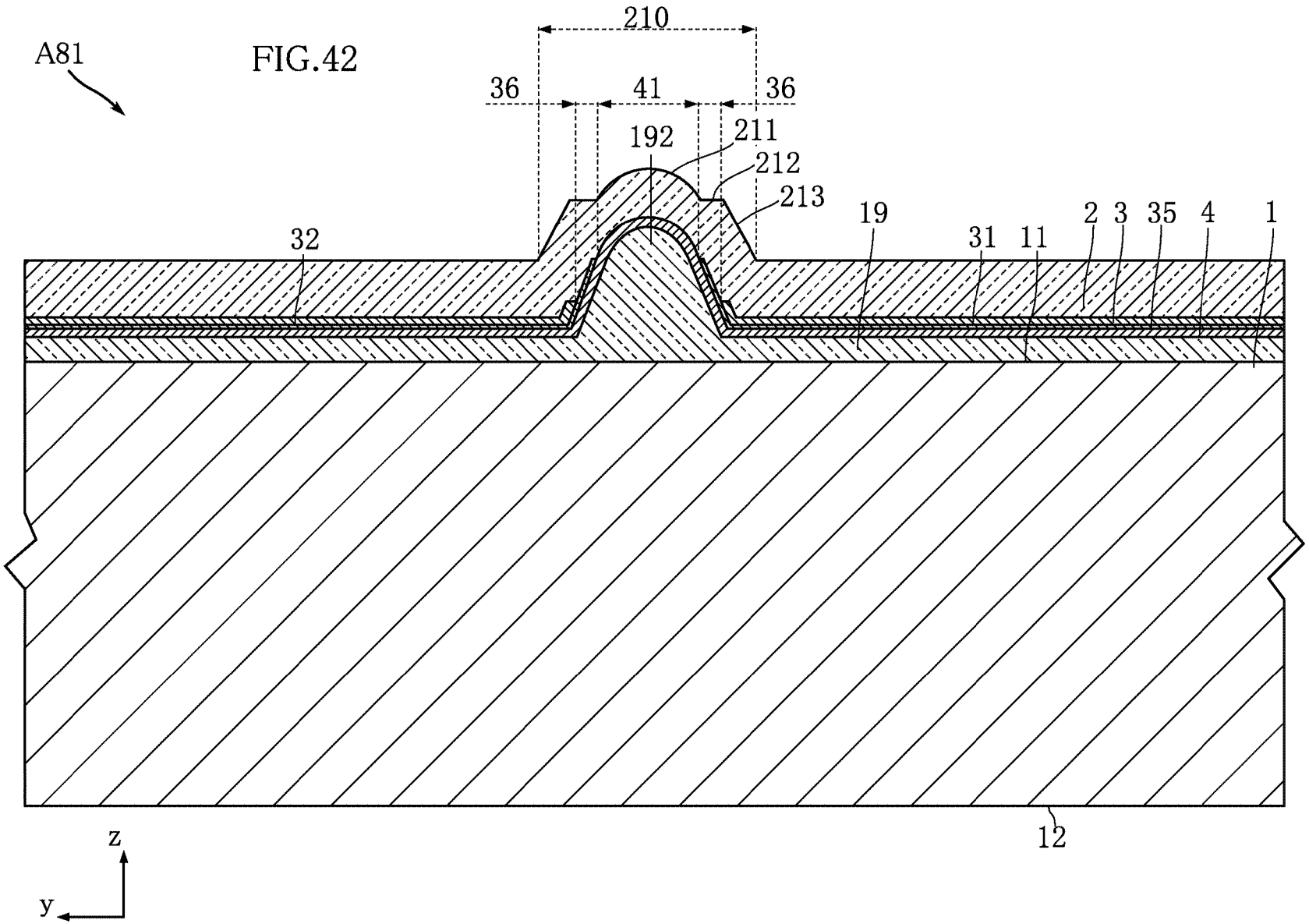
FIG. 42 is an enlarged cross-sectional view of a portion, showing a first modified example of the thermal printhead according to the eighth embodiment.

FIG. 42 shows a first modified example of the thermal printhead A8. In a thermal printhead A81 of the present modified example, the insulating layer 19 has a protrusion 192. The protrusion 192 is a site in which the insulating layer 19 partially protrudes in the z direction. The protrusion 192 has a shape that extends lengthwise in the x direction. The individual electrodes 31 and the common electrode 32 are provided on both sides of the protrusion 192 in the y direction. The multiple heat generation portions 41 are provided in a region overlapping with the protrusion 192 as viewed in the z direction.

The protection layer 2 includes a protrusion 210. The protrusion 210 has a shape that overlaps with the protrusion 192 as viewed in the z direction and protrudes in the z direction. The protrusion 210 has a first surface 211, a pair of second surfaces 212, and a pair of third surfaces 213. The first surface 211 is a surface of the protrusion 210 that is the furthest away from the first substrate 1 in the z direction, and in the example shown in the drawings, it is a curved surface that bulges in the z direction. The pair of second surfaces 212 are connected to both ends in the y direction of the first surface 211. The second surfaces 212 are surfaces that are approximately perpendicular to the z direction. The pair of third surfaces 213 are connected to both second surfaces 212 in the y direction. The pair of third surfaces 213 are surfaces that are inclined so as to be closer to the first substrate 1 in the z direction the further away they are from the second surface 212 in the y direction.

According to this kind of modified example as well, the durability and reliability of the thermal printhead A81 can be improved due to the presence of the auxiliary heat generation portions 36. Also, by providing the protrusion 192, the multiple heat generation portions 41 can be pressed more strongly against the printing paper via the first surface 211 and the pair of second surfaces 212 of the protrusion 210 of the protection layer 2, which is preferable for improving the printing quality.

Figure 43:
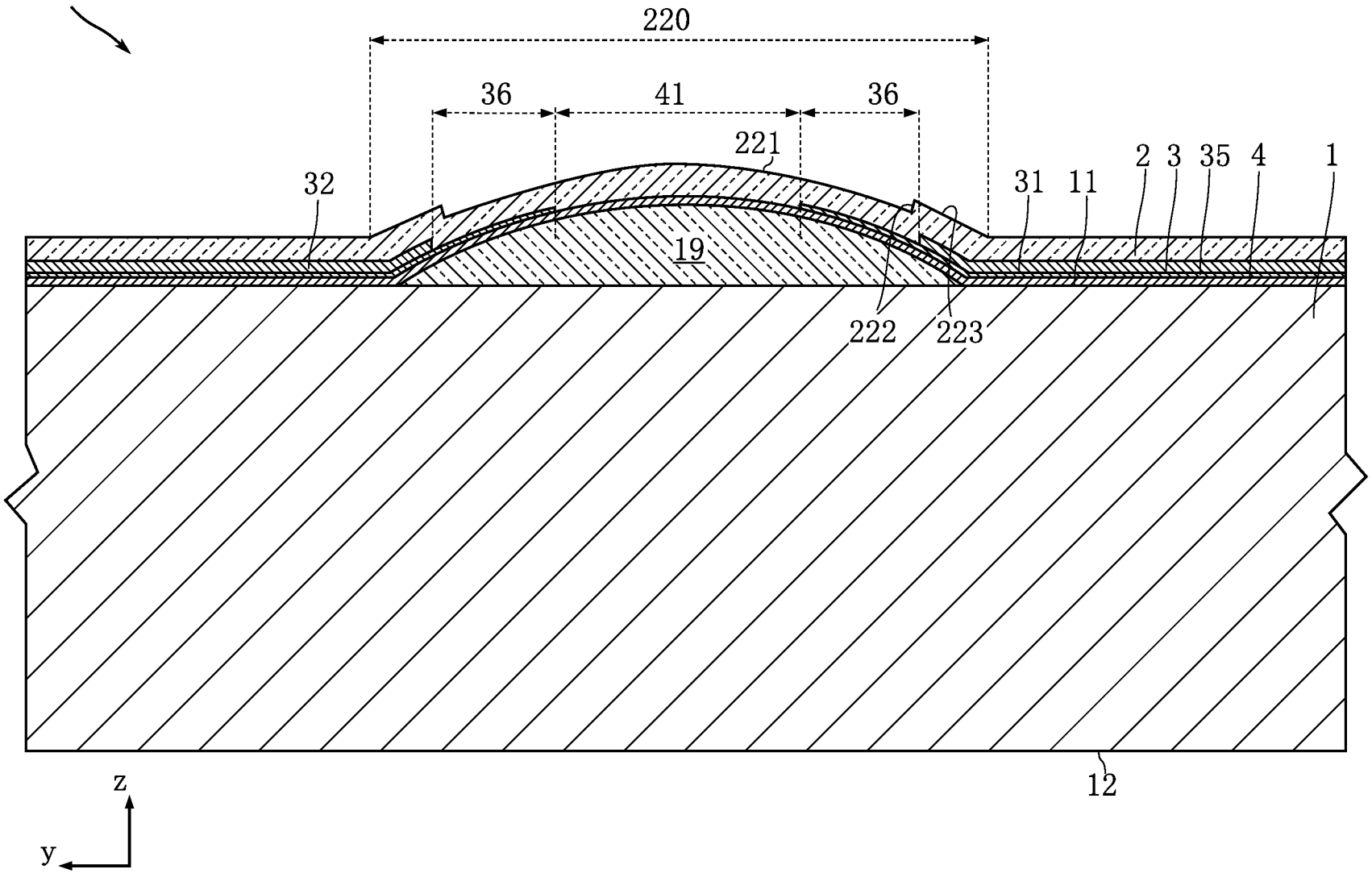
FIG. 43 is an enlarged cross-sectional view of a portion, showing a second modified example of the thermal printhead according to the eighth embodiment.

FIG. 43 shows a second modified example of the thermal printhead A8. In a thermal printhead A82 of the present modified example, the insulating layer 19 is provided so as to cover only part of the first front surface 11 in the y direction. The insulating layer 19 has a shape that gently protrudes in the z direction and extends lengthwise in the x direction. The multiple heat generation portions 41 and the multiple auxiliary heat generation portions 36 are provided on the insulating layer 19.

The protection layer 2 includes a protrusion 220. The protrusion 220 has a shape that overlaps with the insulating layer 19 as viewed in the z direction and protrudes in the z direction overall. The protrusion 220 has a first surface 221, a pair of second surfaces 222, and a pair of third surfaces 223. The first surface 221 is a surface of the protrusion 220 that is located in the approximate center in the y direction, and in the example shown in the drawings, it is a curved surface that gently bulges in the z direction. The pair of second surfaces 222 are connected to both ends in the y direction of the first surface 221. The second surface 222 has a shape that is further away from the first substrate 1 in the z direction the further away it is from the first surface 221 in the y direction, and the second surface 222 is slightly inclined with respect to the z direction. The pair of third surfaces 223 are surfaces that are gently inclined so as to be closer to the first substrate 1 in the z direction the further away they are from the second surface 222 in the y direction.

According to this kind of modified example as well, the durability and reliability of the thermal printhead A82 can be improved due to the presence of the auxiliary heat generation portions 36. Also, by including the insulating layer 19 with a bulging shape, the multiple heat generation portions 41 can be more strongly pressed against the printing paper via the protrusion 220 of the protection layer 2, which is preferable for improving the printing quality.

Figure 44:
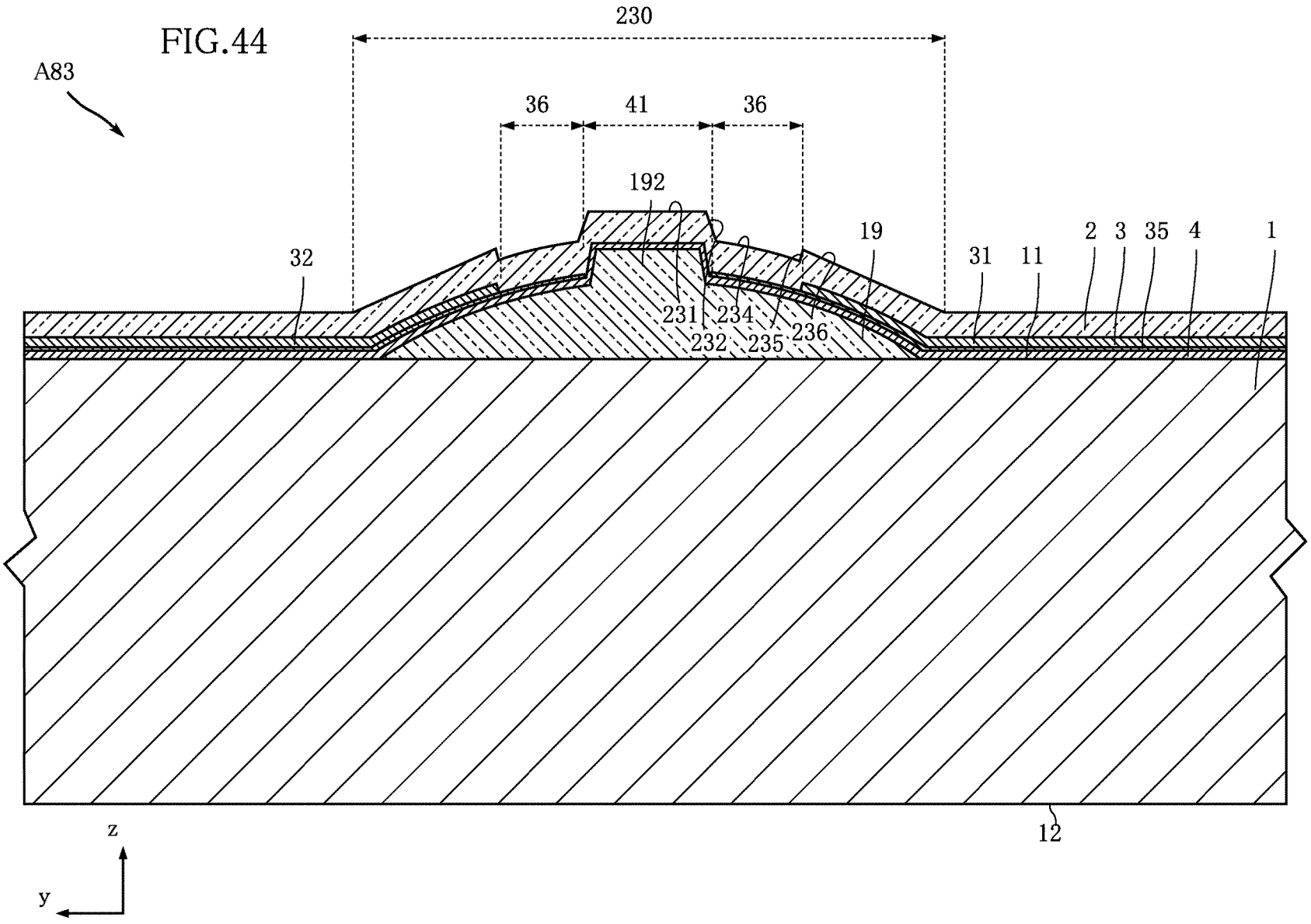
FIG. 44 is an enlarged cross-sectional view of a portion, showing a third modified example of the thermal printhead according to the eighth embodiment.

FIG. 44 shows a third modified example of the thermal printhead A8. In a thermal printhead A83 of the present modified example, the insulating layer 19 is provided so as to cover only part of the first front surface 11 in the y direction, and the thermal printhead A83 further includes a protrusion 192. The protrusion 192 is formed into a shape in which part of the insulating layer 19 partially protrudes relative to the surrounding site. In the present embodiment, the multiple heat generation portions 41 are provided on the protrusion 192. The pair of auxiliary heat generation portions 36 are provided on both sides in the secondary scanning direction y of the protrusion 192.

The protection layer 2 includes a protrusion 230. The protrusion 230 has a shape that overlaps with the insulating layer 19 as viewed in the z direction and protrudes in the z direction overall. The protrusion 230 has a first surface 231, a pair of second surfaces 232, a pair of third surfaces 233, a pair of fourth surfaces 234, a pair of fifth surfaces 235, and a pair of sixth surfaces 236. The first surface 231 is a surface of the protrusion 210 that is the furthest away from the first substrate 1 in the z direction, and in the example shown in the drawings, it is a surface that is approximately perpendicular to the z direction. The pair of second surfaces 223 are connected to both ends in the y direction of the first surface 231. The second surface 232 has a shape that is closer to the first surface 1 in the z direction the further away it is from the first surface 231 in the y direction, and the second surface 232 is slightly inclined with respect to the z direction. The pair of third surfaces 233 are connected to both second surfaces 232 in the y direction. The third surface 233 is inclined so as to be further away from the first substrate 1 in the z direction the further away it is from the second surface 232 in the y direction. The dimension in the z direction of the third surface 233 is smaller than the dimension in the z direction of the second surface 232. The pair of fourth surfaces 234 are connected to both of the pair of third surfaces 233 in the y direction. The fourth surface 234 is inclined so as to be closer to the first substrate 1 in the z direction the further away it is from the third surface 233 in the y direction, and the fourth surface 234 is a gently curved surface. The pair of fifth surfaces 235 are connected to both of the pair of fourth surfaces 234 in the y direction. The fifth surface 235 has a shape that is further away from the first substrate 1 in the z direction the further away it is from the fourth surface 234 in the y direction, and the fifth surface 235 is slightly inclined with respect to the z direction. The pair of sixth surfaces 236 are connected to both of the pair of fifth surfaces 235 in the y direction. The sixth surface 236 is inclined so as to be closer to the first substrate 1 in the z direction the further away it is from the fifth surface 235 in the y direction, and the sixth surface 236 is a gently curved surface.

According to this kind of modified example as well, the durability and reliability of the thermal printhead A83 can be improved due to the presence of the auxiliary heat generation portion 36. Also, due to the insulating layer 19 including the protrusion 192, the multiple heat generation portions 41 can be more strongly pressed against the printing paper via the protrusion 230 of the protection layer 2, and the printing quality can be further improved.

Figure 45:
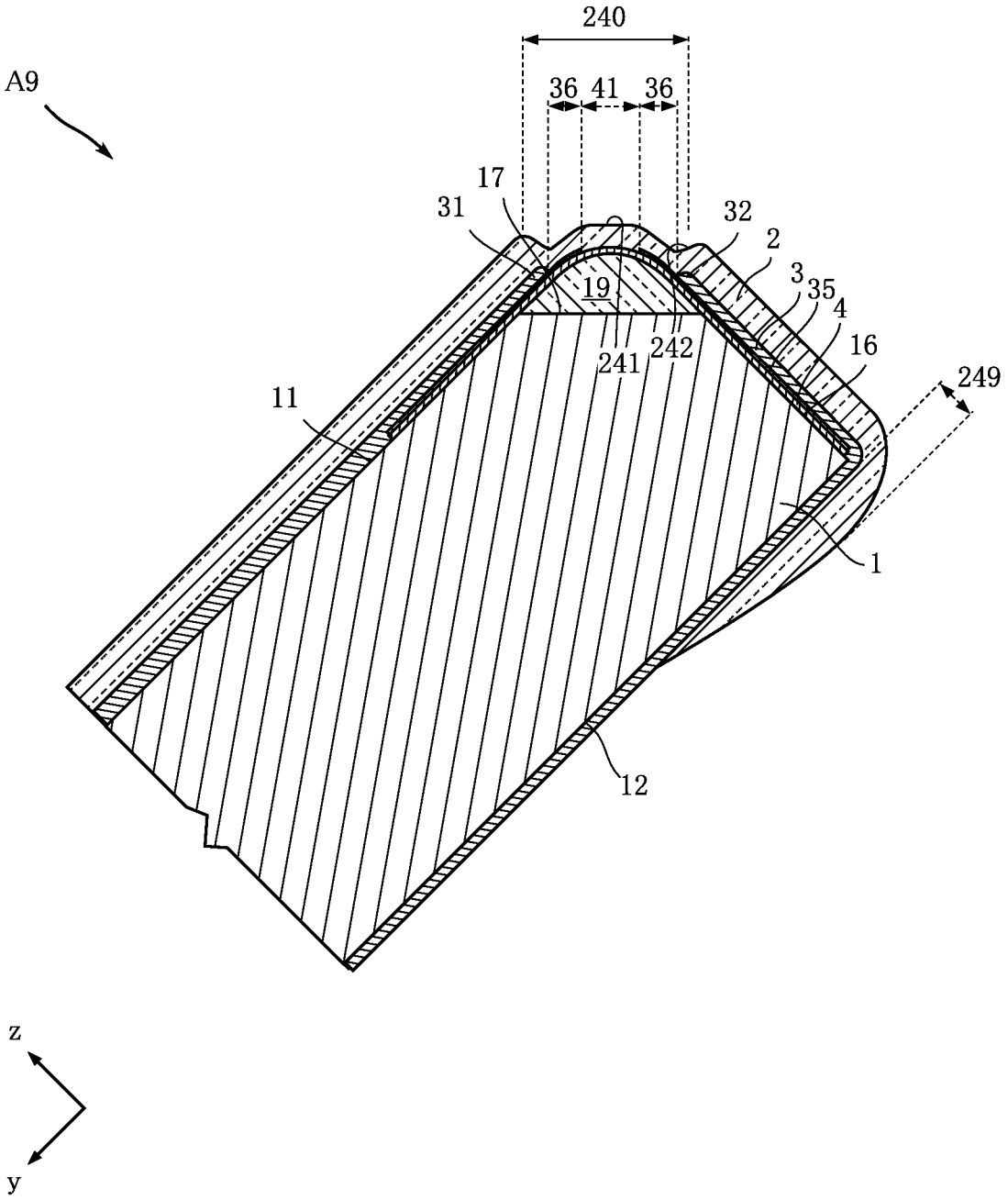
FIG. 45 is an enlarged cross-sectional view of a portion, showing a thermal printhead according to a ninth embodiment.

FIG. 45 shows a thermal printhead according to a ninth embodiment. In a thermal printhead A9 of the present embodiment, the first substrate 1 has the first front surface 11, the first rear surface 12, an end surface 16, and an inclined surface 17. The first substrate 1 is composed of ceramic. The end surface 16 is a surface that is located between the first front surface 11 and the first rear surface 12 in the z direction and is perpendicular to the y direction. The end surface 16 is connected to the first rear surface 12. The inclined surface 17 is interposed between the first front surface 11 and the end surface 16 and connects the first front surface 11 and the end surface 16. The inclined surface 17 is inclined with respect to the first front surface 11 and the end surface 16.

The insulating layer 19 is formed on the inclined surface 17 of the first substrate 1. The insulating surface 19 is flush with the first front surface 11 and the end surface 16 and has an approximately triangular shape as viewed in the x direction.

The resistor layer 4 covers at least part of the first front surface 11 and at least part of the insulating layer 19 and the end surface 16. The resistor layer 4 covers all of the insulating layer 19.

The second conduction layer 35 exposes portions that are to be the heat generation portions 41 of the resistor layer 4. The heat generation portions 41 are provided on the insulating layer 19. Also, the pair of auxiliary heat generation portions 36 are provided on both sides of the heat generation portions 41.

The first conduction layer 3 exposes the resistor layer 4 and the second conduction layer 35 on the insulating layer 19. Accordingly, the multiple heat generation portions 41 and the multiple auxiliary heat generation portions 36 are provided on the insulating layer 19.

The protection layer 2 is formed so as to overlap with the first front surface 11, the end surface 16, and the first rear surface 12 of the first substrate 1. The protection layer 2 includes a protrusion 240. The protrusion 240 has a shape that overlaps with the insulating layer 19 as viewed in a direction perpendicular to the inclined surface 17, and that bulges overall. The protrusion 240 has a first surface 241, a pair of second surfaces 242, and a pair of third surfaces 243. The first surface 241 is located in the approximate center as viewed in the x direction of the protrusion 240 and is an approximately flat surface in the example illustrated in the drawings. The pair of second surfaces 242 connect to both sides of the first surface 241 and are surfaces with a shape that is further away from the inclined surface 17 the further away it is from the first surface 241. The pair of third surfaces 243 are connected to the outer sides of the pair of second surfaces 242, and are surfaces that bulge gently as viewed in the x direction.

Also, the protection layer 2 has a bulging portion 249. The bulging portion 249 covers the portion of the first rear surface 12 on the side on which the inclined surface 17 is located in the y direction. The bulging portion 249 is a shape that bulges away from the first rear surface 12 in the z direction.

According to the present embodiment as well, the durability and reliability of the thermal printhead A9 can be improved due to the presence of the auxiliary heat generation portion 36. Also, the multiple heat generation portions 41 can be more strongly pressed against the printing paper.

Figure 46:
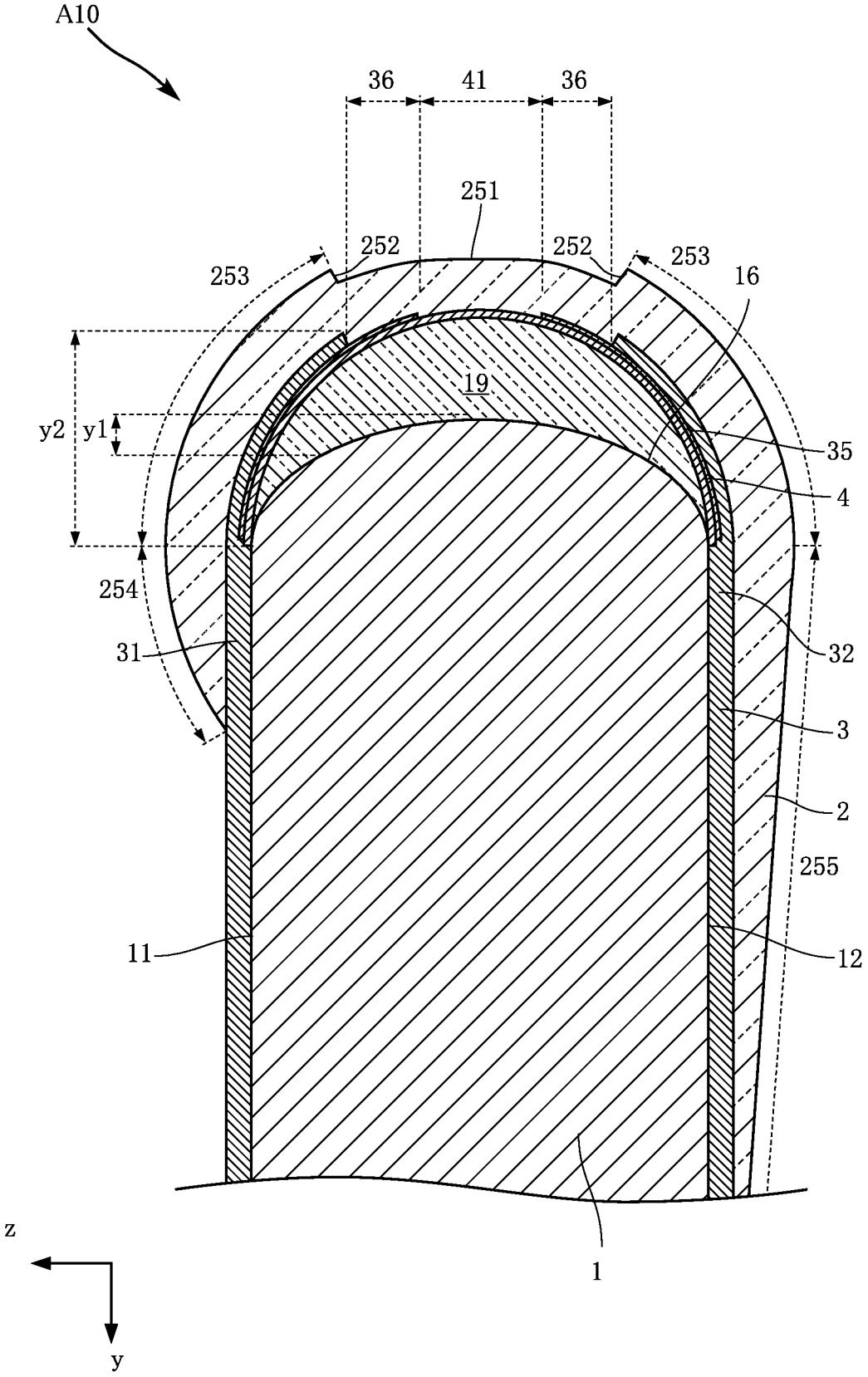
FIG. 46 is an enlarged cross-sectional view of a portion, showing a thermal printhead according to a tenth embodiment.

FIG. 46 shows a thermal printhead according to a tenth embodiment. In a thermal printhead A10 of the present embodiment, the first substrate 1 has a first front surface 11, a first rear surface 12, and an end surface 16. The first substrate 1 is composed of ceramic. The end surface 16 is connected to the first front surface 11 and the first rear surface 12. The end surface 16 is a curved surface that bulges in the y direction.

The insulating layer 19 is formed so as to cover the end surface 16 of the first substrate 1. The insulating layer 19 is a shape that bulges in the y direction.

The resistor layer 4 is formed so as to cover the insulating layer 19. The second conduction layer 35 exposes the resistor layer 4 in the region overlapping with the insulating layer 19 in the y direction. Accordingly, the multiple heat generation portions 41 are provided on the insulating layer 19. The first conduction layer 3 exposes the second conduction layer 35 in a region overlapping the insulating layer 19 as viewed in the y direction. Accordingly, the multiple auxiliary heat generation portions 36 are provided on the insulating layer 19.

The resistor layer 4 is curved overall by being formed on the insulating layer 19. The portion of the resistor layer 4 that overlaps with the first conduction layer 3 is curved such that its dimension in the y direction is a dimension y2. The dimension y2 is larger than the dimension y1.

The protection layer 2 has a first surface 251, a pair of second surfaces 252, a pair of third surfaces 253, a fourth surface 254, and a fifth surface 255. The first surface 251 is a surface of the protection layer 2 that is located in the approximate center in the x direction, and in the example illustrated in the drawings, it is a surface that is approximately perpendicular with respect to the y direction. The pair of second surfaces 252 are connected to both ends of the first surface 251 in the z direction and are inclined so as to be further away from the first substrate 1 in the y direction the further away they are from the first surface 251 in the z direction. The pair of third surfaces 253 are connected to the outer sides of the pair of second surfaces 252 in the z direction. The third surfaces 253 are curved surfaces with bulging shapes that approximately conform to the shape of the insulating layer 19. One end of the fourth surface 254 is connected to one of the third surfaces 253, and the other end is in contact with the first conduction layer 3. The fourth surface 254 is a curved surface that smoothly connects from the third surface 253. The fifth surface 255 is connected to the other third surface 253. The fifth surface 255 has a shape that is closer to the first rear surface 12 the further away it is from the third surface 253 in the y direction. The fifth surface 255 has a larger area than the third surface 253 and is an approximately flat surface.

According to the present embodiment as well, the durability and reliability of the thermal printhead A10 can be improved due to the presence of the auxiliary heat generation portion 36. Also, the multiple heat generation portions 41 can be more strongly pressed against the printing paper.

Figure 47:
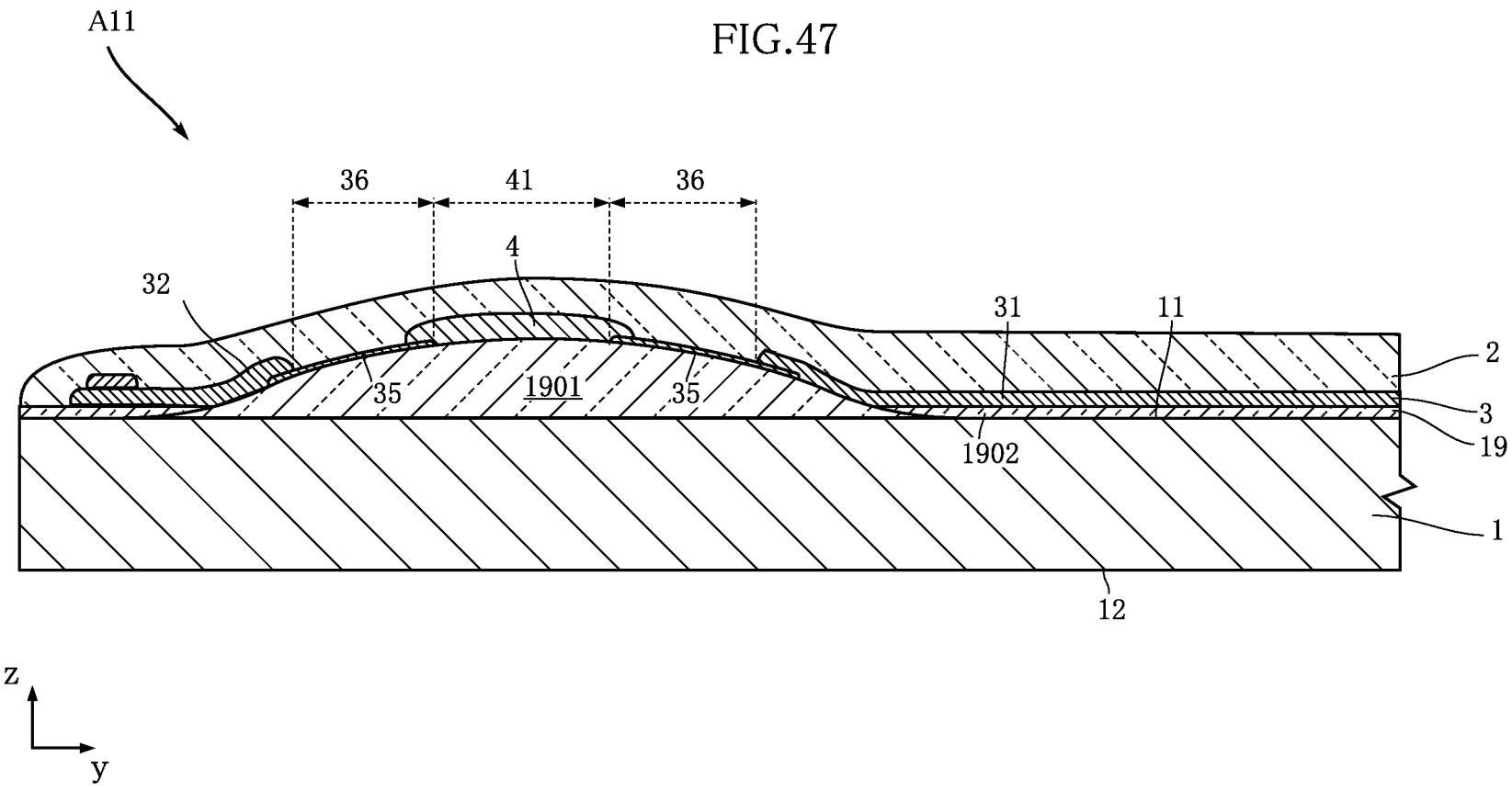
FIG. 47 is an enlarged cross-sectional view of a portion, showing a thermal printhead according to an eleventh embodiment.

FIG. 47 shows a thermal printhead according to an eleventh embodiment. In a thermal printhead A11 of the present embodiment, the first substrate 1 is composed of an insulating material such as ceramic, for example. Also, the protection layer 2, the first conduction layer 3, the second conduction layer 35, and the resistor layer 4 are formed through a procedure using printing and firing.

In the present embodiment, the insulating layer 19 has a heater glaze portion 1901 and a flat portion 1902. The heater glaze portion 1901 is a portion that gently bulges in the z direction. The flat portion 1902 covers the portion of the first front surface 11 that is exposed from the heater glaze portion 1901, and has a flat shape. The insulating layer 19 is composed of glass, for example.

The first conduction layer 3 is formed by printing a resinate Au paste including Au, for example, and firing the resinate Au paste. The first conduction layer 3 is formed straddling the heater glaze portion 1901 and the flat portion 1902. The individual electrode 31 and the common electrode 32 of the first conduction layer 3 are each provided on part of the heater glaze portion 1901.

The second conduction layer 35 is formed by printing a paste including Ti or a resistor material, for example, and firing the paste. The second conduction layer 35 is formed on the heater glaze portion 1901 and part thereof overlaps with the individual electrode 31 and the common electrode 32. In the example illustrated in the drawings, the second conduction layer 35 is interposed between the heater glaze portion 1901 and the first conduction layer 3. The second conduction layer 35 has two regions that are separate in the y direction on the heater glaze portion 1901.

The resistor layer 4 is formed by printing a paste including TaN or a resistor material, for example, and firing the paste. The resistor layer 4 is formed so as to overlap with part of the second conduction layer 35 on the heater glaze portion 1901. The portion of the resistor layer 4 held by the second conduction layer 35 is the heat generation portion 41. Also, on both sides in the y direction of the heat generation portion 41, the portions of the second conduction layer 35 that are exposed from the first conduction layer 3 constitute a pair of auxiliary heat generation portions 36.

The protection layer 2 is composed of glass, for example, and covers the first conduction layer 3, the second conduction layer 35, and the resistor layer 4.

According to the present embodiment as well, the durability and reliability of the thermal printhead A11 can be improved due to the presence of the auxiliary heat generation portion 36. Also, the first conduction layer 3, the second conduction layer 35, and the resistor layer 4 formed using the procedures of printing and firing are advantageous in that they are not likely to be damaged through friction.

The thermal printhead according to the present disclosure is not limited to the above-described embodiments. The specific configurations of the units of the thermal printhead according to the present disclosure can be designed and modified in various ways.

Appendix B1

A thermal printhead including:

a substrate;

a resistor layer including a plurality of heat generation portions that are supported by the substrate and are aligned in a primary scanning direction;

a first conduction layer that is supported by the substrate, forms conductive path to the plurality of heat generation portions, and has a resistance value per unit length in a secondary scanning direction that is smaller than that of the heat generation portions; and a second conduction layer that has auxiliary heat generation portions that are adjacent to the heat generation portions in the secondary scanning direction and come into contact with the first conduction layer, the second conduction layer having a resistance per unit length in the secondary scanning direction that is between that of the heat generation portions and the first conduction layer.

Appendix B2

The thermal printhead according to Appendix B1, wherein the substrate is composed of a single-crystal semiconductor, and has a front surface and a protrusion that protrudes from the front surface and extends in the primary scanning direction, the protrusion has a peak portion at which a distance from the front surface is the greatest, and a pair of first inclined portions that connect to the peak portion on both sides in the secondary scanning direction and are inclined with respect to the front surface, and the heat generation portion is formed on at least part of the peak portion in the secondary scanning direction.

Appendix B3

The thermal printhead according to Appendix B2, wherein the protrusion has a pair of second inclined portions that are connected to the pair of first inclined portions on sides opposite to the peak portion in the secondary scanning direction, and that are inclined with respect to the front surface at an inclination angle greater than that of the first inclined portions.

Appendix B4

The thermal printhead according to Appendix B3, wherein the heat generation portions are formed over the entire length of the peak portion in the secondary scanning direction.

Appendix B5

The thermal printhead according to Appendix B4, wherein the auxiliary heat generation portions are formed on at least part of the first inclined portion in the secondary scanning direction.

Appendix B6

The thermal printhead according to Appendix B5, wherein the heat generation portions are each further formed on part of the pair of first inclined portions in the secondary scanning direction, straddling boundaries between the peak portion and the pair of first inclined portions.

Appendix B7

The thermal printhead according to Appendix B6, wherein a pair of the auxiliary heat generation portions are formed so as to individually straddle a boundary between the pair of first inclined portions and the pair of second inclined portions.

Appendix B8

The thermal printhead according to Appendix B7, wherein the auxiliary heat generation portions are each formed on respective parts of the first inclined portion and the second inclined portion in the secondary scanning direction.

Appendix B9

The thermal printhead according to Appendix B2, wherein the heat generation portions are formed so as to straddle a boundary between the peak portion and the first inclined portion, on part of the peak portion in the secondary scanning direction and on at least part in the secondary scanning direction of the first inclined portion located downstream in the secondary scanning direction, and the auxiliary heat generation portions are formed so as to straddle a boundary between the peak portion and the first inclined portion, on part of the peak portion in the secondary scanning direction and on at least part of the first inclined portion located upstream in the secondary scanning direction.

Appendix B10

The thermal printhead according to Appendix B9, wherein the heat generation portions are formed so as to straddle a boundary between the first inclined portion and the second inclined portion over the entire length of the first inclined portion located downstream in the secondary scanning direction and on part of the second inclined portion located downstream in the secondary scanning direction.

Appendix B11

The thermal printhead according to Appendix B10, including a pair of the auxiliary heat generation portions, wherein one of the auxiliary heat generation portions is formed so as to straddle a boundary between the peak portion and the first inclined portion on part of the peak portion in the secondary scanning direction and on part of the first inclined portion located upstream in the secondary scanning direction.

Appendix B12

The thermal printhead according to Appendix B11, wherein the other auxiliary heat generation portion is formed on part of the second inclined portion located downstream in the secondary scanning direction.

Appendix B13

The thermal printhead according to any one of Appendixes B1 to B12, wherein the resistor layer is formed between the substrate and the first conduction layer.

Appendix B14

The thermal printhead according to Appendix B13, wherein the second conduction layer is formed between the resistor layer and the first conduction layer.

Appendix B15

The thermal printhead according to Appendix B13, wherein the second conduction layer is formed on the side of the resistor layer and the first conduction layer opposite to the substrate.

Appendix B16

The thermal printhead according to any one of Appendixes B1 to B15, wherein the resistor layer includes TaN.

Appendix B17

The thermal printhead according to any one of Appendixes B1 to B16, wherein the first conduction layer includes Cu.

Appendix B18

The thermal printhead according to any one of Appendixes B1 to B17, wherein the second conduction layer includes Ti.

Appendix B19

The thermal printhead according to any one of Appendixes B1 to B18, wherein the second conduction layer is thinner than the resistor layer.

Appendix B20

The thermal printhead according to Appendix B1, wherein the substrate is composed of ceramic.

Appendix B21

The thermal printhead according to Appendix B20, wherein the resistor layer is located between the substrate and the first conduction layer.

Appendix B22

The thermal printhead according to Appendix B20, wherein the second conduction layer has a site interposed between the substrate and the resistor layer, and the resistor layer and the first conduction layer are formed by firing a paste containing a metal.

The thermal printhead according to the present disclosure is not limited to the above-described embodiments. The specific configurations of the units of the thermal printhead can be designed and modified in various ways.

The invention claimed is:

1. A thermal printhead including:

a substrate;

a resistor layer including a plurality of heat generation portions that are supported by the substrate and are aligned in a primary scanning direction;

a wiring layer that is supported by the substrate and forms a conductive path to the plurality of heat generation portions;

an insulating layer interposed between the substrate and the resistor layer; and a reflection layer located opposite to the plurality of heat generation portions with respect to the insulating layer, the reflection layer overlapping with the plurality of heat generation portions as viewed in a thickness direction of the plurality of heat generation portions and having a greater heat reflectivity than the insulating layer, wherein the reflection layer is interposed between the insulating layer and the substrate, the substrate comprises a single-crystal semiconductor, the reflection layer comprises Ti, and the reflection layer includes: a reflection first layer in contact with the substrate; and a reflection second layer formed on the reflection first layer.

2. The thermal printhead according to claim 1, wherein the substrate comprises Si.

3. The thermal printhead according to claim 1, wherein the reflection second layer is in contact with the insulating layer.

4. The thermal printhead according to claim 1, wherein the reflection first layer comprises Ti, and the reflection second layer comprises Cu.

5. The thermal printhead according to claim 1, wherein the reflection layer is insulated from the wiring layer.

6. The thermal printhead according to claim 1, wherein the reflection layer is electrically connected to a part of the wiring layer.

7. The thermal printhead according to claim 1, wherein the substrate includes: a front surface on which the insulating layer is formed; and a protrusion that protrudes from the front surface and extends in the primary scanning direction, the protrusion includes a peak portion at which a distance from the front surface is the greatest, and a first inclined portion that connects to the peak portion in a secondary scanning direction and is inclined with respect to the front surface, and the heat generation portions are formed on at least part of the peak portion in the secondary scanning direction and on at least part of the first inclined portion in the secondary scanning direction, straddling a boundary between the peak portion and the first inclined portion.

8. A thermal printhead including:

a substrate;

a resistor layer including a plurality of heat generation portions that are supported by the substrate and are aligned in a primary scanning direction;

a wiring layer that is supported by the substrate and forms a conductive path to the plurality of heat generation portions;

an insulating layer interposed between the substrate and the resistor layer; and a reflection layer located opposite to the plurality of heat generation portions with respect to the insulating layer, the reflection layer overlapping with the plurality of heat generation portions as viewed in a thickness direction of the plurality of heat generation portions and having a greater heat reflectivity than the insulating layer, wherein the reflection layer is interposed between the insulating layer and the substrate, the substrate comprises a single-crystal semiconductor, and the reflection layer includes a through portion that allows contact between the substrate and the insulating layer.

9. A thermal printhead including:

a substrate;

a resistor layer including a plurality of heat generation portions that are supported by the substrate and are aligned in a primary scanning direction;

a wiring layer that is supported by the substrate and forms a conductive path to the plurality of heat generation portions;

an insulating layer interposed between the substrate and the resistor layer; and a reflection layer located opposite to the plurality of heat generation portions with respect to the insulating layer, the reflection layer overlapping with the plurality of heat generation portions as viewed in a thickness direction of the plurality of heat generation portions and having a greater heat reflectivity than the insulating layer, wherein the reflection layer is interposed between the insulating layer and the substrate, the substrate comprises a single-crystal semiconductor, the substrate includes: a front surface on which the insulating layer is formed; and a protrusion that protrudes from the front surface and extends in the primary scanning direction, the protrusion includes a peak portion at which a distance from the front surface is the greatest, and a first inclined portion that connects to the peak portion in a secondary scanning direction and is inclined with respect to the front surface, the heat generation portions are formed on at least part of the peak portion in the secondary scanning direction and on at least part of the first inclined portion in the secondary scanning direction, straddling a boundary between the peak portion and the first inclined portion, and the protrusion includes a second inclined portion that is connected to the first inclined portion on the side opposite to the peak portion in the secondary scanning direction, and that is inclined with respect to the front surface at an inclination angle greater than that of the first inclined portion.

10. The thermal printhead according to claim 9, wherein the protrusion includes a pair of first inclined portions located on both sides of the peak portion in the secondary scanning direction.

11. The thermal printhead according to claim 10, wherein the protrusion includes a pair of second inclined portions located on both sides of the pair of first inclined portions in the secondary scanning direction.

12. The thermal printhead according to claim 11, wherein the heat generation portions are formed over an entire length of the peak portion in the secondary scanning direction and over an entire length of the pair of first inclined portions in the secondary scanning direction.

13. The thermal printhead according to claim 10, wherein the heat generation portions are further formed on at least a part of the second inclined portion in the secondary scanning direction, straddling the boundary between the first inclined portion and the second inclined portion.

* * * * *